US011384640B2

(12) United States Patent
Walunj et al.

(10) Patent No.: US 11,384,640 B2
(45) Date of Patent: Jul. 12, 2022

(54) AIRFOIL SHAPE AND PLATFORM CONTOUR FOR TURBINE ROTOR BLADES

(71) Applicant: General Electric Company, Schenectady, NY (US)

(72) Inventors: Jalindar Appa Walunj, Bangalore (IN); Sylvain Pierre, Greer, SC (US); Prem Venugopal, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 16/199,353

(22) Filed: Nov. 26, 2018

(65) Prior Publication Data

US 2020/0165918 A1 May 28, 2020

(51) Int. Cl.
*F01D 5/14* (2006.01)
*F01D 5/06* (2006.01)

(52) U.S. Cl.
CPC ..... *F01D 5/141* (2013.01); *F01D 5/066* (2013.01); *F05D 2240/303* (2013.01); *F05D 2240/304* (2013.01); *F05D 2240/305* (2013.01); *F05D 2240/306* (2013.01); *F05D 2240/307* (2013.01); *F05D 2240/80* (2013.01); *F05D 2250/74* (2013.01)

(58) Field of Classification Search
CPC ... F01D 5/06; F01D 5/066; F01D 5/14; F01D 5/141; F01D 5/142; F01D 5/145; F04D 29/38; F04D 29/384; F05D 2240/303; F05D 2240/304; F05D 2240/305; F05D 2240/306; F05D 2240/307; F05D 2240/80; F05D 2250/74
See application file for complete search history.

(56) References Cited

U.S. PATENT DOCUMENTS

| | | | | |
|---|---|---|---|---|
| 6,503,054 | B1 | 1/2003 | Bielek et al. | |
| 6,685,434 | B1 | 2/2004 | Humanchuk et al. | |
| 6,736,599 | B1 | 5/2004 | Jacks et al. | |
| 6,739,838 | B1 | 5/2004 | Bielek et al. | |
| 6,779,980 | B1 | 8/2004 | Brittingham et al. | |
| 7,329,093 | B2 * | 2/2008 | Vandeputte | F01D 5/141 415/191 |
| 7,527,473 | B2 | 5/2009 | Humanchuk et al. | |
| 7,731,483 | B2 | 6/2010 | DeLong et al. | |
| 7,837,445 | B2 | 11/2010 | Benjamin et al. | |

(Continued)

*Primary Examiner* — David E Sosnowski
*Assistant Examiner* — Julian B Getachew
(74) *Attorney, Agent, or Firm* — Charlotte Wilson; Hoffman Warnick LLC

(57) ABSTRACT

A turbine rotor blade including an airfoil that extends from a platform. The platform may include a first portion of a nominal platform contour substantially in accordance with Cartesian coordinate values of X', Y', and Z' as set forth in Table II. The Cartesian coordinate values of X', Y', and Z' are non-dimensional values from 0% to 100% convertible to dimensional distances by multiplying the Cartesian coordinate values of X', Y', and Z' by a height of the airfoil defined along a Z' axis. The X' and Y' values of the first portion are coordinate values that, when connected by smooth continuing arcs, define contour lines of the first portion of the nominal airfoil profile at each Z' coordinate value. The contour lines may be joined smoothly with one another to form the first portion.

19 Claims, 3 Drawing Sheets

(56) References Cited

U.S. PATENT DOCUMENTS

| | | | | |
|---|---|---|---|---|
| 8,070,428 | B2 | 12/2011 | Bielek et al. | |
| 8,133,016 | B2 | 3/2012 | McGovern et al. | |
| 8,133,030 | B2 | 3/2012 | Grafitti et al. | |
| 8,231,353 | B2 | 7/2012 | Siden et al. | |
| 8,313,291 | B2 | 11/2012 | Mariotti et al. | |
| 8,371,818 | B2 | 2/2013 | Brittingham et al. | |
| 8,702,384 | B2 * | 4/2014 | Baer | F04D 29/324 415/191 |
| 8,807,950 | B2 | 8/2014 | Bielek et al. | |
| 8,814,511 | B2 | 8/2014 | Check et al. | |
| 9,828,857 | B2 * | 11/2017 | Huxol | F01D 5/005 |

* cited by examiner

AIRFOIL SHAPE AND PLATFORM CONTOUR FOR TURBINE ROTOR BLADES

BACKGROUND OF THE INVENTION

The subject matter disclosed herein relates to turbine engine airfoils and, more specifically, to airfoils of turbine rotor blades.

Some aircraft and/or power plant systems, for example certain jet aircraft, gas turbines, and combined cycle power plant systems, employ turbines (also referred to as turbomachines) in their design and operation. These turbines employ airfoils (e.g., turbine rotor blades, blades, airfoils, etc.) which during operation are exposed to fluid flows. These airfoils—and the endwalls or platforms from which the airfoils extend—are configured to aerodynamically interact with the fluid flows and generate energy (e.g., creating thrust, turning kinetic energy to mechanical energy, thermal energy to mechanical energy, etc.) from these fluid flows as part of power generation. As a result of this interaction and conversion, the aerodynamic characteristics and losses of the airfoils and platforms have an impact on system and turbine operation, performance, thrust, efficiency, and power.

BRIEF DESCRIPTION OF THE INVENTION

Aspects and advantages are set forth below in the following description, or may be obvious from the description, or may be learned through practice.

According to an exemplary embodiment, a turbine rotor blade includes an airfoil that extends from a platform, with the platform including a first portion of a nominal platform contour substantially in accordance with Cartesian coordinate values of X', Y', and Z' as set forth in Table II. The Cartesian coordinate values of X', Y', and Z' are non-dimensional values from 0% to 100% convertible to dimensional distances by multiplying the Cartesian coordinate values of X', Y', and Z' by a height of the airfoil defined along a Z' axis. The X' and Y' values of the first portion are coordinate values that, when connected by smooth continuing arcs, define contour lines of the first portion of the nominal airfoil profile at each Z' coordinate value. The contour lines may be joined smoothly with one another to form the first portion.

According to an exemplary embodiment, the present disclosure includes a turbine rotor blade having an airfoil that includes a pressure side portion of a nominal airfoil profile substantially in accordance with Cartesian coordinate values of X, Y, and Z of a pressure side as set forth in Table I. The Cartesian coordinate values of X, Y, and Z are non-dimensional values from 0% to 100% convertible to dimensional distances by multiplying the Cartesian coordinate values of X, Y, and Z by a height of the airfoil defined along the Z axis. The X and Y values of the pressure side are coordinate values that, when connected by smooth continuing arcs, define pressure side sections of the pressure side portion of the nominal airfoil profile at each Z coordinate value. The pressure side sections may be joined smoothly with one another to form the pressure side portion.

According to another exemplary embodiment, the present disclosure includes a turbine rotor blade having an airfoil that includes a suction side portion of a nominal airfoil profile substantially in accordance with Cartesian coordinate values of X, Y, and Z of a suction side as set forth in Table I. The Cartesian coordinate values of X, Y, and Z are non-dimensional values from 0% to 100% convertible to dimensional distances by multiplying the Cartesian coordinate values of X, Y, and Z by a height of the airfoil defined along the Z axis. The X and Y values of the suction side are coordinate values that, when connected by smooth continuing arcs, define suction side sections of the suction side portion of the nominal airfoil profile at each Z coordinate value. The suction side sections may be joined smoothly with one another to form the suction side portion.

According to another exemplary embodiment, the present disclosure includes a turbine engine that has an airfoil that includes: a pressure side portion of a nominal airfoil profile substantially in accordance with Cartesian coordinate values of X, Y, and Z of a pressure side as set forth in Table I; and a suction side portion of the nominal airfoil profile substantially in accordance with Cartesian coordinate values of X, Y, and Z of the suction side as set forth in Table I. The Cartesian coordinate values of X, Y, and Z are non-dimensional values from 0% to 100% convertible to dimensional distances by multiplying the Cartesian coordinate values of X, Y, and Z by a height of the airfoil defined along the Z axis. The X and Y values of the pressure side are coordinate values that, when connected by smooth continuing arcs, define pressure side sections of the pressure side portion of the nominal airfoil profile at each Z coordinate value. The pressure side sections may be joined smoothly with one another to form the pressure side portion. The X and Y values of the suction side are coordinate values that, when connected by smooth continuing arcs, define suction side sections of the suction side portion of the nominal airfoil profile at each Z coordinate value. The suction side sections may be joined smoothly with one another to form the suction side portion.

Those of ordinary skill in the art will better appreciate the features and aspects of such embodiments, and others, upon review of the specification.

BRIEF DESCRIPTION OF THE DRAWINGS

A full and enabling disclosure of various embodiments, including the best mode thereof to one skilled in the art, is set forth more particularly in the remainder of the specification, including reference to the accompanying figures, in which.

DETAILED DESCRIPTION OF THE INVENTION

One or more specific embodiments of the present subject matter will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present subject matter, the articles "a," "an," "the," and "said" are intended to mean that there are one or more of the elements. The terms "comprising," "including," and "having" are intended to be inclusive and mean that there may be additional elements other than the listed elements.

Figure 1:
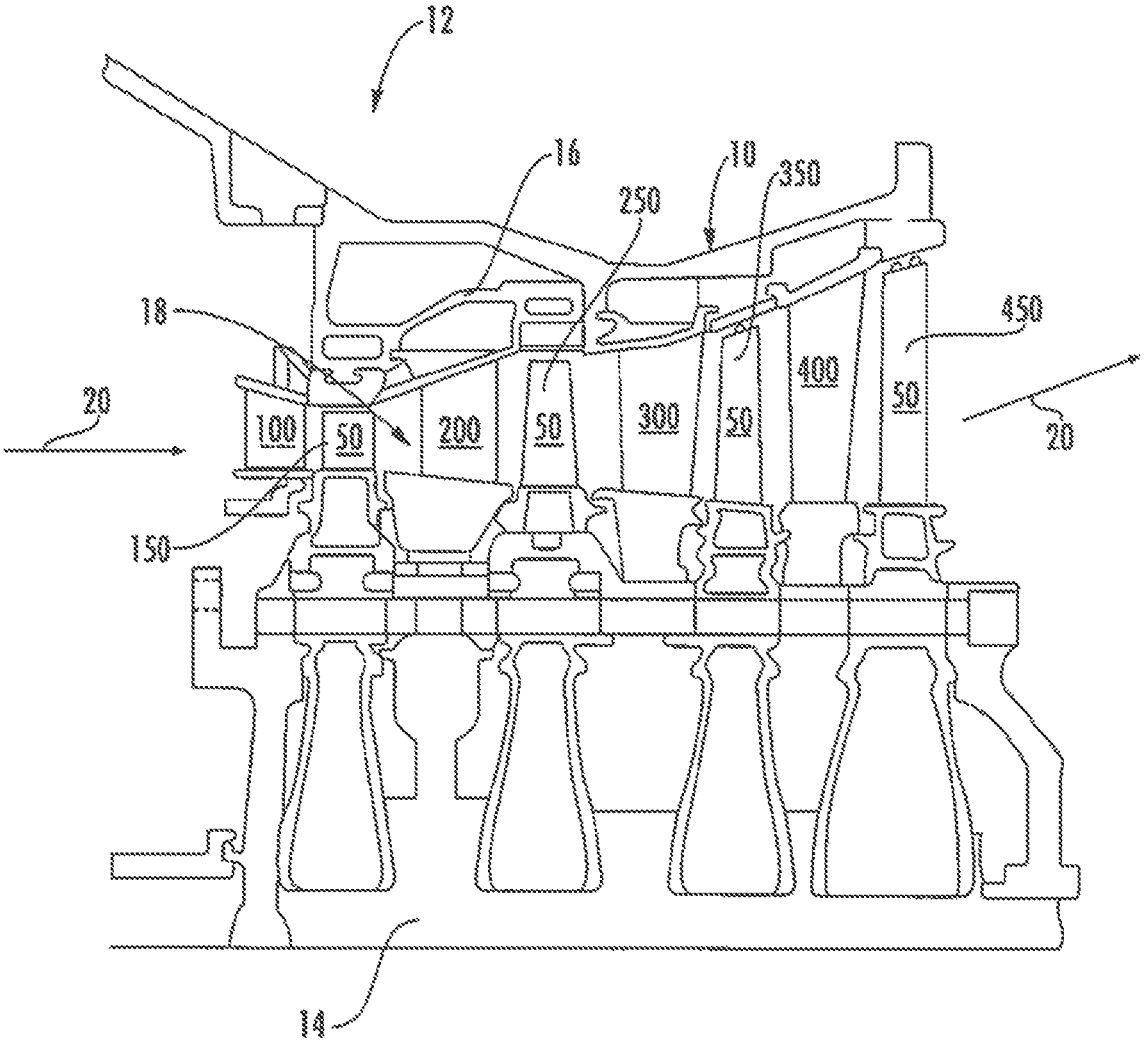
FIG. 1 is a schematic representation of an exemplary turbine having multiple stages with each stage including alternating rows of turbine rotor blades and stationary vanes or nozzles according to at least one embodiment of the present disclosure.

Referring now to the drawings, particularly to FIG. 1, there is illustrated an exemplary turbine 10 of a combustion or gas turbine 12 including a plurality of turbine stages arranged in serial flow order. Each stage of the turbine includes a row of turbine vanes or nozzles disposed axially adjacent to a corresponding row of turbine rotor blades. While four stages are illustrated in FIG. 1, the exact number of stages of the turbine 10 is a choice of engineering design, and may be more or less than the four stages shown. The four stages are merely exemplary of one turbine design, and are not intended to limit the presently claimed turbine rotor blade in any manner.

As depicted in FIG. 1, the first stage includes a plurality of turbine nozzles 100 and a plurality of turbine rotor blades 150. The turbine nozzles 100 are annularly arranged about an axis of a turbine rotor 14, while the turbine rotor blades 150 are annularly arranged about and coupled to the turbine rotor 14. A second stage of the turbine 12 includes a plurality of turbine nozzles 200 annularly arranged about the axis of the turbine rotor 14 and a plurality of turbine rotor blades 250 annularly arranged about and coupled to the turbine rotor 14. A third stage of the turbine 12 includes a plurality of turbine nozzles 300 annularly arranged about the axis of the turbine rotor 14 and a plurality of turbine rotor blades 350 annularly arranged about and coupled to the turbine rotor 14. In particular embodiments, the turbine 12 may further include a fourth stage, which also includes plurality of turbine nozzles 400 annularly arranged about the axis of the turbine rotor 14 and a plurality of turbine rotor blades 450 annularly arranged about and coupled to the turbine rotor 14. As will be appreciated, the turbine nozzles 100, 200, 300, 400 may be coupled to the casing 16 of the turbine 12 and remain stationary during operation.

It will be appreciated that the turbine nozzles 100, 200, 300 and 400 and turbine rotor blades 150, 250, 350 and 450 are disposed or at least partially disposed within a working fluid or hot gas path 18 of the turbine 12. The various stages of the turbine 10 at least partially define the hot gas path 18 through which combustion gases, as indicated by arrows 20, flow during operation of the gas turbine 12.

Figure 2:
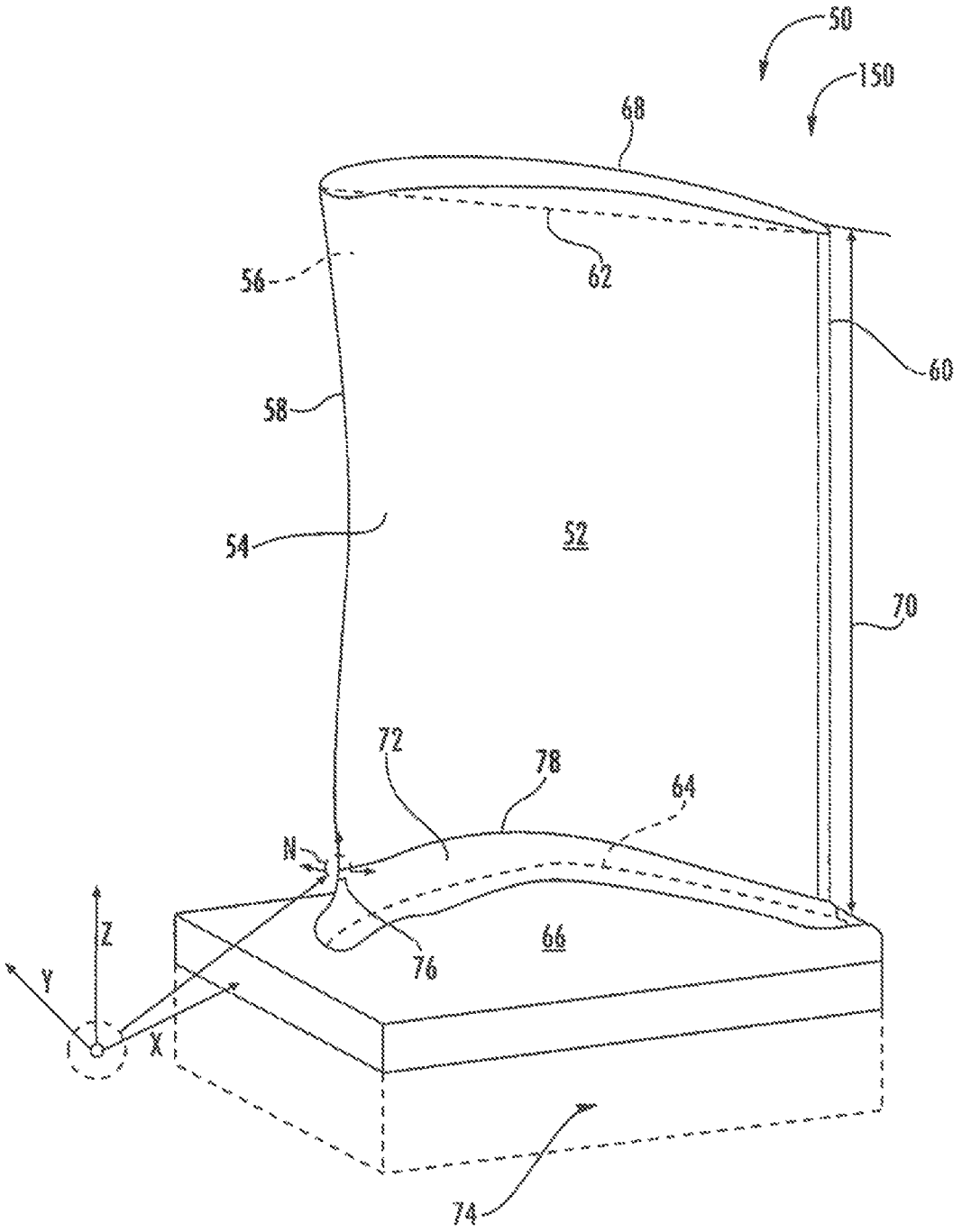
FIG. 2 is a perspective view of a turbine rotor blade according to at least one embodiment of the present disclosure.

FIG. 2 provides a perspective view of an exemplary turbine rotor blade 50, as may be incorporated in one of the stages of the turbine 12. In a preferred embodiment of the present disclosure, the turbine rotor blade 50 (as described by the points included within Table I below) is a turbine rotor blade 250 of the plurality of the turbine rotor blades 250 used in the second stage of the turbine 12, as shown in FIG. 1. As illustrated in FIG. 2, the turbine rotor blade 50 includes an airfoil 52 having a pressure side 54 and an opposing suction side 56. The pressure side 54 and the suction side 56 meet or intersect at a leading edge 58 and a trailing edge 60 of the airfoil 52. A chord line 62 extends between the leading edge 58 and the trailing edge 60 such that pressure and suction sides 54, 56 can be said to extend in chord or chordwise between the leading edge 58 and the trailing edge 60.

The airfoil 52 further includes a first end or root 64 which intersects with and extends radially outwardly from an endwall or platform 66 of the turbine rotor blade 50. The airfoil 52 terminates radially at a second end or radial tip 68 of the airfoil 52. The pressure and suction sides 54, 56 can be said to extend in span or in a span-wise direction 70 (along the height of the airfoil 52) between the platform 66 and the radial tip 68 of the airfoil 52. In other words, each turbine rotor blade 50 includes an airfoil 52 having opposing pressure and suction sides 54, 56 that extend in chord or chordwise 62 between opposing leading and trailing edges 58, 60 and that extend in span or span-wise 70 between the platform 66 and the radial tip 68 of the airfoil 52.

In particular configurations, the airfoil 52 may include a fillet 72 formed between the platform 66 and the airfoil 52 proximate to the root 64. The fillet 72 can include a weld or braze fillet, which can be formed via conventional MIG welding, TIG welding, brazing, etc., and can include a profile that reduces fluid dynamic losses. In particular embodiments, the platform 66, airfoil 52 and the fillet 72 can be formed as a single component, such as by casting and/or machining and/or 3D printing and/or any other suitable technique now known or later developed and/or discovered. In particular configurations, the turbine rotor blade 50 includes a mounting portion 74 which is formed to connect and/or to secure the turbine rotor blade 50 to the rotor shaft 14.

The airfoil 52 of the turbine rotor blade 50 has a profile at any cross-section taken between the platform 66 or the root 64 and the radial tip 68. In accordance with the present disclosure, the X, Y, and Z values of the profile are given in Table I as percentage values of the airfoil span or height. As one example only, the height of the airfoil 52 of the rotor blade 50 may be from about 2 inches to about 50 inches. As another example, the height of the airfoil 52 of the rotor blade 50 may be from about 3 inches to about 10 inches. However, it is to be understood that heights below or above this range may also be employed as desired in the specific application.

A hot gas path of a gas turbine requires airfoils that meet system requirements of aerodynamic and mechanical blade loading and efficiency. Additionally, the platforms and fillets at the base of the airfoils impact aerodynamic characteristics and losses of the rotor blade and must also satisfy system requirements of aerodynamic and mechanical blade loading and efficiency. That is, the aerodynamic characteristics and losses associated with each of the airfoil, the fillet, and/or the platform, separately, as well as the manner in which these components function together, significantly impact performance, thrust, efficiency, and power. As will be seen, to define the shape of these components, there is a unique set or locus of points in space that meet the stage requirements and that can be manufactured. This unique locus of points meets the requirements for stage efficiency and are arrived at by iteration between aerodynamic and mechanical loadings enabling the turbine to run in an efficient, safe and smooth manner. These points are unique and specific to the system.

In accordance with the embodiments of the present disclosure, the locus of points that defines an airfoil profile of a turbine rotor blade includes a set of points with X, Y, and Z dimensions relative to a reference origin coordinate system, as provided in Table I and shown in FIG. 2, respectively. As provided below, in accordance with an alternative embodiment of the present disclosure, the locus of points that defines a contour of a platform of a turbine rotor blade includes a set of points with X', Y', and Z' dimensions relative to a reference origin coordinate system, as provided in Table II and shown in FIG. 3, respectively.

The Cartesian coordinate system of X, Y, and Z values given in Table I below defines the airfoil profile of the turbine rotor blade 50 at various locations along its length or span or, as used herein, height. As shown in FIG. 2, the point data origin 76 is defined at or proximate to the root 64 at the leading edge 58 of the airfoil 52. In one embodiment, as presented in Table I below, the point data origin 76 is defined at or proximate to (above or below) a transition or intersection line 78 defined between the fillet 72 and the airfoil 52. The point data origin 76 corresponds to the non-dimensional Z value of Table I (presented below) at Z equals 0.

The coordinate values for the X, Y, and Z coordinates are set forth in non-dimensionalized units in Table I, although units of dimensions may be used when the values are appropriately converted. That is, the X, Y, and Z values set forth in Table I are expressed in non-dimensional form (X, Y, and Z) from 0% to 100% of the radial span 70 or height of the airfoil. As one example, the Cartesian coordinate values of X, Y, and Z may be convertible to dimensional distances by multiplying the X, Y, and Z values by a height of the airfoil at the leading edge 58 and/or multiplying by a constant number. As another example, the Cartesian coordinate values of X, Y, and Z may be convertible to dimensional distances by multiplying the X, Y, and Z values by a height of the airfoil at the trailing edge 60 and/or multiplying by a constant number. Thus, to convert the Z value to a Z coordinate value, for example, in inches, the non-dimensional Z value given in Table I is multiplied by the height of the airfoil in inches.

As described above, the Cartesian coordinate system has orthogonally-related X, Y, and Z axes, where the X axis lies generally parallel to a centerline of the rotor shaft 14, i.e., the rotary axis and a positive X coordinate value is axial toward an aft, i.e., exhaust end, of the turbine 10. The positive Y coordinate value extends tangentially in the direction of rotation of the rotor, and the positive Z coordinate value extends radially outwardly toward the radial tip 68 of the airfoil 52. All the values in Table I are given at room temperature and do not include the fillet 72.

By defining X and Y coordinate values at selected locations in a Z direction normal to the X, Y plane, the airfoil shape or profile sections (which may be referred to as "pressure side sections" on the pressure side and "suction side sections" on the suction side) of the airfoil 52 of the turbine rotor blade 50 along the span or height of the airfoil 52 can be ascertained. Thus, by connecting the X and Y values with smooth continuing arcs, each profile section (which may include a pressure side section and suction side section) at each distance Z is determined. The airfoil profiles of the various surface locations between the distances Z can then be determined by smoothly connecting the adjacent profile sections to one another to form the airfoil profile.

The Table I values are generated and shown to four decimal places for determining the profile of the airfoil. As the turbine rotor blade heats up during operation of the gas turbine, mechanical stresses and elevated temperatures will cause a change in the X, Y, and Z values. Accordingly, it should be understood that the values for the nominal airfoil profile given in Table I represent ambient, non-operating or non-hot conditions (e.g., room temperature) and are for an uncoated airfoil.

There are typical manufacturing tolerances as well as coatings which may be accounted for in the actual profile of the airfoil 52. It will therefore be appreciated that +/− typical manufacturing tolerances, i.e., +/− values, including any coating thicknesses, may be additive to the X and Y values given in Table I below. Accordingly, a distance of +/−5% in a direction normal to any airfoil surface location or about +/−5% of the chord 62 in a direction nominal to any airfoil surface location may define an airfoil profile envelope for this particular airfoil design, i.e., a range of variation between measured points on the actual airfoil surface at nominal cold or room temperature and the ideal position of those points as given in Table I below at the same temperature. According to another example, a tolerance of about 10-20% of a thickness of the airfoil's trailing edge 60 in a direction normal to any airfoil surface location may define a range of variation between measured points on an actual airfoil surface and ideal positions as embodied by the invention in Table I. As should further be understood, the data provided in Table I is scalable and the geometry pertains to all aerodynamic scales and/or RPM ranges. The design of the airfoil 52 for the turbine rotor blade 50 is robust to this range of variation without impairment of mechanical and aerodynamic functions.

TABLE I

| SUCTION SIDE | | | PRESSURE SIDE | | |
|---|---|---|---|---|---|
| X (%) | Y (%) | Z (%) | X (%) | Y (%) | Z (%) |
| 0.0000 | 0.0000 | 0.0000 | 0.0000 | 0.0000 | 0.0000 |
| −0.2028 | 0.5110 | 0.0000 | 0.2343 | −0.3110 | 0.0000 |
| −0.2630 | 1.0617 | 0.0000 | 0.5384 | −0.5589 | 0.0000 |
| −0.2082 | 1.6138 | 0.0000 | 0.8891 | −0.7261 | 0.0000 |
| −0.0699 | 2.1454 | 0.0000 | 1.2590 | −0.8480 | 0.0000 |
| 0.1260 | 2.6591 | 0.0000 | 1.6357 | −0.9549 | 0.0000 |
| 0.3576 | 3.1550 | 0.0000 | 2.0166 | −1.0480 | 0.0000 |
| 0.6151 | 3.6372 | 0.0000 | 2.4002 | −1.1247 | 0.0000 |
| 0.8960 | 4.1058 | 0.0000 | 2.7851 | −1.1932 | 0.0000 |
| 1.1973 | 4.5647 | 0.0000 | 3.1701 | −1.2576 | 0.0000 |
| 1.5138 | 5.0113 | 0.0000 | 3.5564 | −1.3234 | 0.0000 |
| 1.8426 | 5.4469 | 0.0000 | 3.9427 | −1.3891 | 0.0000 |
| 2.1823 | 5.8703 | 0.0000 | 4.3291 | −1.4535 | 0.0000 |
| 2.5317 | 6.2854 | 0.0000 | 4.7168 | −1.5111 | 0.0000 |
| 2.8879 | 6.6922 | 0.0000 | 5.1031 | −1.5590 | 0.0000 |
| 3.2523 | 7.0936 | 0.0000 | 5.4908 | −1.6015 | 0.0000 |
| 3.6208 | 7.4909 | 0.0000 | 5.8812 | −1.6439 | 0.0000 |
| 3.9934 | 7.8827 | 0.0000 | 6.2730 | −1.6905 | 0.0000 |
| 4.3743 | 8.2677 | 0.0000 | 6.6662 | −1.7426 | 0.0000 |
| 4.7606 | 8.6472 | 0.0000 | 7.0580 | −1.7933 | 0.0000 |
| 5.1551 | 9.0198 | 0.0000 | 7.4471 | −1.8179 | 0.0000 |
| 5.5552 | 9.3869 | 0.0000 | 7.8307 | −1.7837 | 0.0000 |
| 5.9607 | 9.7486 | 0.0000 | 8.2088 | −1.6850 | 0.0000 |
| 6.3758 | 10.1021 | 0.0000 | 8.5814 | −1.5508 | 0.0000 |
| 6.7964 | 10.4487 | 0.0000 | 8.9554 | −1.4138 | 0.0000 |
| 7.2183 | 10.7980 | 0.0000 | 9.3294 | −1.2891 | 0.0000 |
| 7.6663 | 11.0980 | 0.0000 | 9.7061 | −1.1754 | 0.0000 |
| 8.1595 | 11.3131 | 0.0000 | 10.0829 | −1.0672 | 0.0000 |
| 8.6732 | 11.4912 | 0.0000 | 10.4610 | −0.9644 | 0.0000 |
| 9.1979 | 11.6309 | 0.0000 | 10.8418 | −0.8672 | 0.0000 |
| 9.7322 | 11.7296 | 0.0000 | 11.2227 | −0.7822 | 0.0000 |
| 10.2733 | 11.7857 | 0.0000 | 11.6076 | −0.7083 | 0.0000 |
| 10.8158 | 11.8035 | 0.0000 | 11.9940 | −0.6480 | 0.0000 |
| 11.3583 | 11.7844 | 0.0000 | 12.3830 | −0.6028 | 0.0000 |
| 11.8981 | 11.7268 | 0.0000 | 12.7748 | −0.5713 | 0.0000 |
| 12.4324 | 11.6364 | 0.0000 | 13.1708 | −0.5535 | 0.0000 |
| 12.9612 | 11.5131 | 0.0000 | 13.5653 | −0.5521 | 0.0000 |
| 13.4790 | 11.3583 | 0.0000 | 13.9599 | −0.5685 | 0.0000 |
| 13.9873 | 11.1747 | 0.0000 | 14.3517 | −0.6000 | 0.0000 |
| 14.4859 | 10.9651 | 0.0000 | 14.7407 | −0.6466 | 0.0000 |
| 14.9750 | 10.7309 | 0.0000 | 15.1257 | −0.7069 | 0.0000 |
| 15.4531 | 10.4761 | 0.0000 | 15.5079 | −0.7795 | 0.0000 |
| 15.9203 | 10.2034 | 0.0000 | 15.8888 | −0.8644 | 0.0000 |
| 16.3765 | 9.9116 | 0.0000 | 16.2682 | −0.9617 | 0.0000 |
| 16.8231 | 9.6061 | 0.0000 | 16.6450 | −1.0699 | 0.0000 |

TABLE I-continued

| SUCTION SIDE | | | PRESSURE SIDE | | |
|---|---|---|---|---|---|
| X (%) | Y (%) | Z (%) | X (%) | Y (%) | Z (%) |
| 17.2587 | 9.2856 | 0.0000 | 17.0203 | −1.1905 | 0.0000 |
| 17.6848 | 8.9527 | 0.0000 | 17.3930 | −1.3206 | 0.0000 |
| 18.0999 | 8.6088 | 0.0000 | 17.7601 | −1.4604 | 0.0000 |
| 18.5040 | 8.2554 | 0.0000 | 18.1259 | −1.6070 | 0.0000 |
| 18.8999 | 7.8910 | 0.0000 | 18.4862 | −1.7604 | 0.0000 |
| 19.2876 | 7.5197 | 0.0000 | 18.8424 | −1.9207 | 0.0000 |
| 19.6657 | 7.1388 | 0.0000 | 19.1958 | −2.0878 | 0.0000 |
| 20.0384 | 6.7511 | 0.0000 | 19.5465 | −2.2591 | 0.0000 |
| 20.4014 | 6.3552 | 0.0000 | 19.8931 | −2.4358 | 0.0000 |
| 20.7590 | 5.9525 | 0.0000 | 20.2370 | −2.6166 | 0.0000 |
| 21.1097 | 5.5442 | 0.0000 | 20.5781 | −2.8029 | 0.0000 |
| 21.4549 | 5.1291 | 0.0000 | 20.9165 | −2.9947 | 0.0000 |
| 21.7919 | 4.7085 | 0.0000 | 21.2521 | −3.1906 | 0.0000 |
| 22.1248 | 4.2839 | 0.0000 | 21.5850 | −3.3920 | 0.0000 |
| 22.4522 | 3.8537 | 0.0000 | 21.9138 | −3.6002 | 0.0000 |
| 22.7742 | 3.4194 | 0.0000 | 22.2399 | −3.8126 | 0.0000 |
| 23.0906 | 2.9824 | 0.0000 | 22.5632 | −4.0318 | 0.0000 |
| 23.4030 | 2.5413 | 0.0000 | 22.8810 | −4.2565 | 0.0000 |
| 23.7112 | 2.0974 | 0.0000 | 23.1975 | −4.4880 | 0.0000 |
| 24.0153 | 1.6508 | 0.0000 | 23.5085 | −4.7264 | 0.0000 |
| 24.3167 | 1.2028 | 0.0000 | 23.8167 | −4.9688 | 0.0000 |
| 24.6154 | 0.7521 | 0.0000 | 24.1208 | −5.2182 | 0.0000 |
| 24.9099 | 0.3000 | 0.0000 | 24.4222 | −5.4730 | 0.0000 |
| 25.2045 | −0.1534 | 0.0000 | 24.7195 | −5.7305 | 0.0000 |
| 25.4963 | −0.6083 | 0.0000 | 25.0140 | −5.9922 | 0.0000 |
| 25.7867 | −1.0631 | 0.0000 | 25.3058 | −6.2580 | 0.0000 |
| 26.0771 | −1.5179 | 0.0000 | 25.5963 | −6.5251 | 0.0000 |
| 26.3676 | −1.9741 | 0.0000 | 25.8826 | −6.7950 | 0.0000 |
| 26.6580 | −2.4303 | 0.0000 | 26.1675 | −7.0662 | 0.0000 |
| 26.9484 | −2.8851 | 0.0000 | 26.4498 | −7.3402 | 0.0000 |
| 27.2389 | −3.3413 | 0.0000 | 26.7292 | −7.6156 | 0.0000 |
| 27.5293 | −3.7975 | 0.0000 | 27.0073 | −7.8951 | 0.0000 |
| 27.8183 | −4.2537 | 0.0000 | 27.2827 | −8.1759 | 0.0000 |
| 28.1074 | −4.7099 | 0.0000 | 27.5553 | −8.4595 | 0.0000 |
| 28.3965 | −5.1661 | 0.0000 | 27.8252 | −8.7458 | 0.0000 |
| 28.6842 | −5.6237 | 0.0000 | 28.0923 | −9.0362 | 0.0000 |
| 28.9718 | −6.0812 | 0.0000 | 28.3554 | −9.3280 | 0.0000 |
| 29.2582 | −6.5402 | 0.0000 | 28.6157 | −9.6239 | 0.0000 |
| 29.5445 | −7.0005 | 0.0000 | 28.8732 | −9.9226 | 0.0000 |
| 29.8281 | −7.4622 | 0.0000 | 29.1267 | −10.2254 | 0.0000 |
| 30.1117 | −7.9238 | 0.0000 | 29.3774 | −10.5309 | 0.0000 |
| 30.3939 | −8.3869 | 0.0000 | 29.6239 | −10.8405 | 0.0000 |
| 30.6747 | −8.8513 | 0.0000 | 29.8664 | −11.1514 | 0.0000 |
| 30.9542 | −9.3157 | 0.0000 | 30.1062 | −11.4652 | 0.0000 |
| 31.2336 | −9.7801 | 0.0000 | 30.3432 | −11.7789 | 0.0000 |
| 31.5117 | −10.2459 | 0.0000 | 30.5774 | −12.0940 | 0.0000 |
| 31.7871 | −10.7131 | 0.0000 | 30.8090 | −12.4118 | 0.0000 |
| 32.0584 | −11.1830 | 0.0000 | 31.0364 | −12.7324 | 0.0000 |
| 32.3337 | −11.6501 | 0.0000 | 31.2597 | −13.0584 | 0.0000 |
| 32.6187 | −12.1159 | 0.0000 | 31.5008 | −13.3721 | 0.0000 |
| 32.7324 | −12.3639 | 0.0000 | 31.6570 | −13.4845 | 0.0000 |
| 32.8461 | −12.6118 | 0.0000 | 31.8131 | −13.5968 | 0.0000 |
| 32.8790 | −12.9543 | 0.0000 | 32.0543 | −13.6544 | 0.0000 |
| 32.7735 | −13.2804 | 0.0000 | 32.3050 | −13.6324 | 0.0000 |
| 32.5351 | −13.5297 | 0.0000 | 32.5351 | −13.5297 | 0.0000 |
| 0.3000 | 0.4658 | 2.6714 | 0.3000 | 0.4658 | 2.6714 |
| 0.0644 | 0.9192 | 2.6714 | 0.6165 | 0.2192 | 2.6714 |
| 0.0192 | 1.4316 | 2.6714 | 0.9960 | 0.0877 | 2.6714 |
| 0.0959 | 1.9412 | 2.6714 | 1.3974 | 0.0548 | 2.6714 |
| 0.2507 | 2.4330 | 2.6714 | 1.8001 | 0.0781 | 2.6714 |
| 0.4535 | 2.9070 | 2.6714 | 2.1988 | 0.1356 | 2.6714 |
| 0.6932 | 3.3646 | 2.6714 | 2.5947 | 0.2151 | 2.6714 |
| 0.9590 | 3.8057 | 2.6714 | 2.9851 | 0.3137 | 2.6714 |
| 1.2480 | 4.2345 | 2.6714 | 3.3728 | 0.4261 | 2.6714 |
| 1.5563 | 4.6469 | 2.6714 | 3.7578 | 0.5466 | 2.6714 |
| 1.8823 | 5.0483 | 2.6714 | 4.1400 | 0.6740 | 2.6714 |
| 2.2234 | 5.4360 | 2.6714 | 4.5222 | 0.8028 | 2.6714 |
| 2.5769 | 5.8114 | 2.6714 | 4.9044 | 0.9316 | 2.6714 |
| 2.9386 | 6.1785 | 2.6714 | 5.2867 | 1.0590 | 2.6714 |
| 3.3112 | 6.5361 | 2.6714 | 5.6689 | 1.1878 | 2.6714 |
| 3.6920 | 6.8854 | 2.6714 | 6.0511 | 1.3165 | 2.6714 |
| 4.0811 | 7.2238 | 2.6714 | 6.4333 | 1.4467 | 2.6714 |
| 4.4770 | 7.5553 | 2.6714 | 6.8155 | 1.5755 | 2.6714 |
| 4.8812 | 7.8759 | 2.6714 | 7.1978 | 1.7042 | 2.6714 |
| 5.2935 | 8.1869 | 2.6714 | 7.5813 | 1.8289 | 2.6714 |
| 5.7127 | 8.4883 | 2.6714 | 7.9649 | 1.9508 | 2.6714 |

TABLE I-continued

| SUCTION SIDE | | | PRESSURE SIDE | | |
|---|---|---|---|---|---|
| X (%) | Y (%) | Z (%) | X (%) | Y (%) | Z (%) |
| 6.1401 | 8.7759 | 2.6714 | 8.3526 | 2.0659 | 2.6714 |
| 6.5785 | 9.0499 | 2.6714 | 8.7403 | 2.1728 | 2.6714 |
| 7.0251 | 9.3075 | 2.6714 | 9.1321 | 2.2686 | 2.6714 |
| 7.4841 | 9.5431 | 2.6714 | 9.5267 | 2.3536 | 2.6714 |
| 7.9540 | 9.7582 | 2.6714 | 9.9240 | 2.4262 | 2.6714 |
| 8.4335 | 9.9473 | 2.6714 | 10.3226 | 2.4824 | 2.6714 |
| 8.9239 | 10.1075 | 2.6714 | 10.7240 | 2.5221 | 2.6714 |
| 9.4226 | 10.2404 | 2.6714 | 11.1268 | 2.5454 | 2.6714 |
| 9.9281 | 10.3418 | 2.6714 | 11.5296 | 2.5509 | 2.6714 |
| 10.4404 | 10.4117 | 2.6714 | 11.9323 | 2.5385 | 2.6714 |
| 10.9542 | 10.4487 | 2.6714 | 12.3351 | 2.5084 | 2.6714 |
| 11.4706 | 10.4528 | 2.6714 | 12.7351 | 2.4618 | 2.6714 |
| 11.9858 | 10.4240 | 2.6714 | 13.1338 | 2.3988 | 2.6714 |
| 12.4981 | 10.3637 | 2.6714 | 13.5297 | 2.3193 | 2.6714 |
| 13.0064 | 10.2719 | 2.6714 | 13.9215 | 2.2262 | 2.6714 |
| 13.5078 | 10.1500 | 2.6714 | 14.3092 | 2.1180 | 2.6714 |
| 14.0010 | 9.9993 | 2.6714 | 14.6942 | 1.9974 | 2.6714 |
| 14.4873 | 9.8240 | 2.6714 | 15.0750 | 1.8631 | 2.6714 |
| 14.9627 | 9.6253 | 2.6714 | 15.4517 | 1.7193 | 2.6714 |
| 15.4298 | 9.4048 | 2.6714 | 15.8230 | 1.5631 | 2.6714 |
| 15.8860 | 9.1636 | 2.6714 | 16.1915 | 1.3987 | 2.6714 |
| 16.3326 | 8.9061 | 2.6714 | 16.5559 | 1.2247 | 2.6714 |
| 16.7696 | 8.6307 | 2.6714 | 16.9149 | 1.0425 | 2.6714 |
| 17.1971 | 8.3417 | 2.6714 | 17.2710 | 0.8521 | 2.6714 |
| 17.6149 | 8.0389 | 2.6714 | 17.6218 | 0.6535 | 2.6714 |
| 18.0232 | 7.7238 | 2.6714 | 17.9697 | 0.4493 | 2.6714 |
| 18.4232 | 7.3964 | 2.6714 | 18.3136 | 0.2384 | 2.6714 |
| 18.8150 | 7.0608 | 2.6714 | 18.6533 | 0.0219 | 2.6714 |
| 19.1972 | 6.7142 | 2.6714 | 18.9890 | −0.2014 | 2.6714 |
| 19.5712 | 6.3593 | 2.6714 | 19.3219 | −0.4288 | 2.6714 |
| 19.9384 | 5.9963 | 2.6714 | 19.6507 | −0.6617 | 2.6714 |
| 20.2987 | 5.6264 | 2.6714 | 19.9767 | −0.9001 | 2.6714 |
| 20.6521 | 5.2497 | 2.6714 | 20.2987 | −1.1425 | 2.6714 |
| 20.9973 | 4.8675 | 2.6714 | 20.6179 | −1.3905 | 2.6714 |
| 21.3384 | 4.4784 | 2.6714 | 20.9329 | −1.6426 | 2.6714 |
| 21.6727 | 4.0852 | 2.6714 | 21.2439 | −1.8974 | 2.6714 |
| 22.0015 | 3.6879 | 2.6714 | 21.5522 | −2.1577 | 2.6714 |
| 22.3262 | 3.2865 | 2.6714 | 21.8577 | −2.4221 | 2.6714 |
| 22.6454 | 2.8810 | 2.6714 | 22.1591 | −2.6892 | 2.6714 |
| 22.9605 | 2.4728 | 2.6714 | 22.4577 | −2.9605 | 2.6714 |
| 23.2728 | 2.0618 | 2.6714 | 22.7522 | −3.2358 | 2.6714 |
| 23.5811 | 1.6481 | 2.6714 | 23.0440 | −3.5139 | 2.6714 |
| 23.8879 | 1.2330 | 2.6714 | 23.3317 | −3.7962 | 2.6714 |
| 24.1907 | 0.8151 | 2.6714 | 23.6167 | −4.0825 | 2.6714 |
| 24.4907 | 0.3945 | 2.6714 | 23.8975 | −4.3715 | 2.6714 |
| 24.7894 | −0.0260 | 2.6714 | 24.1756 | −4.6633 | 2.6714 |
| 25.0866 | −0.4480 | 2.6714 | 24.4496 | −4.9592 | 2.6714 |
| 25.3812 | −0.8713 | 2.6714 | 24.7222 | −5.2565 | 2.6714 |
| 25.6744 | −1.2960 | 2.6714 | 24.9949 | −5.5538 | 2.6714 |
| 25.9648 | −1.7234 | 2.6714 | 25.2647 | −5.8525 | 2.6714 |
| 26.2539 | −2.1508 | 2.6714 | 25.5346 | −6.1525 | 2.6714 |
| 26.5402 | −2.5796 | 2.6714 | 25.8031 | −6.4539 | 2.6714 |
| 26.8251 | −3.0112 | 2.6714 | 26.0703 | −6.7553 | 2.6714 |
| 27.1073 | −3.4427 | 2.6714 | 26.3361 | −7.0594 | 2.6714 |
| 27.3882 | −3.8756 | 2.6714 | 26.6018 | −7.3635 | 2.6714 |
| 27.6663 | −4.3113 | 2.6714 | 26.8649 | −7.6676 | 2.6714 |
| 27.9430 | −4.7469 | 2.6714 | 27.1265 | −7.9745 | 2.6714 |
| 28.2170 | −5.1839 | 2.6714 | 27.3882 | −8.2814 | 2.6714 |
| 28.4896 | −5.6209 | 2.6714 | 27.6471 | −8.5910 | 2.6714 |
| 28.7622 | −6.0607 | 2.6714 | 27.9060 | −8.9006 | 2.6714 |
| 29.0335 | −6.4991 | 2.6714 | 28.1622 | −9.2116 | 2.6714 |
| 29.3034 | −6.9388 | 2.6714 | 28.4184 | −9.5239 | 2.6714 |
| 29.5733 | −7.3786 | 2.6714 | 28.6718 | −9.8363 | 2.6714 |
| 29.8418 | −7.8197 | 2.6714 | 28.9239 | −10.1514 | 2.6714 |
| 30.1089 | −8.2608 | 2.6714 | 29.1746 | −10.4678 | 2.6714 |
| 30.3747 | −8.7033 | 2.6714 | 29.4226 | −10.7857 | 2.6714 |
| 30.6391 | −9.1472 | 2.6714 | 29.6692 | −11.1049 | 2.6714 |
| 30.9007 | −9.5924 | 2.6714 | 29.9130 | −11.4254 | 2.6714 |
| 31.1597 | −10.0390 | 2.6714 | 30.1555 | −11.7474 | 2.6714 |
| 31.4172 | −10.4856 | 2.6714 | 30.3952 | −12.0721 | 2.6714 |
| 31.6734 | −10.9336 | 2.6714 | 30.6322 | −12.3981 | 2.6714 |
| 31.9323 | −11.3802 | 2.6714 | 30.8679 | −12.7255 | 2.6714 |
| 32.1967 | −11.8227 | 2.6714 | 31.0953 | −13.0584 | 2.6714 |
| 32.4598 | −12.2666 | 2.6714 | 31.3282 | −13.3886 | 2.6714 |
| 32.5673 | −12.5015 | 2.6714 | 31.4775 | −13.5208 | 2.6714 |
| 32.6748 | −12.7365 | 2.6714 | 31.6268 | −13.6530 | 2.6714 |

TABLE I-continued

| SUCTION SIDE | | | PRESSURE SIDE | | |
|---|---|---|---|---|---|
| X (%) | Y (%) | Z (%) | X (%) | Y (%) | Z (%) |
| 32.7187 | −13.0639 | 2.6714 | 31.8748 | −13.7283 | 2.6714 |
| 32.6022 | −13.3735 | 2.6714 | 32.1337 | −13.7133 | 2.6714 |
| 32.3735 | −13.6105 | 2.6714 | 32.3735 | −13.6105 | 2.6714 |
| 0.4809 | 0.8316 | 5.3428 | 0.4809 | 0.8316 | 5.3428 |
| 0.2466 | 1.2782 | 5.3428 | 0.8028 | 0.5822 | 5.3428 |
| 0.2000 | 1.7823 | 5.3428 | 1.1878 | 0.4521 | 5.3428 |
| 0.2726 | 2.2851 | 5.3428 | 1.5946 | 0.4165 | 5.3428 |
| 0.4219 | 2.7714 | 5.3428 | 2.0015 | 0.4480 | 5.3428 |
| 0.6206 | 3.2399 | 5.3428 | 2.4029 | 0.5233 | 5.3428 |
| 0.8549 | 3.6907 | 5.3428 | 2.7975 | 0.6302 | 5.3428 |
| 1.1165 | 4.1277 | 5.3428 | 3.1838 | 0.7603 | 5.3428 |
| 1.4015 | 4.5496 | 5.3428 | 3.5660 | 0.9069 | 5.3428 |
| 1.7056 | 4.9565 | 5.3428 | 3.9427 | 1.0658 | 5.3428 |
| 2.0275 | 5.3511 | 5.3428 | 4.3154 | 1.2330 | 5.3428 |
| 2.3632 | 5.7333 | 5.3428 | 4.6853 | 1.4056 | 5.3428 |
| 2.7125 | 6.1045 | 5.3428 | 5.0551 | 1.5796 | 5.3428 |
| 3.0714 | 6.4648 | 5.3428 | 5.4237 | 1.7563 | 5.3428 |
| 3.4400 | 6.8155 | 5.3428 | 5.7922 | 1.9316 | 5.3428 |
| 3.8181 | 7.1553 | 5.3428 | 6.1621 | 2.1056 | 5.3428 |
| 4.2058 | 7.4854 | 5.3428 | 6.5333 | 2.2769 | 5.3428 |
| 4.6044 | 7.8019 | 5.3428 | 6.9060 | 2.4440 | 5.3428 |
| 5.0127 | 8.1060 | 5.3428 | 7.2827 | 2.6043 | 5.3428 |
| 5.4319 | 8.3937 | 5.3428 | 7.6608 | 2.7564 | 5.3428 |
| 5.8607 | 8.6663 | 5.3428 | 8.0444 | 2.9002 | 5.3428 |
| 6.3018 | 8.9212 | 5.3428 | 8.4307 | 3.0331 | 5.3428 |
| 6.7525 | 9.1568 | 5.3428 | 8.8198 | 3.1550 | 5.3428 |
| 7.2128 | 9.3732 | 5.3428 | 9.2143 | 3.2632 | 5.3428 |
| 7.6841 | 9.5664 | 5.3428 | 9.6130 | 3.3550 | 5.3428 |
| 8.1636 | 9.7363 | 5.3428 | 10.0144 | 3.4304 | 5.3428 |
| 8.6513 | 9.8815 | 5.3428 | 10.4185 | 3.4879 | 5.3428 |
| 9.1458 | 10.0007 | 5.3428 | 10.8254 | 3.5276 | 5.3428 |
| 9.6459 | 10.0938 | 5.3428 | 11.2336 | 3.5482 | 5.3428 |
| 10.1514 | 10.1569 | 5.3428 | 11.6419 | 3.5482 | 5.3428 |
| 10.6583 | 10.1911 | 5.3428 | 12.0501 | 3.5290 | 5.3428 |
| 11.1665 | 10.1952 | 5.3428 | 12.4570 | 3.4893 | 5.3428 |
| 11.6748 | 10.1706 | 5.3428 | 12.8612 | 3.4304 | 5.3428 |
| 12.1817 | 10.1171 | 5.3428 | 13.2612 | 3.3509 | 5.3428 |
| 12.6831 | 10.0363 | 5.3428 | 13.6585 | 3.2536 | 5.3428 |
| 13.1804 | 9.9294 | 5.3428 | 14.0503 | 3.1386 | 5.3428 |
| 13.6722 | 9.7966 | 5.3428 | 14.4366 | 3.0071 | 5.3428 |
| 14.1558 | 9.6390 | 5.3428 | 14.8188 | 2.8605 | 5.3428 |
| 14.6325 | 9.4582 | 5.3428 | 15.1942 | 2.7002 | 5.3428 |
| 15.0997 | 9.2582 | 5.3428 | 15.5654 | 2.5276 | 5.3428 |
| 15.5572 | 9.0362 | 5.3428 | 15.9299 | 2.3440 | 5.3428 |
| 16.0066 | 8.7965 | 5.3428 | 16.2888 | 2.1481 | 5.3428 |
| 16.4463 | 8.5417 | 5.3428 | 16.6422 | 1.9426 | 5.3428 |
| 16.8765 | 8.2704 | 5.3428 | 16.9888 | 1.7275 | 5.3428 |
| 17.2984 | 7.9855 | 5.3428 | 17.3313 | 1.5042 | 5.3428 |
| 17.7108 | 7.6868 | 5.3428 | 17.6670 | 1.2727 | 5.3428 |
| 18.1149 | 7.3772 | 5.3428 | 17.9985 | 1.0329 | 5.3428 |
| 18.5109 | 7.0580 | 5.3428 | 18.3245 | 0.7864 | 5.3428 |
| 18.8986 | 6.7292 | 5.3428 | 18.6465 | 0.5357 | 5.3428 |
| 19.2780 | 6.3908 | 5.3428 | 18.9643 | 0.2781 | 5.3428 |
| 19.6507 | 6.0429 | 5.3428 | 19.2780 | 0.0164 | 5.3428 |
| 20.0151 | 5.6881 | 5.3428 | 19.5876 | −0.2507 | 5.3428 |
| 20.3726 | 5.3264 | 5.3428 | 19.8945 | −0.5206 | 5.3428 |
| 20.7233 | 4.9579 | 5.3428 | 20.1986 | −0.7932 | 5.3428 |
| 21.0672 | 4.5825 | 5.3428 | 20.5000 | −1.0699 | 5.3428 |
| 21.4056 | 4.2017 | 5.3428 | 20.7973 | −1.3494 | 5.3428 |
| 21.7371 | 3.8167 | 5.3428 | 21.0932 | −1.6302 | 5.3428 |
| 22.0645 | 3.4263 | 5.3428 | 21.3878 | −1.9152 | 5.3428 |
| 22.3865 | 3.0317 | 5.3428 | 21.6782 | −2.2015 | 5.3428 |
| 22.7029 | 2.6344 | 5.3428 | 21.9686 | −2.4906 | 5.3428 |
| 23.0153 | 2.2330 | 5.3428 | 22.2549 | −2.7796 | 5.3428 |
| 23.3235 | 1.8275 | 5.3428 | 22.5413 | −3.0728 | 5.3428 |
| 23.6276 | 1.4193 | 5.3428 | 22.8249 | −3.3660 | 5.3428 |
| 23.9277 | 1.0083 | 5.3428 | 23.1071 | −3.6619 | 5.3428 |
| 24.2249 | 0.5959 | 5.3428 | 23.3879 | −3.9578 | 5.3428 |
| 24.5181 | 0.1808 | 5.3428 | 23.6674 | −4.2565 | 5.3428 |
| 24.8099 | −0.2370 | 5.3428 | 23.9455 | −4.5565 | 5.3428 |
| 25.0976 | −0.6562 | 5.3428 | 24.2236 | −4.8565 | 5.3428 |
| 25.3839 | −1.0768 | 5.3428 | 24.4989 | −5.1579 | 5.3428 |
| 25.6675 | −1.4987 | 5.3428 | 24.7729 | −5.4606 | 5.3428 |
| 25.9497 | −1.9234 | 5.3428 | 25.0469 | −5.7648 | 5.3428 |
| 26.2306 | −2.3481 | 5.3428 | 25.3182 | −6.0689 | 5.3428 |
| 26.5087 | −2.7728 | 5.3428 | 25.5894 | −6.3744 | 5.3428 |

TABLE I-continued

| SUCTION SIDE | | | PRESSURE SIDE | | |
|---|---|---|---|---|---|
| X (%) | Y (%) | Z (%) | X (%) | Y (%) | Z (%) |
| 26.7854 | −3.2002 | 5.3428 | 25.8607 | −6.6813 | 5.3428 |
| 27.0608 | −3.6290 | 5.3428 | 26.1292 | −6.9881 | 5.3428 |
| 27.3334 | −4.0578 | 5.3428 | 26.3977 | −7.2978 | 5.3428 |
| 27.6046 | −4.4893 | 5.3428 | 26.6635 | −7.6060 | 5.3428 |
| 27.8731 | −4.9209 | 5.3428 | 26.9292 | −7.9170 | 5.3428 |
| 28.1403 | −5.3538 | 5.3428 | 27.1936 | −8.2293 | 5.3428 |
| 28.4074 | −5.7867 | 5.3428 | 27.4553 | −8.5431 | 5.3428 |
| 28.6732 | −6.2210 | 5.3428 | 27.7170 | −8.8568 | 5.3428 |
| 28.9376 | −6.6566 | 5.3428 | 27.9759 | −9.1732 | 5.3428 |
| 29.2006 | −7.0909 | 5.3428 | 28.2334 | −9.4897 | 5.3428 |
| 29.4623 | −7.5279 | 5.3428 | 28.4896 | −9.8089 | 5.3428 |
| 29.7240 | −7.9649 | 5.3428 | 28.7444 | −10.1281 | 5.3428 |
| 29.9829 | −8.4019 | 5.3428 | 28.9965 | −10.4487 | 5.3428 |
| 30.2404 | −8.8403 | 5.3428 | 29.2486 | −10.7720 | 5.3428 |
| 30.4966 | −9.2801 | 5.3428 | 29.4979 | −11.0953 | 5.3428 |
| 30.7514 | −9.7212 | 5.3428 | 29.7445 | −11.4200 | 5.3428 |
| 31.0049 | −10.1623 | 5.3428 | 29.9897 | −11.7474 | 5.3428 |
| 31.2583 | −10.6035 | 5.3428 | 30.2322 | −12.0762 | 5.3428 |
| 31.5131 | −11.0446 | 5.3428 | 30.4706 | −12.4077 | 5.3428 |
| 31.7679 | −11.4843 | 5.3428 | 30.7048 | −12.7433 | 5.3428 |
| 32.0214 | −11.9255 | 5.3428 | 30.9377 | −13.0790 | 5.3428 |
| 32.2693 | −12.3707 | 5.3428 | 31.1720 | −13.4132 | 5.3428 |
| 32.3824 | −12.5981 | 5.3428 | 31.3124 | −13.5598 | 5.3428 |
| 32.4954 | −12.8255 | 5.3428 | 31.4528 | −13.7064 | 5.3428 |
| 32.5447 | −13.1475 | 5.3428 | 31.7008 | −13.7927 | 5.3428 |
| 32.4337 | −13.4543 | 5.3428 | 31.9638 | −13.7872 | 5.3428 |
| 32.2063 | −13.6859 | 5.3428 | 32.2063 | −13.6859 | 5.3428 |
| 0.7864 | 1.4700 | 9.9993 | 0.7864 | 1.4700 | 9.9993 |
| 0.6124 | 1.7467 | 9.9993 | 1.1028 | 1.2193 | 9.9993 |
| 0.5261 | 2.0632 | 9.9993 | 1.4850 | 1.0850 | 9.9993 |
| 0.5165 | 2.2275 | 9.9993 | 1.8864 | 1.0494 | 9.9993 |
| 0.5069 | 2.3919 | 9.9993 | 2.2892 | 1.0768 | 9.9993 |
| 0.5740 | 2.8961 | 9.9993 | 2.6851 | 1.1480 | 9.9993 |
| 0.7220 | 3.3838 | 9.9993 | 3.0742 | 1.2508 | 9.9993 |
| 0.9206 | 3.8509 | 9.9993 | 3.4564 | 1.3768 | 9.9993 |
| 1.1535 | 4.3003 | 9.9993 | 3.8331 | 1.5220 | 9.9993 |
| 1.4165 | 4.7332 | 9.9993 | 4.2058 | 1.6768 | 9.9993 |
| 1.7029 | 5.1510 | 9.9993 | 4.5757 | 1.8412 | 9.9993 |
| 2.0097 | 5.5565 | 9.9993 | 4.9428 | 2.0097 | 9.9993 |
| 2.3344 | 5.9470 | 9.9993 | 5.3100 | 2.1796 | 9.9993 |
| 2.6742 | 6.3251 | 9.9993 | 5.6757 | 2.3508 | 9.9993 |
| 3.0262 | 6.6909 | 9.9993 | 6.0429 | 2.5194 | 9.9993 |
| 3.3879 | 7.0457 | 9.9993 | 6.4114 | 2.6865 | 9.9993 |
| 3.7592 | 7.3882 | 9.9993 | 6.7813 | 2.8481 | 9.9993 |
| 4.1386 | 7.7183 | 9.9993 | 7.1539 | 3.0029 | 9.9993 |
| 4.5291 | 8.0362 | 9.9993 | 7.5293 | 3.1509 | 9.9993 |
| 4.9305 | 8.3389 | 9.9993 | 7.9088 | 3.2879 | 9.9993 |
| 5.3428 | 8.6294 | 9.9993 | 8.2923 | 3.4167 | 9.9993 |
| 5.7689 | 8.9033 | 9.9993 | 8.6814 | 3.5317 | 9.9993 |
| 6.2073 | 9.1595 | 9.9993 | 9.0760 | 3.6345 | 9.9993 |
| 6.6580 | 9.3965 | 9.9993 | 9.4733 | 3.7208 | 9.9993 |
| 7.1183 | 9.6102 | 9.9993 | 9.8719 | 3.7893 | 9.9993 |
| 7.5868 | 9.8020 | 9.9993 | 10.2733 | 3.8386 | 9.9993 |
| 8.0636 | 9.9678 | 9.9993 | 10.6733 | 3.8688 | 9.9993 |
| 8.5499 | 10.1075 | 9.9993 | 11.0747 | 3.8783 | 9.9993 |
| 9.0458 | 10.2212 | 9.9993 | 11.4775 | 3.8674 | 9.9993 |
| 9.5486 | 10.3076 | 9.9993 | 11.8816 | 3.8372 | 9.9993 |
| 10.0514 | 10.3651 | 9.9993 | 12.2858 | 3.7879 | 9.9993 |
| 10.5528 | 10.3911 | 9.9993 | 12.6858 | 3.7181 | 9.9993 |
| 11.0542 | 10.3870 | 9.9993 | 13.0817 | 3.6304 | 9.9993 |
| 11.5583 | 10.3541 | 9.9993 | 13.4708 | 3.5235 | 9.9993 |
| 12.0611 | 10.2939 | 9.9993 | 13.8544 | 3.3989 | 9.9993 |
| 12.5625 | 10.2048 | 9.9993 | 14.2311 | 3.2591 | 9.9993 |
| 13.0571 | 10.0897 | 9.9993 | 14.6037 | 3.1030 | 9.9993 |
| 13.5434 | 9.9500 | 9.9993 | 14.9723 | 2.9331 | 9.9993 |
| 14.0201 | 9.7870 | 9.9993 | 15.3353 | 2.7509 | 9.9993 |
| 14.4900 | 9.6007 | 9.9993 | 15.6929 | 2.5591 | 9.9993 |
| 14.9531 | 9.3938 | 9.9993 | 16.0436 | 2.3563 | 9.9993 |
| 15.4079 | 9.1678 | 9.9993 | 16.3874 | 2.1454 | 9.9993 |
| 15.8531 | 8.9253 | 9.9993 | 16.7258 | 1.9262 | 9.9993 |
| 16.2860 | 8.6663 | 9.9993 | 17.0587 | 1.7001 | 9.9993 |
| 16.7094 | 8.3951 | 9.9993 | 17.3848 | 1.4672 | 9.9993 |
| 17.1204 | 8.1115 | 9.9993 | 17.7081 | 1.2275 | 9.9993 |
| 17.5217 | 7.8170 | 9.9993 | 18.0259 | 0.9809 | 9.9993 |
| 17.9149 | 7.5115 | 9.9993 | 18.3396 | 0.7288 | 9.9993 |
| 18.2999 | 7.1964 | 9.9993 | 18.6492 | 0.4713 | 9.9993 |

TABLE I-continued

| SUCTION SIDE | | | PRESSURE SIDE | | |
|---|---|---|---|---|---|
| X (%) | Y (%) | Z (%) | X (%) | Y (%) | Z (%) |
| 18.6766 | 6.8717 | 9.9993 | 18.9561 | 0.2082 | 9.9993 |
| 19.0465 | 6.5388 | 9.9993 | 19.2589 | −0.0589 | 9.9993 |
| 19.4082 | 6.1963 | 9.9993 | 19.5589 | −0.3288 | 9.9993 |
| 19.7630 | 5.8470 | 9.9993 | 19.8562 | −0.6028 | 9.9993 |
| 20.1110 | 5.4880 | 9.9993 | 20.1507 | −0.8795 | 9.9993 |
| 20.4535 | 5.1236 | 9.9993 | 20.4439 | −1.1590 | 9.9993 |
| 20.7905 | 4.7510 | 9.9993 | 20.7329 | −1.4412 | 9.9993 |
| 21.1206 | 4.3729 | 9.9993 | 21.0206 | −1.7248 | 9.9993 |
| 21.4467 | 3.9893 | 9.9993 | 21.3069 | −2.0097 | 9.9993 |
| 21.7672 | 3.6002 | 9.9993 | 21.5905 | −2.2974 | 9.9993 |
| 22.0810 | 3.2084 | 9.9993 | 21.8727 | −2.5865 | 9.9993 |
| 22.3906 | 2.8125 | 9.9993 | 22.1536 | −2.8769 | 9.9993 |
| 22.6947 | 2.4139 | 9.9993 | 22.4317 | −3.1687 | 9.9993 |
| 22.9947 | 2.0125 | 9.9993 | 22.7098 | −3.4619 | 9.9993 |
| 23.2906 | 1.6083 | 9.9993 | 22.9851 | −3.7564 | 9.9993 |
| 23.5824 | 1.2015 | 9.9993 | 23.2605 | −4.0537 | 9.9993 |
| 23.8715 | 0.7918 | 9.9993 | 23.5331 | −4.3510 | 9.9993 |
| 24.1564 | 0.3808 | 9.9993 | 23.8057 | −4.6483 | 9.9993 |
| 24.4400 | −0.0315 | 9.9993 | 24.0770 | −4.9483 | 9.9993 |
| 24.7195 | −0.4466 | 9.9993 | 24.3469 | −5.2483 | 9.9993 |
| 24.9962 | −0.8631 | 9.9993 | 24.6154 | −5.5497 | 9.9993 |
| 25.2716 | −1.2823 | 9.9993 | 24.8839 | −5.8525 | 9.9993 |
| 25.5442 | −1.7015 | 9.9993 | 25.1510 | −6.1552 | 9.9993 |
| 25.8155 | −2.1221 | 9.9993 | 25.4168 | −6.4593 | 9.9993 |
| 26.0853 | −2.5440 | 9.9993 | 25.6812 | −6.7635 | 9.9993 |
| 26.3539 | −2.9660 | 9.9993 | 25.9456 | −7.0703 | 9.9993 |
| 26.6210 | −3.3893 | 9.9993 | 26.2086 | −7.3772 | 9.9993 |
| 26.8854 | −3.8140 | 9.9993 | 26.4703 | −7.6855 | 9.9993 |
| 27.1498 | −4.2400 | 9.9993 | 26.7306 | −7.9937 | 9.9993 |
| 27.4115 | −4.6661 | 9.9993 | 26.9895 | −8.3047 | 9.9993 |
| 27.6718 | −5.0949 | 9.9993 | 27.2471 | −8.6170 | 9.9993 |
| 27.9307 | −5.5237 | 9.9993 | 27.5033 | −8.9294 | 9.9993 |
| 28.1869 | −5.9538 | 9.9993 | 27.7581 | −9.2431 | 9.9993 |
| 28.4417 | −6.3854 | 9.9993 | 28.0101 | −9.5582 | 9.9993 |
| 28.6965 | −6.8169 | 9.9993 | 28.2608 | −9.8760 | 9.9993 |
| 28.9499 | −7.2484 | 9.9993 | 28.5102 | −10.1938 | 9.9993 |
| 29.2034 | −7.6813 | 9.9993 | 28.7568 | −10.5130 | 9.9993 |
| 29.4568 | −8.1143 | 9.9993 | 29.0034 | −10.8336 | 9.9993 |
| 29.7103 | −8.5472 | 9.9993 | 29.2472 | −11.1569 | 9.9993 |
| 29.9623 | −8.9814 | 9.9993 | 29.4883 | −11.4802 | 9.9993 |
| 30.2117 | −9.4157 | 9.9993 | 29.7294 | −11.8063 | 9.9993 |
| 30.4583 | −9.8527 | 9.9993 | 29.9664 | −12.1337 | 9.9993 |
| 30.7021 | −10.2897 | 9.9993 | 30.2007 | −12.4639 | 9.9993 |
| 30.9432 | −10.7295 | 9.9993 | 30.4295 | −12.7954 | 9.9993 |
| 31.1843 | −11.1679 | 9.9993 | 30.6555 | −13.1297 | 9.9993 |
| 31.4268 | −11.6063 | 9.9993 | 30.8843 | −13.4639 | 9.9993 |
| 31.6789 | −12.0419 | 9.9993 | 31.0138 | −13.6187 | 9.9993 |
| 31.9337 | −12.4748 | 9.9993 | 31.1432 | −13.7735 | 9.9993 |
| 32.1570 | −12.9214 | 9.9993 | 31.3843 | −13.8845 | 9.9993 |
| 32.2049 | −13.4064 | 9.9993 | 31.6501 | −13.8968 | 9.9993 |
| 31.8994 | −13.7996 | 9.9993 | 31.8994 | −13.7996 | 9.9993 |
| 1.3193 | 2.7961 | 20.0000 | 1.3193 | 2.7961 | 20.0000 |
| 1.1549 | 3.0756 | 20.0000 | 1.6275 | 2.5481 | 20.0000 |
| 1.0686 | 3.3893 | 20.0000 | 2.0001 | 2.4125 | 20.0000 |
| 1.0603 | 3.5509 | 20.0000 | 2.3919 | 2.3632 | 20.0000 |
| 1.0521 | 3.7126 | 20.0000 | 2.7879 | 2.3824 | 20.0000 |
| 1.1261 | 4.2017 | 20.0000 | 3.1769 | 2.4454 | 20.0000 |
| 1.2782 | 4.6716 | 20.0000 | 3.5591 | 2.5399 | 20.0000 |
| 1.4782 | 5.1277 | 20.0000 | 3.9318 | 2.6563 | 20.0000 |
| 1.7166 | 5.5648 | 20.0000 | 6.4552 | 3.7496 | 20.0000 |
| 1.9837 | 5.9826 | 20.0000 | 6.0963 | 3.5907 | 20.0000 |
| 2.2714 | 6.3840 | 20.0000 | 6.8169 | 3.9030 | 20.0000 |
| 2.5783 | 6.7690 | 20.0000 | 5.7387 | 3.4276 | 20.0000 |
| 2.9043 | 7.1388 | 20.0000 | 7.1813 | 4.0469 | 20.0000 |
| 3.2441 | 7.4964 | 20.0000 | 5.3812 | 3.2619 | 20.0000 |
| 3.5975 | 7.8416 | 20.0000 | 4.3003 | 2.7906 | 20.0000 |
| 3.9633 | 8.1759 | 20.0000 | 5.0223 | 3.0975 | 20.0000 |
| 4.3373 | 8.4978 | 20.0000 | 4.6620 | 2.9399 | 20.0000 |
| 4.7222 | 8.8047 | 20.0000 | 7.5485 | 4.1811 | 20.0000 |
| 5.1182 | 9.0965 | 20.0000 | 7.9197 | 4.3044 | 20.0000 |
| 5.5237 | 9.3719 | 20.0000 | 8.2951 | 4.4126 | 20.0000 |
| 5.9415 | 9.6308 | 20.0000 | 8.6746 | 4.5058 | 20.0000 |
| 6.3730 | 9.8705 | 20.0000 | 9.0595 | 4.5811 | 20.0000 |
| 6.8183 | 10.0897 | 20.0000 | 9.4513 | 4.6400 | 20.0000 |
| 7.2745 | 10.2856 | 20.0000 | 9.8500 | 4.6811 | 20.0000 |
| 7.7375 | 10.4555 | 20.0000 | 10.2500 | 4.7003 | 20.0000 |

TABLE I-continued

| SUCTION SIDE | | | PRESSURE SIDE | | |
|---|---|---|---|---|---|
| X (%) | Y (%) | Z (%) | X (%) | Y (%) | Z (%) |
| 8.2074 | 10.5966 | 20.0000 | 10.6514 | 4.6976 | 20.0000 |
| 8.6855 | 10.7103 | 20.0000 | 11.0487 | 4.6716 | 20.0000 |
| 9.1732 | 10.7939 | 20.0000 | 11.4432 | 4.6222 | 20.0000 |
| 9.6664 | 10.8501 | 20.0000 | 11.8337 | 4.5510 | 20.0000 |
| 10.1610 | 10.8761 | 20.0000 | 12.2200 | 4.4592 | 20.0000 |
| 10.6528 | 10.8706 | 20.0000 | 12.6036 | 4.3469 | 20.0000 |
| 11.1419 | 10.8364 | 20.0000 | 12.9831 | 4.2167 | 20.0000 |
| 11.6268 | 10.7720 | 20.0000 | 13.3557 | 4.0688 | 20.0000 |
| 12.1090 | 10.6816 | 20.0000 | 13.7229 | 3.9071 | 20.0000 |
| 12.5899 | 10.5637 | 20.0000 | 14.0804 | 3.7318 | 20.0000 |
| 13.0653 | 10.4213 | 20.0000 | 14.4311 | 3.5441 | 20.0000 |
| 13.5311 | 10.2555 | 20.0000 | 14.7736 | 3.3454 | 20.0000 |
| 13.9873 | 10.0692 | 20.0000 | 15.1120 | 3.1372 | 20.0000 |
| 14.4339 | 9.8637 | 20.0000 | 15.4449 | 2.9180 | 20.0000 |
| 14.8723 | 9.6376 | 20.0000 | 15.7737 | 2.6906 | 20.0000 |
| 15.3024 | 9.3938 | 20.0000 | 16.0970 | 2.4563 | 20.0000 |
| 15.7244 | 9.1349 | 20.0000 | 16.4162 | 2.2152 | 20.0000 |
| 16.1354 | 8.8609 | 20.0000 | 16.7313 | 1.9700 | 20.0000 |
| 16.5354 | 8.5746 | 20.0000 | 17.0409 | 1.7193 | 20.0000 |
| 16.9258 | 8.2773 | 20.0000 | 17.3464 | 1.4645 | 20.0000 |
| 17.3053 | 7.9704 | 20.0000 | 17.6478 | 1.2042 | 20.0000 |
| 17.6766 | 7.6539 | 20.0000 | 17.9437 | 0.9425 | 20.0000 |
| 18.0396 | 7.3293 | 20.0000 | 18.2369 | 0.6754 | 20.0000 |
| 18.3958 | 6.9964 | 20.0000 | 18.5273 | 0.4055 | 20.0000 |
| 18.7437 | 6.6566 | 20.0000 | 18.8136 | 0.1329 | 20.0000 |
| 19.0849 | 6.3087 | 20.0000 | 19.0986 | −0.1425 | 20.0000 |
| 19.4191 | 5.9538 | 20.0000 | 19.3794 | −0.4192 | 20.0000 |
| 19.7466 | 5.5935 | 20.0000 | 19.6589 | −0.6987 | 20.0000 |
| 20.0699 | 5.2264 | 20.0000 | 19.9370 | −0.9795 | 20.0000 |
| 20.3863 | 4.8524 | 20.0000 | 20.2123 | −1.2631 | 20.0000 |
| 20.6987 | 4.4743 | 20.0000 | 20.4877 | −1.5481 | 20.0000 |
| 21.0055 | 4.0907 | 20.0000 | 20.7603 | −1.8330 | 20.0000 |
| 21.3069 | 3.7030 | 20.0000 | 21.0316 | −2.1207 | 20.0000 |
| 21.6056 | 3.3126 | 20.0000 | 21.3015 | −2.4098 | 20.0000 |
| 21.8974 | 2.9180 | 20.0000 | 21.5700 | −2.6988 | 20.0000 |
| 22.1865 | 2.5221 | 20.0000 | 21.8385 | −2.9892 | 20.0000 |
| 22.4714 | 2.1234 | 20.0000 | 22.1043 | −3.2810 | 20.0000 |
| 22.7522 | 1.7220 | 20.0000 | 22.3700 | −3.5742 | 20.0000 |
| 23.0303 | 1.3193 | 20.0000 | 22.6344 | −3.8688 | 20.0000 |
| 23.3043 | 0.9138 | 20.0000 | 22.8975 | −4.1633 | 20.0000 |
| 23.5756 | 0.5069 | 20.0000 | 23.1605 | −4.4592 | 20.0000 |
| 23.8455 | 0.0973 | 20.0000 | 23.4222 | −4.7551 | 20.0000 |
| 24.1112 | −0.3124 | 20.0000 | 23.6824 | −5.0538 | 20.0000 |
| 24.3756 | −0.7247 | 20.0000 | 23.9414 | −5.3524 | 20.0000 |
| 24.6359 | −1.1384 | 20.0000 | 24.2003 | −5.6511 | 20.0000 |
| 24.8962 | −1.5535 | 20.0000 | 24.4565 | −5.9525 | 20.0000 |
| 25.1538 | −1.9686 | 20.0000 | 24.7140 | −6.2539 | 20.0000 |
| 25.4100 | −2.3851 | 20.0000 | 24.9688 | −6.5552 | 20.0000 |
| 25.6648 | −2.8029 | 20.0000 | 25.2236 | −6.8594 | 20.0000 |
| 25.9182 | −3.2221 | 20.0000 | 25.4757 | −7.1635 | 20.0000 |
| 26.1703 | −3.6413 | 20.0000 | 25.7292 | −7.4690 | 20.0000 |
| 26.4224 | −4.0619 | 20.0000 | 25.9799 | −7.7759 | 20.0000 |
| 26.6717 | −4.4825 | 20.0000 | 26.2292 | −8.0841 | 20.0000 |
| 26.9183 | −4.9044 | 20.0000 | 26.4785 | −8.3924 | 20.0000 |
| 27.1649 | −5.3278 | 20.0000 | 26.7251 | −8.7033 | 20.0000 |
| 27.4087 | −5.7524 | 20.0000 | 26.9703 | −9.0143 | 20.0000 |
| 27.6526 | −6.1771 | 20.0000 | 27.2142 | −9.3280 | 20.0000 |
| 27.8937 | −6.6032 | 20.0000 | 27.4553 | −9.6431 | 20.0000 |
| 28.1348 | −7.0292 | 20.0000 | 27.6950 | −9.9582 | 20.0000 |
| 28.3745 | −7.4567 | 20.0000 | 27.9321 | −10.2760 | 20.0000 |
| 28.6143 | −7.8841 | 20.0000 | 28.1677 | −10.5952 | 20.0000 |
| 28.8540 | −8.3115 | 20.0000 | 28.4006 | −10.9158 | 20.0000 |
| 29.0924 | −8.7390 | 20.0000 | 28.6321 | −11.2378 | 20.0000 |
| 29.3308 | −9.1678 | 20.0000 | 28.8636 | −11.5611 | 20.0000 |
| 29.5664 | −9.5979 | 20.0000 | 29.0924 | −11.8857 | 20.0000 |
| 29.7993 | −10.0281 | 20.0000 | 29.3184 | −12.2118 | 20.0000 |
| 30.0308 | −10.4610 | 20.0000 | 29.5431 | −12.5392 | 20.0000 |
| 30.2596 | −10.8939 | 20.0000 | 29.7609 | −12.8694 | 20.0000 |
| 30.4884 | −11.3268 | 20.0000 | 29.9747 | −13.2036 | 20.0000 |
| 30.7185 | −11.7597 | 20.0000 | 30.1897 | −13.5365 | 20.0000 |
| 30.9555 | −12.1885 | 20.0000 | 30.3124 | −13.6934 | 20.0000 |
| 31.1925 | −12.6173 | 20.0000 | 30.4350 | −13.8503 | 20.0000 |
| 31.4090 | −13.0571 | 20.0000 | 30.6569 | −13.9790 | 20.0000 |
| 31.4624 | −13.5297 | 20.0000 | 30.9213 | −13.9982 | 20.0000 |
| 31.1651 | −13.9119 | 20.0000 | 31.1651 | −13.9119 | 20.0000 |
| 1.8056 | 4.1701 | 29.9993 | 1.8056 | 4.1701 | 29.9993 |

TABLE I-continued

| SUCTION SIDE | | | PRESSURE SIDE | | |
|---|---|---|---|---|---|
| X (%) | Y (%) | Z (%) | X (%) | Y (%) | Z (%) |
| 1.6494 | 4.4428 | 29.9993 | 2.1084 | 3.9181 | 29.9993 |
| 1.5713 | 4.7483 | 29.9993 | 2.4741 | 3.7715 | 29.9993 |
| 1.5645 | 4.9065 | 29.9993 | 2.8632 | 3.7181 | 29.9993 |
| 1.5576 | 5.0647 | 29.9993 | 3.2564 | 3.7304 | 29.9993 |
| 1.6344 | 5.5401 | 29.9993 | 3.6441 | 3.7893 | 29.9993 |
| 1.7878 | 5.9949 | 29.9993 | 4.0236 | 3.8797 | 29.9993 |
| 1.9919 | 6.4333 | 29.9993 | 4.3948 | 3.9921 | 29.9993 |
| 2.2330 | 6.8539 | 29.9993 | 4.7620 | 4.1181 | 29.9993 |
| 2.5015 | 7.2539 | 29.9993 | 5.1264 | 4.2510 | 29.9993 |
| 2.7933 | 7.6361 | 29.9993 | 5.4908 | 4.3880 | 29.9993 |
| 3.1030 | 8.0019 | 29.9993 | 5.8552 | 4.5236 | 29.9993 |
| 3.4317 | 8.3513 | 29.9993 | 6.2210 | 4.6579 | 29.9993 |
| 3.7770 | 8.6869 | 29.9993 | 6.5868 | 4.7866 | 29.9993 |
| 4.1359 | 9.0075 | 29.9993 | 6.9553 | 4.9086 | 29.9993 |
| 4.5072 | 9.3143 | 29.9993 | 7.3238 | 5.0223 | 29.9993 |
| 4.8894 | 9.6048 | 29.9993 | 7.6964 | 5.1250 | 29.9993 |
| 5.2812 | 9.8788 | 29.9993 | 8.0732 | 5.2154 | 29.9993 |
| 5.6826 | 10.1349 | 29.9993 | 8.4540 | 5.2880 | 29.9993 |
| 6.0990 | 10.3733 | 29.9993 | 8.8390 | 5.3442 | 29.9993 |
| 6.5278 | 10.5911 | 29.9993 | 9.2280 | 5.3798 | 29.9993 |
| 6.9690 | 10.7884 | 29.9993 | 9.6171 | 5.3963 | 29.9993 |
| 7.4183 | 10.9597 | 29.9993 | 10.0075 | 5.3922 | 29.9993 |
| 7.8745 | 11.1049 | 29.9993 | 10.3952 | 5.3675 | 29.9993 |
| 8.3362 | 11.2199 | 29.9993 | 10.7802 | 5.3223 | 29.9993 |
| 8.8061 | 11.3063 | 29.9993 | 11.1624 | 5.2552 | 29.9993 |
| 9.2815 | 11.3611 | 29.9993 | 11.5419 | 5.1675 | 29.9993 |
| 9.7623 | 11.3843 | 29.9993 | 11.9173 | 5.0565 | 29.9993 |
| 10.2459 | 11.3761 | 29.9993 | 12.2858 | 4.9277 | 29.9993 |
| 10.7268 | 11.3391 | 29.9993 | 12.6474 | 4.7825 | 29.9993 |
| 11.1994 | 11.2747 | 29.9993 | 12.9995 | 4.6222 | 29.9993 |
| 11.6679 | 11.1857 | 29.9993 | 13.3447 | 4.4482 | 29.9993 |
| 12.1323 | 11.0706 | 29.9993 | 13.6845 | 4.2606 | 29.9993 |
| 12.5940 | 10.9309 | 29.9993 | 14.0174 | 4.0606 | 29.9993 |
| 13.0488 | 10.7706 | 29.9993 | 14.3448 | 3.8496 | 29.9993 |
| 13.4954 | 10.5870 | 29.9993 | 14.6681 | 3.6304 | 29.9993 |
| 13.9311 | 10.3856 | 29.9993 | 14.9832 | 3.4030 | 29.9993 |
| 14.3571 | 10.1651 | 29.9993 | 15.2928 | 3.1687 | 29.9993 |
| 14.7750 | 9.9267 | 29.9993 | 15.5970 | 2.9290 | 29.9993 |
| 15.1819 | 9.6719 | 29.9993 | 15.8970 | 2.6851 | 29.9993 |
| 15.5805 | 9.4020 | 29.9993 | 16.1902 | 2.4372 | 29.9993 |
| 15.9710 | 9.1171 | 29.9993 | 16.4806 | 2.1851 | 29.9993 |
| 16.3491 | 8.8212 | 29.9993 | 16.7669 | 1.9289 | 29.9993 |
| 16.7190 | 8.5157 | 29.9993 | 17.0491 | 1.6686 | 29.9993 |
| 17.0779 | 8.2006 | 29.9993 | 17.3300 | 1.4056 | 29.9993 |
| 17.4272 | 7.8773 | 29.9993 | 17.6067 | 1.1398 | 29.9993 |
| 17.7683 | 7.5471 | 29.9993 | 17.8807 | 0.8713 | 29.9993 |
| 18.1026 | 7.2087 | 29.9993 | 18.1519 | 0.6000 | 29.9993 |
| 18.4300 | 6.8635 | 29.9993 | 18.4218 | 0.3274 | 29.9993 |
| 18.7506 | 6.5128 | 29.9993 | 18.6890 | 0.0521 | 29.9993 |
| 19.0657 | 6.1552 | 29.9993 | 18.9547 | −0.2260 | 29.9993 |
| 19.3739 | 5.7935 | 29.9993 | 19.2178 | −0.5055 | 29.9993 |
| 19.6767 | 5.4250 | 29.9993 | 19.4794 | −0.7850 | 29.9993 |
| 19.9753 | 5.0524 | 29.9993 | 19.7397 | −1.0672 | 29.9993 |
| 20.2685 | 4.6757 | 29.9993 | 19.9973 | −1.3508 | 29.9993 |
| 20.5576 | 4.2934 | 29.9993 | 20.2562 | −1.6357 | 29.9993 |
| 20.8425 | 3.9085 | 29.9993 | 20.5124 | −1.9220 | 29.9993 |
| 21.1234 | 3.5208 | 29.9993 | 20.7672 | −2.2084 | 29.9993 |
| 21.4001 | 3.1304 | 29.9993 | 21.0220 | −2.4961 | 29.9993 |
| 21.6741 | 2.7385 | 29.9993 | 21.2768 | −2.7851 | 29.9993 |
| 21.9453 | 2.3440 | 29.9993 | 21.5289 | −3.0742 | 29.9993 |
| 22.2125 | 1.9481 | 29.9993 | 21.7823 | −3.3646 | 29.9993 |
| 22.4769 | 1.5508 | 29.9993 | 22.0330 | −3.6550 | 29.9993 |
| 22.7399 | 1.1508 | 29.9993 | 22.2837 | −3.9468 | 29.9993 |
| 22.9988 | 0.7494 | 29.9993 | 22.5331 | −4.2400 | 29.9993 |
| 23.2550 | 0.3466 | 29.9993 | 22.7824 | −4.5332 | 29.9993 |
| 23.5085 | −0.0575 | 29.9993 | 23.0303 | −4.8277 | 29.9993 |
| 23.7605 | −0.4630 | 29.9993 | 23.2783 | −5.1223 | 29.9993 |
| 24.0099 | −0.8699 | 29.9993 | 23.5235 | −5.4182 | 29.9993 |
| 24.2565 | −1.2782 | 29.9993 | 23.7688 | −5.7141 | 29.9993 |
| 24.5017 | −1.6878 | 29.9993 | 24.0140 | −6.0114 | 29.9993 |
| 24.7455 | −2.0988 | 29.9993 | 24.2578 | −6.3100 | 29.9993 |
| 24.9880 | −2.5098 | 29.9993 | 24.5003 | −6.6087 | 29.9993 |
| 25.2278 | −2.9221 | 29.9993 | 24.7414 | −6.9087 | 29.9993 |
| 25.4675 | −3.3358 | 29.9993 | 24.9812 | −7.2087 | 29.9993 |
| 25.7045 | −3.7496 | 29.9993 | 25.2209 | −7.5115 | 29.9993 |
| 25.9401 | −4.1647 | 29.9993 | 25.4593 | −7.8129 | 29.9993 |

TABLE I-continued

| SUCTION SIDE | | | PRESSURE SIDE | | |
|---|---|---|---|---|---|
| X (%) | Y (%) | Z (%) | X (%) | Y (%) | Z (%) |
| 26.1744 | −4.5811 | 29.9993 | 25.6963 | −8.1170 | 29.9993 |
| 26.4059 | −4.9990 | 29.9993 | 25.9319 | −8.4211 | 29.9993 |
| 26.6374 | −5.4168 | 29.9993 | 26.1662 | −8.7266 | 29.9993 |
| 26.8690 | −5.8346 | 29.9993 | 26.3991 | −9.0335 | 29.9993 |
| 27.0977 | −6.2539 | 29.9993 | 26.6292 | −9.3417 | 29.9993 |
| 27.3265 | −6.6731 | 29.9993 | 26.8580 | −9.6513 | 29.9993 |
| 27.5553 | −7.0936 | 29.9993 | 27.0854 | −9.9623 | 29.9993 |
| 27.7827 | −7.5128 | 29.9993 | 27.3101 | −10.2733 | 29.9993 |
| 28.0088 | −7.9334 | 29.9993 | 27.5348 | −10.5870 | 29.9993 |
| 28.2348 | −8.3554 | 29.9993 | 27.7553 | −10.9021 | 29.9993 |
| 28.4595 | −8.7759 | 29.9993 | 27.9759 | −11.2186 | 29.9993 |
| 28.6828 | −9.1993 | 29.9993 | 28.1937 | −11.5364 | 29.9993 |
| 28.9047 | −9.6226 | 29.9993 | 28.4102 | −11.8556 | 29.9993 |
| 29.1239 | −10.0473 | 29.9993 | 28.6239 | −12.1762 | 29.9993 |
| 29.3431 | −10.4733 | 29.9993 | 28.8349 | −12.4981 | 29.9993 |
| 29.5596 | −10.8994 | 29.9993 | 29.0417 | −12.8214 | 29.9993 |
| 29.7774 | −11.3254 | 29.9993 | 29.2472 | −13.1461 | 29.9993 |
| 29.9966 | −11.7487 | 29.9993 | 29.4513 | −13.4749 | 29.9993 |
| 30.2171 | −12.1721 | 29.9993 | 29.5650 | −13.6297 | 29.9993 |
| 30.4363 | −12.5968 | 29.9993 | 29.6787 | −13.7845 | 29.9993 |
| 30.6432 | −13.0297 | 29.9993 | 29.8952 | −13.9105 | 29.9993 |
| 30.6884 | −13.4900 | 29.9993 | 30.1500 | −13.9379 | 29.9993 |
| 30.3911 | −13.8571 | 29.9993 | 30.3911 | −13.8571 | 29.9993 |
| 2.2741 | 5.5812 | 40.0000 | 2.2741 | 5.5812 | 40.0000 |
| 2.1275 | 5.8511 | 40.0000 | 2.5550 | 5.3278 | 40.0000 |
| 2.0549 | 6.1484 | 40.0000 | 2.9029 | 5.1757 | 40.0000 |
| 2.0522 | 6.3018 | 40.0000 | 3.2756 | 5.1086 | 40.0000 |
| 2.0495 | 6.4552 | 40.0000 | 3.6537 | 5.1058 | 40.0000 |
| 2.1385 | 6.9197 | 40.0000 | 4.0290 | 5.1483 | 40.0000 |
| 2.2988 | 7.3580 | 40.0000 | 4.4003 | 5.2236 | 40.0000 |
| 2.5070 | 7.7772 | 40.0000 | 4.7674 | 5.3195 | 40.0000 |
| 2.7550 | 8.1773 | 40.0000 | 5.1319 | 5.4237 | 40.0000 |
| 3.0317 | 8.5595 | 40.0000 | 5.4963 | 5.5291 | 40.0000 |
| 3.3317 | 8.9225 | 40.0000 | 5.8620 | 5.6319 | 40.0000 |
| 3.6509 | 9.2650 | 40.0000 | 6.2278 | 5.7264 | 40.0000 |
| 3.9879 | 9.5897 | 40.0000 | 6.5963 | 5.8127 | 40.0000 |
| 4.3373 | 9.8952 | 40.0000 | 6.9662 | 5.8908 | 40.0000 |
| 4.7003 | 10.1856 | 40.0000 | 7.3375 | 5.9593 | 40.0000 |
| 5.0757 | 10.4596 | 40.0000 | 7.7115 | 6.0182 | 40.0000 |
| 5.4661 | 10.7172 | 40.0000 | 8.0869 | 6.0634 | 40.0000 |
| 5.8716 | 10.9555 | 40.0000 | 8.4663 | 6.0936 | 40.0000 |
| 6.2881 | 11.1720 | 40.0000 | 8.8486 | 6.1073 | 40.0000 |
| 6.7142 | 11.3624 | 40.0000 | 9.2294 | 6.1032 | 40.0000 |
| 7.1484 | 11.5268 | 40.0000 | 9.6075 | 6.0785 | 40.0000 |
| 7.5950 | 11.6638 | 40.0000 | 9.9815 | 6.0374 | 40.0000 |
| 8.0512 | 11.7734 | 40.0000 | 10.3528 | 5.9758 | 40.0000 |
| 8.5129 | 11.8542 | 40.0000 | 10.7227 | 5.8963 | 40.0000 |
| 8.9773 | 11.9063 | 40.0000 | 11.0898 | 5.7977 | 40.0000 |
| 9.4404 | 11.9268 | 40.0000 | 11.4528 | 5.6826 | 40.0000 |
| 9.9034 | 11.9186 | 40.0000 | 11.8104 | 5.5497 | 40.0000 |
| 10.3665 | 11.8830 | 40.0000 | 12.1584 | 5.4017 | 40.0000 |
| 10.8295 | 11.8172 | 40.0000 | 12.4981 | 5.2401 | 40.0000 |
| 11.2898 | 11.7255 | 40.0000 | 12.8324 | 5.0634 | 40.0000 |
| 11.7433 | 11.6090 | 40.0000 | 13.1584 | 4.8757 | 40.0000 |
| 12.1885 | 11.4693 | 40.0000 | 13.4804 | 4.6757 | 40.0000 |
| 12.6242 | 11.3063 | 40.0000 | 13.7955 | 4.4674 | 40.0000 |
| 13.0529 | 11.1227 | 40.0000 | 14.1064 | 4.2496 | 40.0000 |
| 13.4749 | 10.9199 | 40.0000 | 14.4106 | 4.0236 | 40.0000 |
| 13.8873 | 10.6980 | 40.0000 | 14.7092 | 3.7907 | 40.0000 |
| 14.2914 | 10.4624 | 40.0000 | 15.0024 | 3.5523 | 40.0000 |
| 14.6832 | 10.2117 | 40.0000 | 15.2901 | 3.3084 | 40.0000 |
| 15.0654 | 9.9486 | 40.0000 | 15.5737 | 3.0605 | 40.0000 |
| 15.4380 | 9.6746 | 40.0000 | 15.8531 | 2.8084 | 40.0000 |
| 15.8011 | 9.3883 | 40.0000 | 16.1285 | 2.5522 | 40.0000 |
| 16.1545 | 9.0924 | 40.0000 | 16.3998 | 2.2933 | 40.0000 |
| 16.5011 | 8.7855 | 40.0000 | 16.6683 | 2.0316 | 40.0000 |
| 16.8409 | 8.4691 | 40.0000 | 16.9340 | 1.7672 | 40.0000 |
| 17.1724 | 8.1444 | 40.0000 | 17.1957 | 1.5001 | 40.0000 |
| 17.4971 | 7.8115 | 40.0000 | 17.4560 | 1.2302 | 40.0000 |
| 17.8149 | 7.4704 | 40.0000 | 17.7135 | 0.9576 | 40.0000 |
| 18.1259 | 7.1224 | 40.0000 | 17.9684 | 0.6822 | 40.0000 |
| 18.4314 | 6.7703 | 40.0000 | 18.2218 | 0.4069 | 40.0000 |
| 18.7301 | 6.4128 | 40.0000 | 18.4739 | 0.1274 | 40.0000 |
| 19.0219 | 6.0497 | 40.0000 | 18.7232 | −0.1521 | 40.0000 |
| 19.3095 | 5.6840 | 40.0000 | 18.9712 | −0.4329 | 40.0000 |
| 19.5904 | 5.3127 | 40.0000 | 19.2178 | −0.7165 | 40.0000 |

TABLE I-continued

| SUCTION SIDE | | | PRESSURE SIDE | | |
|---|---|---|---|---|---|
| X (%) | Y (%) | Z (%) | X (%) | Y (%) | Z (%) |
| 19.8657 | 4.9373 | 40.0000 | 19.4630 | −1.0001 | 40.0000 |
| 20.1384 | 4.5592 | 40.0000 | 19.7082 | −1.2850 | 40.0000 |
| 20.4055 | 4.1784 | 40.0000 | 19.9507 | −1.5713 | 40.0000 |
| 20.6699 | 3.7948 | 40.0000 | 20.1932 | −1.8590 | 40.0000 |
| 20.9316 | 3.4085 | 40.0000 | 20.4356 | −2.1467 | 40.0000 |
| 21.1891 | 3.0208 | 40.0000 | 20.6754 | −2.4344 | 40.0000 |
| 21.4453 | 2.6303 | 40.0000 | 20.9151 | −2.7235 | 40.0000 |
| 21.6974 | 2.2385 | 40.0000 | 21.1549 | −3.0139 | 40.0000 |
| 21.9481 | 1.8467 | 40.0000 | 21.3932 | −3.3043 | 40.0000 |
| 22.1960 | 1.4522 | 40.0000 | 21.6316 | −3.5961 | 40.0000 |
| 22.4413 | 1.0562 | 40.0000 | 21.8686 | −3.8879 | 40.0000 |
| 22.6837 | 0.6589 | 40.0000 | 22.1043 | −4.1797 | 40.0000 |
| 22.9249 | 0.2603 | 40.0000 | 22.3399 | −4.4729 | 40.0000 |
| 23.1632 | −0.1384 | 40.0000 | 22.5755 | −4.7661 | 40.0000 |
| 23.4002 | −0.5398 | 40.0000 | 22.8098 | −5.0606 | 40.0000 |
| 23.6345 | −0.9412 | 40.0000 | 23.0427 | −5.3552 | 40.0000 |
| 23.8674 | −1.3439 | 40.0000 | 23.2756 | −5.6497 | 40.0000 |
| 24.0989 | −1.7467 | 40.0000 | 23.5085 | −5.9456 | 40.0000 |
| 24.3277 | −2.1522 | 40.0000 | 23.7400 | −6.2415 | 40.0000 |
| 24.5565 | −2.5577 | 40.0000 | 23.9715 | −6.5388 | 40.0000 |
| 24.7825 | −2.9632 | 40.0000 | 24.2017 | −6.8361 | 40.0000 |
| 25.0072 | −3.3701 | 40.0000 | 24.4304 | −7.1334 | 40.0000 |
| 25.2305 | −3.7783 | 40.0000 | 24.6592 | −7.4320 | 40.0000 |
| 25.4524 | −4.1880 | 40.0000 | 24.8866 | −7.7320 | 40.0000 |
| 25.6730 | −4.5976 | 40.0000 | 25.1127 | −8.0321 | 40.0000 |
| 25.8922 | −5.0086 | 40.0000 | 25.3374 | −8.3334 | 40.0000 |
| 26.1100 | −5.4195 | 40.0000 | 25.5607 | −8.6362 | 40.0000 |
| 26.3265 | −5.8305 | 40.0000 | 25.7826 | −8.9403 | 40.0000 |
| 26.5429 | −6.2429 | 40.0000 | 26.0018 | −9.2445 | 40.0000 |
| 26.7580 | −6.6553 | 40.0000 | 26.2210 | −9.5500 | 40.0000 |
| 26.9731 | −7.0690 | 40.0000 | 26.4374 | −9.8582 | 40.0000 |
| 27.1868 | −7.4827 | 40.0000 | 26.6525 | −10.1664 | 40.0000 |
| 27.4005 | −7.8964 | 40.0000 | 26.8662 | −10.4761 | 40.0000 |
| 27.6129 | −8.3102 | 40.0000 | 27.0772 | −10.7870 | 40.0000 |
| 27.8238 | −8.7253 | 40.0000 | 27.2882 | −11.0994 | 40.0000 |
| 28.0334 | −9.1404 | 40.0000 | 27.4964 | −11.4117 | 40.0000 |
| 28.2417 | −9.5568 | 40.0000 | 27.7033 | −11.7268 | 40.0000 |
| 28.4485 | −9.9747 | 40.0000 | 27.9074 | −12.0433 | 40.0000 |
| 28.6526 | −10.3939 | 40.0000 | 28.1074 | −12.3611 | 40.0000 |
| 28.8568 | −10.8131 | 40.0000 | 28.3047 | −12.6803 | 40.0000 |
| 29.0609 | −11.2309 | 40.0000 | 28.4978 | −13.0023 | 40.0000 |
| 29.2664 | −11.6487 | 40.0000 | 28.6924 | −13.3256 | 40.0000 |
| 29.4746 | −12.0652 | 40.0000 | 28.8033 | −13.4776 | 40.0000 |
| 29.6815 | −12.4817 | 40.0000 | 28.9143 | −13.6297 | 40.0000 |
| 29.8733 | −12.9077 | 40.0000 | 29.1239 | −13.7530 | 40.0000 |
| 29.9048 | −13.3571 | 40.0000 | 29.3732 | −13.7790 | 40.0000 |
| 29.6061 | −13.7078 | 40.0000 | 29.6061 | −13.7078 | 40.0000 |
| 2.7358 | 7.0032 | 50.0007 | 2.7358 | 7.0032 | 50.0007 |
| 2.6057 | 7.2690 | 50.0007 | 3.0016 | 6.7457 | 50.0007 |
| 2.5467 | 7.5594 | 50.0007 | 3.3331 | 6.5813 | 50.0007 |
| 2.5488 | 7.7081 | 50.0007 | 3.6934 | 6.5004 | 50.0007 |
| 2.5509 | 7.8567 | 50.0007 | 4.0619 | 6.4826 | 50.0007 |
| 2.6509 | 8.3019 | 50.0007 | 4.4304 | 6.5114 | 50.0007 |
| 2.8249 | 8.7253 | 50.0007 | 4.7948 | 6.5717 | 50.0007 |
| 3.0482 | 9.1253 | 50.0007 | 5.1593 | 6.6511 | 50.0007 |
| 3.3071 | 9.5020 | 50.0007 | 5.5209 | 6.7333 | 50.0007 |
| 3.5920 | 9.8568 | 50.0007 | 5.8840 | 6.8114 | 50.0007 |
| 3.8989 | 10.1925 | 50.0007 | 6.2484 | 6.8786 | 50.0007 |
| 4.2277 | 10.5103 | 50.0007 | 6.6142 | 6.9320 | 50.0007 |
| 4.5743 | 10.8076 | 50.0007 | 6.9840 | 6.9745 | 50.0007 |
| 4.9346 | 11.0843 | 50.0007 | 7.3553 | 7.0032 | 50.0007 |
| 5.3100 | 11.3405 | 50.0007 | 7.7279 | 7.0197 | 50.0007 |
| 5.6990 | 11.5775 | 50.0007 | 8.0992 | 7.0224 | 50.0007 |
| 6.1004 | 11.7926 | 50.0007 | 8.4691 | 7.0101 | 50.0007 |
| 6.5141 | 11.9844 | 50.0007 | 8.8362 | 6.9827 | 50.0007 |
| 6.9375 | 12.1488 | 50.0007 | 9.2020 | 6.9375 | 50.0007 |
| 7.3690 | 12.2844 | 50.0007 | 9.5664 | 6.8744 | 50.0007 |
| 7.8074 | 12.3913 | 50.0007 | 9.9281 | 6.7936 | 50.0007 |
| 8.2554 | 12.4666 | 50.0007 | 10.2856 | 6.6963 | 50.0007 |
| 8.7102 | 12.5118 | 50.0007 | 10.6405 | 6.5840 | 50.0007 |
| 9.1664 | 12.5269 | 50.0007 | 10.9884 | 6.4552 | 50.0007 |
| 9.6185 | 12.5132 | 50.0007 | 11.3309 | 6.3114 | 50.0007 |
| 10.0678 | 12.4707 | 50.0007 | 11.6679 | 6.1552 | 50.0007 |
| 10.5172 | 12.4008 | 50.0007 | 11.9981 | 5.9853 | 50.0007 |
| 10.9638 | 12.3036 | 50.0007 | 12.3214 | 5.8045 | 50.0007 |
| 11.4022 | 12.1817 | 50.0007 | 12.6379 | 5.6127 | 50.0007 |

TABLE I-continued

| SUCTION SIDE | | | PRESSURE SIDE | | |
|---|---|---|---|---|---|
| X (%) | Y (%) | Z (%) | X (%) | Y (%) | Z (%) |
| 11.8337 | 12.0364 | 50.0007 | 12.9488 | 5.4100 | 50.0007 |
| 12.2543 | 11.8707 | 50.0007 | 13.2543 | 5.1976 | 50.0007 |
| 12.6680 | 11.6857 | 50.0007 | 13.5530 | 4.9784 | 50.0007 |
| 13.0735 | 11.4816 | 50.0007 | 13.8462 | 4.7510 | 50.0007 |
| 13.4722 | 11.2597 | 50.0007 | 14.1338 | 4.5195 | 50.0007 |
| 13.8599 | 11.0240 | 50.0007 | 14.4161 | 4.2825 | 50.0007 |
| 14.2393 | 10.7733 | 50.0007 | 14.6914 | 4.0400 | 50.0007 |
| 14.6092 | 10.5117 | 50.0007 | 14.9640 | 3.7934 | 50.0007 |
| 14.9695 | 10.2391 | 50.0007 | 15.2312 | 3.5427 | 50.0007 |
| 15.3189 | 9.9555 | 50.0007 | 15.4956 | 3.2893 | 50.0007 |
| 15.6613 | 9.6623 | 50.0007 | 15.7559 | 3.0317 | 50.0007 |
| 15.9942 | 9.3609 | 50.0007 | 16.0134 | 2.7701 | 50.0007 |
| 16.3203 | 9.0486 | 50.0007 | 16.2682 | 2.5057 | 50.0007 |
| 16.6395 | 8.7280 | 50.0007 | 16.5217 | 2.2385 | 50.0007 |
| 16.9518 | 8.4006 | 50.0007 | 16.7710 | 1.9700 | 50.0007 |
| 17.2573 | 8.0649 | 50.0007 | 17.0176 | 1.6974 | 50.0007 |
| 17.5560 | 7.7224 | 50.0007 | 17.2628 | 1.4234 | 50.0007 |
| 17.8478 | 7.3745 | 50.0007 | 17.5053 | 1.1467 | 50.0007 |
| 18.1341 | 7.0224 | 50.0007 | 17.7464 | 0.8686 | 50.0007 |
| 18.4136 | 6.6662 | 50.0007 | 17.9862 | 0.5877 | 50.0007 |
| 18.6876 | 6.3059 | 50.0007 | 18.2232 | 0.3069 | 50.0007 |
| 18.9575 | 5.9415 | 50.0007 | 18.4588 | 0.0233 | 50.0007 |
| 19.2219 | 5.5744 | 50.0007 | 18.6931 | −0.2603 | 50.0007 |
| 19.4808 | 5.2031 | 50.0007 | 18.9273 | −0.5466 | 50.0007 |
| 19.7370 | 4.8291 | 50.0007 | 19.1588 | −0.8329 | 50.0007 |
| 19.9890 | 4.4524 | 50.0007 | 19.3904 | −1.1206 | 50.0007 |
| 20.2370 | 4.0743 | 50.0007 | 19.6192 | −1.4083 | 50.0007 |
| 20.4822 | 3.6920 | 50.0007 | 19.8493 | −1.6974 | 50.0007 |
| 20.7261 | 3.3098 | 50.0007 | 20.0767 | −1.9878 | 50.0007 |
| 20.9658 | 2.9249 | 50.0007 | 20.3041 | −2.2782 | 50.0007 |
| 21.2042 | 2.5385 | 50.0007 | 20.5315 | −2.5687 | 50.0007 |
| 21.4398 | 2.1508 | 50.0007 | 20.7576 | −2.8605 | 50.0007 |
| 21.6727 | 1.7631 | 50.0007 | 20.9823 | −3.1523 | 50.0007 |
| 21.9042 | 1.3727 | 50.0007 | 21.2069 | −3.4454 | 50.0007 |
| 22.1344 | 0.9823 | 50.0007 | 21.4316 | −3.7372 | 50.0007 |
| 22.3618 | 0.5905 | 50.0007 | 21.6549 | −4.0304 | 50.0007 |
| 22.5878 | 0.1973 | 50.0007 | 21.8782 | −4.3236 | 50.0007 |
| 22.8112 | −0.1959 | 50.0007 | 22.1001 | −4.6181 | 50.0007 |
| 23.0331 | −0.5905 | 50.0007 | 22.3221 | −4.9127 | 50.0007 |
| 23.2536 | −0.9864 | 50.0007 | 22.5440 | −5.2072 | 50.0007 |
| 23.4728 | −1.3823 | 50.0007 | 22.7646 | −5.5017 | 50.0007 |
| 23.6893 | −1.7796 | 50.0007 | 22.9851 | −5.7977 | 50.0007 |
| 23.9057 | −2.1782 | 50.0007 | 23.2057 | −6.0936 | 50.0007 |
| 24.1195 | −2.5783 | 50.0007 | 23.4249 | −6.3895 | 50.0007 |
| 24.3318 | −2.9783 | 50.0007 | 23.6441 | −6.6868 | 50.0007 |
| 24.5428 | −3.3783 | 50.0007 | 23.8619 | −6.9840 | 50.0007 |
| 24.7524 | −3.7811 | 50.0007 | 24.0797 | −7.2813 | 50.0007 |
| 24.9606 | −4.1825 | 50.0007 | 24.2962 | −7.5813 | 50.0007 |
| 25.1675 | −4.5852 | 50.0007 | 24.5113 | −7.8800 | 50.0007 |
| 25.3730 | −4.9894 | 50.0007 | 24.7250 | −8.1800 | 50.0007 |
| 25.5785 | −5.3922 | 50.0007 | 24.9387 | −8.4814 | 50.0007 |
| 25.7826 | −5.7977 | 50.0007 | 25.1497 | −8.7842 | 50.0007 |
| 25.9853 | −6.2018 | 50.0007 | 25.3593 | −9.0869 | 50.0007 |
| 26.1867 | −6.6073 | 50.0007 | 25.5689 | −9.3911 | 50.0007 |
| 26.3881 | −7.0128 | 50.0007 | 25.7744 | −9.6966 | 50.0007 |
| 26.5881 | −7.4197 | 50.0007 | 25.9799 | −10.0021 | 50.0007 |
| 26.7868 | −7.8266 | 50.0007 | 26.1840 | −10.3103 | 50.0007 |
| 26.9854 | −8.2348 | 50.0007 | 26.3854 | −10.6185 | 50.0007 |
| 27.1827 | −8.6431 | 50.0007 | 26.5854 | −10.9281 | 50.0007 |
| 27.3786 | −9.0513 | 50.0007 | 26.7840 | −11.2405 | 50.0007 |
| 27.5745 | −9.4609 | 50.0007 | 26.9813 | −11.5528 | 50.0007 |
| 27.7690 | −9.8705 | 50.0007 | 27.1745 | −11.8666 | 50.0007 |
| 27.9636 | −10.2802 | 50.0007 | 27.3663 | −12.1817 | 50.0007 |
| 28.1567 | −10.6898 | 50.0007 | 27.5539 | −12.4967 | 50.0007 |
| 28.3485 | −11.0994 | 50.0007 | 27.7389 | −12.8159 | 50.0007 |
| 28.5403 | −11.5090 | 50.0007 | 27.9238 | −13.1365 | 50.0007 |
| 28.7307 | −11.9200 | 50.0007 | 28.0307 | −13.2865 | 50.0007 |
| 28.9212 | −12.3324 | 50.0007 | 28.1375 | −13.4365 | 50.0007 |
| 29.1020 | −12.7516 | 50.0007 | 28.3430 | −13.5585 | 50.0007 |
| 29.1184 | −13.1858 | 50.0007 | 28.5869 | −13.5872 | 50.0007 |
| 28.8184 | −13.5201 | 50.0007 | 28.8184 | −13.5201 | 50.0007 |
| 3.2002 | 8.4280 | 60.0000 | 3.2002 | 8.4280 | 60.0000 |
| 3.0509 | 8.8458 | 60.0000 | 3.3454 | 8.2444 | 60.0000 |
| 3.0660 | 9.2924 | 60.0000 | 3.5290 | 8.0992 | 60.0000 |
| 3.1947 | 9.7185 | 60.0000 | 3.6331 | 8.0451 | 60.0000 |
| 3.3934 | 10.1199 | 60.0000 | 3.7372 | 7.9910 | 60.0000 |

TABLE I-continued

| SUCTION SIDE | | | PRESSURE SIDE | | |
|---|---|---|---|---|---|
| X (%) | Y (%) | Z (%) | X (%) | Y (%) | Z (%) |
| 3.6372 | 10.4925 | 60.0000 | 4.0838 | 7.8896 | 60.0000 |
| 3.9153 | 10.8405 | 60.0000 | 4.4414 | 7.8512 | 60.0000 |
| 4.2195 | 11.1679 | 60.0000 | 4.8017 | 7.8581 | 60.0000 |
| 4.5441 | 11.4734 | 60.0000 | 5.1620 | 7.8964 | 60.0000 |
| 4.8839 | 11.7570 | 60.0000 | 5.5209 | 7.9512 | 60.0000 |
| 5.2415 | 12.0186 | 60.0000 | 5.8812 | 8.0101 | 60.0000 |
| 5.6155 | 12.2584 | 60.0000 | 6.2402 | 8.0636 | 60.0000 |
| 6.0045 | 12.4748 | 60.0000 | 6.6005 | 8.1047 | 60.0000 |
| 6.4059 | 12.6666 | 60.0000 | 6.9608 | 8.1307 | 60.0000 |
| 6.8169 | 12.8296 | 60.0000 | 7.3210 | 8.1389 | 60.0000 |
| 7.2361 | 12.9666 | 60.0000 | 7.6827 | 8.1321 | 60.0000 |
| 7.6649 | 13.0735 | 60.0000 | 8.0430 | 8.1074 | 60.0000 |
| 8.1019 | 13.1488 | 60.0000 | 8.4061 | 8.0677 | 60.0000 |
| 8.5458 | 13.1899 | 60.0000 | 8.7677 | 8.0115 | 60.0000 |
| 8.9883 | 13.1995 | 60.0000 | 9.1280 | 7.9375 | 60.0000 |
| 9.4280 | 13.1790 | 60.0000 | 9.4856 | 7.8457 | 60.0000 |
| 9.8623 | 13.1283 | 60.0000 | 9.8363 | 7.7375 | 60.0000 |
| 10.2966 | 13.0516 | 60.0000 | 10.1801 | 7.6129 | 60.0000 |
| 10.7281 | 12.9475 | 60.0000 | 10.5144 | 7.4745 | 60.0000 |
| 11.1528 | 12.8187 | 60.0000 | 10.8446 | 7.3210 | 60.0000 |
| 11.5693 | 12.6666 | 60.0000 | 11.1679 | 7.1525 | 60.0000 |
| 11.9762 | 12.4940 | 60.0000 | 11.4857 | 6.9731 | 60.0000 |
| 12.3735 | 12.3008 | 60.0000 | 11.7994 | 6.7813 | 60.0000 |
| 12.7639 | 12.0912 | 60.0000 | 12.1077 | 6.5799 | 60.0000 |
| 13.1434 | 11.8638 | 60.0000 | 12.4077 | 6.3703 | 60.0000 |
| 13.5160 | 11.6213 | 60.0000 | 12.7022 | 6.1525 | 60.0000 |
| 13.8777 | 11.3652 | 60.0000 | 12.9913 | 5.9292 | 60.0000 |
| 14.2297 | 11.0994 | 60.0000 | 13.2721 | 5.6990 | 60.0000 |
| 14.5722 | 10.8227 | 60.0000 | 13.5489 | 5.4620 | 60.0000 |
| 14.9051 | 10.5363 | 60.0000 | 13.8188 | 5.2209 | 60.0000 |
| 15.2298 | 10.2418 | 60.0000 | 14.0845 | 4.9743 | 60.0000 |
| 15.5476 | 9.9390 | 60.0000 | 14.3462 | 4.7236 | 60.0000 |
| 15.8586 | 9.6281 | 60.0000 | 14.6037 | 4.4688 | 60.0000 |
| 16.1614 | 9.3089 | 60.0000 | 14.8572 | 4.2085 | 60.0000 |
| 16.4587 | 8.9814 | 60.0000 | 15.1079 | 3.9468 | 60.0000 |
| 16.7491 | 8.6485 | 60.0000 | 15.3545 | 3.6797 | 60.0000 |
| 17.0327 | 8.3102 | 60.0000 | 15.5997 | 3.4112 | 60.0000 |
| 17.3108 | 7.9663 | 60.0000 | 15.8408 | 3.1399 | 60.0000 |
| 17.5820 | 7.6170 | 60.0000 | 16.0806 | 2.8659 | 60.0000 |
| 17.8492 | 7.2649 | 60.0000 | 16.3176 | 2.5892 | 60.0000 |
| 18.1108 | 6.9087 | 60.0000 | 16.5518 | 2.3111 | 60.0000 |
| 18.3670 | 6.5498 | 60.0000 | 16.7861 | 2.0303 | 60.0000 |
| 18.6191 | 6.1881 | 60.0000 | 17.0162 | 1.7494 | 60.0000 |
| 18.8657 | 5.8223 | 60.0000 | 17.2464 | 1.4659 | 60.0000 |
| 19.1095 | 5.4552 | 60.0000 | 17.4738 | 1.1809 | 60.0000 |
| 19.3493 | 5.0839 | 60.0000 | 17.6998 | 0.8960 | 60.0000 |
| 19.5863 | 4.7113 | 60.0000 | 17.9245 | 0.6083 | 60.0000 |
| 19.8192 | 4.3373 | 60.0000 | 18.1492 | 0.3206 | 60.0000 |
| 20.0507 | 3.9605 | 60.0000 | 18.3711 | 0.0315 | 60.0000 |
| 20.2795 | 3.5811 | 60.0000 | 18.5917 | −0.2589 | 60.0000 |
| 20.5055 | 3.2016 | 60.0000 | 18.8122 | −0.5494 | 60.0000 |
| 20.7288 | 2.8207 | 60.0000 | 19.0314 | −0.8398 | 60.0000 |
| 20.9508 | 2.4385 | 60.0000 | 19.2493 | −1.1316 | 60.0000 |
| 21.1699 | 2.0549 | 60.0000 | 19.4657 | −1.4248 | 60.0000 |
| 21.3878 | 1.6700 | 60.0000 | 19.6822 | −1.7179 | 60.0000 |
| 21.6028 | 1.2850 | 60.0000 | 19.8986 | −2.0111 | 60.0000 |
| 21.8179 | 0.8987 | 60.0000 | 20.1123 | −2.3056 | 60.0000 |
| 22.0289 | 0.5124 | 60.0000 | 20.3274 | −2.6002 | 60.0000 |
| 22.2399 | 0.1247 | 60.0000 | 20.5411 | −2.8947 | 60.0000 |
| 22.4495 | −0.2644 | 60.0000 | 20.7548 | −3.1906 | 60.0000 |
| 22.6577 | −0.6535 | 60.0000 | 20.9672 | −3.4865 | 60.0000 |
| 22.8646 | −1.0439 | 60.0000 | 21.1795 | −3.7825 | 60.0000 |
| 23.0701 | −1.4343 | 60.0000 | 21.3919 | −4.0784 | 60.0000 |
| 23.2742 | −1.8262 | 60.0000 | 21.6028 | −4.3756 | 60.0000 |
| 23.4770 | −2.2180 | 60.0000 | 21.8138 | −4.6729 | 60.0000 |
| 23.6783 | −2.6111 | 60.0000 | 22.0248 | −4.9702 | 60.0000 |
| 23.8783 | −3.0043 | 60.0000 | 22.2358 | −5.2675 | 60.0000 |
| 24.0756 | −3.3989 | 60.0000 | 22.4454 | −5.5661 | 60.0000 |
| 24.2729 | −3.7948 | 60.0000 | 22.6550 | −5.8634 | 60.0000 |
| 24.4688 | −4.1893 | 60.0000 | 22.8632 | −6.1634 | 60.0000 |
| 24.6620 | −4.5866 | 60.0000 | 23.0714 | −6.4621 | 60.0000 |
| 24.8551 | −4.9825 | 60.0000 | 23.2797 | −6.7621 | 60.0000 |
| 25.0469 | −5.3798 | 60.0000 | 23.4852 | −7.0621 | 60.0000 |
| 25.2373 | −5.7771 | 60.0000 | 23.6920 | −7.3635 | 60.0000 |
| 25.4264 | −6.1758 | 60.0000 | 23.8962 | −7.6649 | 60.0000 |
| 25.6168 | −6.5744 | 60.0000 | 24.1003 | −7.9677 | 60.0000 |

TABLE I-continued

| SUCTION SIDE | | | PRESSURE SIDE | | |
|---|---|---|---|---|---|
| X (%) | Y (%) | Z (%) | X (%) | Y (%) | Z (%) |
| 25.8059 | −6.9731 | 60.0000 | 24.3030 | −8.2704 | 60.0000 |
| 25.9949 | −7.3731 | 60.0000 | 24.5030 | −8.5732 | 60.0000 |
| 26.1840 | −7.7731 | 60.0000 | 24.7031 | −8.8787 | 60.0000 |
| 26.3717 | −8.1745 | 60.0000 | 24.9017 | −9.1842 | 60.0000 |
| 26.5580 | −8.5759 | 60.0000 | 25.0990 | −9.4911 | 60.0000 |
| 26.7429 | −8.9773 | 60.0000 | 25.2949 | −9.7979 | 60.0000 |
| 26.9251 | −9.3787 | 60.0000 | 25.4880 | −10.1062 | 60.0000 |
| 27.1060 | −9.7815 | 60.0000 | 25.6812 | −10.4158 | 60.0000 |
| 27.2841 | −10.1843 | 60.0000 | 25.8730 | −10.7268 | 60.0000 |
| 27.4594 | −10.5884 | 60.0000 | 26.0621 | −11.0377 | 60.0000 |
| 27.6361 | −10.9912 | 60.0000 | 26.2497 | −11.3515 | 60.0000 |
| 27.8156 | −11.3953 | 60.0000 | 26.4347 | −11.6652 | 60.0000 |
| 28.0005 | −11.7981 | 60.0000 | 26.6169 | −11.9803 | 60.0000 |
| 28.1896 | −12.2036 | 60.0000 | 26.7964 | −12.2967 | 60.0000 |
| 28.2656 | −12.4091 | 60.0000 | 26.9731 | −12.6146 | 60.0000 |
| 28.3417 | −12.6146 | 60.0000 | 27.1512 | −12.9351 | 60.0000 |
| 28.3636 | −12.8913 | 60.0000 | 27.3553 | −13.2338 | 60.0000 |
| 28.2567 | −13.1571 | 60.0000 | 27.6813 | −13.3900 | 60.0000 |
| 28.0348 | −13.3352 | 60.0000 | 28.0348 | −13.3352 | 60.0000 |
| 3.6811 | 9.8500 | 70.0007 | 3.6811 | 9.8500 | 70.0007 |
| 3.5770 | 10.2719 | 70.0007 | 3.8126 | 9.6582 | 70.0007 |
| 3.6208 | 10.7048 | 70.0007 | 3.9852 | 9.4993 | 70.0007 |
| 3.7674 | 11.1145 | 70.0007 | 4.0845 | 9.4390 | 70.0007 |
| 3.9907 | 11.4885 | 70.0007 | 4.1838 | 9.3787 | 70.0007 |
| 4.2606 | 11.8296 | 70.0007 | 4.5209 | 9.2554 | 70.0007 |
| 4.5620 | 12.1460 | 70.0007 | 4.8743 | 9.1965 | 70.0007 |
| 4.8839 | 12.4392 | 70.0007 | 5.2319 | 9.1856 | 70.0007 |
| 5.2223 | 12.7091 | 70.0007 | 5.5922 | 9.2047 | 70.0007 |
| 5.5771 | 12.9543 | 70.0007 | 5.9525 | 9.2376 | 70.0007 |
| 5.9497 | 13.1735 | 70.0007 | 6.3128 | 9.2719 | 70.0007 |
| 6.3388 | 13.3694 | 70.0007 | 6.6731 | 9.3006 | 70.0007 |
| 6.7388 | 13.5393 | 70.0007 | 7.0320 | 9.3184 | 70.0007 |
| 7.1457 | 13.6790 | 70.0007 | 7.3937 | 9.3226 | 70.0007 |
| 7.5622 | 13.7900 | 70.0007 | 7.7553 | 9.3089 | 70.0007 |
| 7.9882 | 13.8694 | 70.0007 | 8.1170 | 9.2746 | 70.0007 |
| 8.4211 | 13.9160 | 70.0007 | 8.4759 | 9.2198 | 70.0007 |
| 8.8527 | 13.9270 | 70.0007 | 8.8307 | 9.1431 | 70.0007 |
| 9.2828 | 13.9037 | 70.0007 | 9.1801 | 9.0472 | 70.0007 |
| 9.7075 | 13.8489 | 70.0007 | 9.5212 | 8.9321 | 70.0007 |
| 10.1295 | 13.7667 | 70.0007 | 9.8568 | 8.7992 | 70.0007 |
| 10.5473 | 13.6557 | 70.0007 | 10.1843 | 8.6499 | 70.0007 |
| 10.9597 | 13.5187 | 70.0007 | 10.5076 | 8.4855 | 70.0007 |
| 11.3624 | 13.3612 | 70.0007 | 10.8227 | 8.3047 | 70.0007 |
| 11.7542 | 13.1817 | 70.0007 | 11.1309 | 8.1101 | 70.0007 |
| 12.1364 | 12.9817 | 70.0007 | 11.4295 | 7.9060 | 70.0007 |
| 12.5104 | 12.7639 | 70.0007 | 11.7186 | 7.6909 | 70.0007 |
| 12.8749 | 12.5296 | 70.0007 | 12.0008 | 7.4676 | 70.0007 |
| 13.2283 | 12.2803 | 70.0007 | 12.2762 | 7.2375 | 70.0007 |
| 13.5722 | 12.0186 | 70.0007 | 12.5461 | 7.0005 | 70.0007 |
| 13.9037 | 11.7474 | 70.0007 | 12.8132 | 6.7566 | 70.0007 |
| 14.2256 | 11.4652 | 70.0007 | 13.0749 | 6.5073 | 70.0007 |
| 14.5394 | 11.1734 | 70.0007 | 13.3324 | 6.2539 | 70.0007 |
| 14.8449 | 10.8733 | 70.0007 | 13.5859 | 5.9949 | 70.0007 |
| 15.1449 | 10.5651 | 70.0007 | 13.8352 | 5.7333 | 70.0007 |
| 15.4367 | 10.2500 | 70.0007 | 14.0790 | 5.4661 | 70.0007 |
| 15.7230 | 9.9267 | 70.0007 | 14.3202 | 5.1976 | 70.0007 |
| 16.0011 | 9.5979 | 70.0007 | 14.5572 | 4.9250 | 70.0007 |
| 16.2737 | 9.2636 | 70.0007 | 14.7901 | 4.6496 | 70.0007 |
| 16.5395 | 8.9239 | 70.0007 | 15.0216 | 4.3729 | 70.0007 |
| 16.7998 | 8.5800 | 70.0007 | 15.2490 | 4.0934 | 70.0007 |
| 17.0546 | 8.2321 | 70.0007 | 15.4764 | 3.8126 | 70.0007 |
| 17.3039 | 7.8814 | 70.0007 | 15.6997 | 3.5317 | 70.0007 |
| 17.5505 | 7.5265 | 70.0007 | 15.9216 | 3.2482 | 70.0007 |
| 17.7916 | 7.1690 | 70.0007 | 16.1422 | 2.9632 | 70.0007 |
| 18.0286 | 6.8101 | 70.0007 | 16.3614 | 2.6769 | 70.0007 |
| 18.2629 | 6.4484 | 70.0007 | 16.5792 | 2.3892 | 70.0007 |
| 18.4944 | 6.0840 | 70.0007 | 16.7957 | 2.1015 | 70.0007 |
| 18.7218 | 5.7168 | 70.0007 | 17.0121 | 1.8125 | 70.0007 |
| 18.9465 | 5.3497 | 70.0007 | 17.2258 | 1.5220 | 70.0007 |
| 19.1684 | 4.9798 | 70.0007 | 17.4396 | 1.2316 | 70.0007 |
| 19.3876 | 4.6085 | 70.0007 | 17.6519 | 0.9398 | 70.0007 |
| 19.6041 | 4.2359 | 70.0007 | 17.8629 | 0.6480 | 70.0007 |
| 19.8192 | 3.8633 | 70.0007 | 18.0725 | 0.3548 | 70.0007 |
| 20.0315 | 3.4879 | 70.0007 | 18.2821 | 0.0616 | 70.0007 |
| 20.2425 | 3.1125 | 70.0007 | 18.4917 | −0.2329 | 70.0007 |
| 20.4521 | 2.7358 | 70.0007 | 18.6985 | −0.5288 | 70.0007 |

TABLE I-continued

| SUCTION SIDE | | | PRESSURE SIDE | | |
|---|---|---|---|---|---|
| X (%) | Y (%) | Z (%) | X (%) | Y (%) | Z (%) |
| 20.6589 | 2.3591 | 70.0007 | 18.9054 | −0.8233 | 70.0007 |
| 20.8644 | 1.9810 | 70.0007 | 19.1123 | −1.1193 | 70.0007 |
| 21.0672 | 1.6015 | 70.0007 | 19.3178 | −1.4165 | 70.0007 |
| 21.2686 | 1.2220 | 70.0007 | 19.5233 | −1.7124 | 70.0007 |
| 21.4686 | 0.8412 | 70.0007 | 19.7274 | −2.0111 | 70.0007 |
| 21.6686 | 0.4589 | 70.0007 | 19.9301 | −2.3084 | 70.0007 |
| 21.8659 | 0.0767 | 70.0007 | 20.1343 | −2.6070 | 70.0007 |
| 22.0618 | −0.3069 | 70.0007 | 20.3356 | −2.9057 | 70.0007 |
| 22.2563 | −0.6905 | 70.0007 | 20.5384 | −3.2043 | 70.0007 |
| 22.4495 | −1.0740 | 70.0007 | 20.7384 | −3.5043 | 70.0007 |
| 22.6426 | −1.4604 | 70.0007 | 20.9398 | −3.8030 | 70.0007 |
| 22.8344 | −1.8453 | 70.0007 | 21.1398 | −4.1044 | 70.0007 |
| 23.0249 | −2.2330 | 70.0007 | 21.3398 | −4.4044 | 70.0007 |
| 23.2139 | −2.6194 | 70.0007 | 21.5385 | −4.7058 | 70.0007 |
| 23.4016 | −3.0071 | 70.0007 | 21.7371 | −5.0072 | 70.0007 |
| 23.5879 | −3.3961 | 70.0007 | 21.9357 | −5.3086 | 70.0007 |
| 23.7729 | −3.7852 | 70.0007 | 22.1330 | −5.6100 | 70.0007 |
| 23.9564 | −4.1743 | 70.0007 | 22.3303 | −5.9127 | 70.0007 |
| 24.1386 | −4.5647 | 70.0007 | 22.5262 | −6.2155 | 70.0007 |
| 24.3195 | −4.9551 | 70.0007 | 22.7221 | −6.5183 | 70.0007 |
| 24.5003 | −5.3456 | 70.0007 | 22.9166 | −6.8224 | 70.0007 |
| 24.6784 | −5.7374 | 70.0007 | 23.1112 | −7.1265 | 70.0007 |
| 24.8579 | −6.1292 | 70.0007 | 23.3043 | −7.4306 | 70.0007 |
| 25.0360 | −6.5224 | 70.0007 | 23.4961 | −7.7361 | 70.0007 |
| 25.2127 | −6.9142 | 70.0007 | 23.6879 | −8.0416 | 70.0007 |
| 25.3908 | −7.3073 | 70.0007 | 23.8783 | −8.3485 | 70.0007 |
| 25.5675 | −7.7019 | 70.0007 | 24.0660 | −8.6568 | 70.0007 |
| 25.7429 | −8.0964 | 70.0007 | 24.2537 | −8.9650 | 70.0007 |
| 25.9168 | −8.4910 | 70.0007 | 24.4387 | −9.2746 | 70.0007 |
| 26.0908 | −8.8855 | 70.0007 | 24.6236 | −9.5856 | 70.0007 |
| 26.2621 | −9.2815 | 70.0007 | 24.8058 | −9.8966 | 70.0007 |
| 26.4306 | −9.6774 | 70.0007 | 24.9866 | −10.2089 | 70.0007 |
| 26.5977 | −10.0733 | 70.0007 | 25.1661 | −10.5226 | 70.0007 |
| 26.7621 | −10.4692 | 70.0007 | 25.3456 | −10.8364 | 70.0007 |
| 26.9265 | −10.8665 | 70.0007 | 25.5223 | −11.1501 | 70.0007 |
| 27.0936 | −11.2624 | 70.0007 | 25.6990 | −11.4638 | 70.0007 |
| 27.2663 | −11.6611 | 70.0007 | 25.8744 | −11.7789 | 70.0007 |
| 27.4430 | −12.0584 | 70.0007 | 26.0470 | −12.0953 | 70.0007 |
| 27.5122 | −12.2611 | 70.0007 | 26.2141 | −12.4159 | 70.0007 |
| 27.5813 | −12.4639 | 70.0007 | 26.3785 | −12.7406 | 70.0007 |
| 27.5909 | −12.7337 | 70.0007 | 26.5785 | −13.0365 | 70.0007 |
| 27.4772 | −12.9899 | 70.0007 | 26.8977 | −13.2091 | 70.0007 |
| 27.2580 | −13.1584 | 70.0007 | 27.2580 | −13.1584 | 70.0007 |
| 4.1441 | 11.3528 | 80.0000 | 4.1441 | 11.3528 | 80.0000 |
| 4.0715 | 11.7652 | 80.0000 | 4.2537 | 11.1473 | 80.0000 |
| 4.1455 | 12.1803 | 80.0000 | 4.4099 | 10.9734 | 80.0000 |
| 4.3291 | 12.5598 | 80.0000 | 4.5051 | 10.9055 | 80.0000 |
| 4.5825 | 12.8968 | 80.0000 | 4.6003 | 10.8377 | 80.0000 |
| 4.8770 | 13.1995 | 80.0000 | 4.9305 | 10.6939 | 80.0000 |
| 5.1935 | 13.4776 | 80.0000 | 5.2812 | 10.6089 | 80.0000 |
| 5.5305 | 13.7311 | 80.0000 | 5.6401 | 10.5733 | 80.0000 |
| 5.8840 | 13.9612 | 80.0000 | 6.0018 | 10.5720 | 80.0000 |
| 6.2539 | 14.1640 | 80.0000 | 6.3634 | 10.5857 | 80.0000 |
| 6.6374 | 14.3380 | 80.0000 | 6.7265 | 10.5966 | 80.0000 |
| 7.0347 | 14.4832 | 80.0000 | 7.0882 | 10.5980 | 80.0000 |
| 7.4402 | 14.5955 | 80.0000 | 7.4485 | 10.5870 | 80.0000 |
| 7.8553 | 14.6750 | 80.0000 | 7.8088 | 10.5624 | 80.0000 |
| 8.2745 | 14.7202 | 80.0000 | 8.1691 | 10.5199 | 80.0000 |
| 8.6965 | 14.7311 | 80.0000 | 8.5280 | 10.4596 | 80.0000 |
| 9.1171 | 14.7065 | 80.0000 | 8.8828 | 10.3774 | 80.0000 |
| 9.5349 | 14.6489 | 80.0000 | 9.2294 | 10.2706 | 80.0000 |
| 9.9473 | 14.5599 | 80.0000 | 9.5650 | 10.1418 | 80.0000 |
| 10.3514 | 14.4407 | 80.0000 | 9.8925 | 9.9911 | 80.0000 |
| 10.7487 | 14.2955 | 80.0000 | 10.2103 | 9.8199 | 80.0000 |
| 11.1350 | 14.1284 | 80.0000 | 10.5213 | 9.6335 | 80.0000 |
| 11.5131 | 13.9407 | 80.0000 | 10.8227 | 9.4335 | 80.0000 |
| 11.8803 | 13.7338 | 80.0000 | 11.1158 | 9.2198 | 80.0000 |
| 12.2378 | 13.5105 | 80.0000 | 11.3980 | 8.9951 | 80.0000 |
| 12.5844 | 13.2708 | 80.0000 | 11.6720 | 8.7622 | 80.0000 |
| 12.9214 | 13.0160 | 80.0000 | 11.9378 | 8.5211 | 80.0000 |
| 13.2475 | 12.7488 | 80.0000 | 12.1954 | 8.2732 | 80.0000 |
| 13.5639 | 12.4707 | 80.0000 | 12.4474 | 8.0184 | 80.0000 |
| 13.8708 | 12.1817 | 80.0000 | 12.6940 | 7.7581 | 80.0000 |
| 14.1695 | 11.8844 | 80.0000 | 12.9351 | 7.4937 | 80.0000 |
| 14.4599 | 11.5775 | 80.0000 | 13.1735 | 7.2238 | 80.0000 |
| 14.7421 | 11.2652 | 80.0000 | 13.4064 | 6.9498 | 80.0000 |

TABLE I-continued

| SUCTION SIDE | | | PRESSURE SIDE | | |
|---|---|---|---|---|---|
| X (%) | Y (%) | Z (%) | X (%) | Y (%) | Z (%) |
| 15.0175 | 10.9446 | 80.0000 | 13.6366 | 6.6731 | 80.0000 |
| 15.2860 | 10.6199 | 80.0000 | 13.8640 | 6.3922 | 80.0000 |
| 15.5463 | 10.2884 | 80.0000 | 14.0873 | 6.1100 | 80.0000 |
| 15.8011 | 9.9527 | 80.0000 | 14.3065 | 5.8251 | 80.0000 |
| 16.0504 | 9.6116 | 80.0000 | 14.5243 | 5.5374 | 80.0000 |
| 16.2943 | 9.2678 | 80.0000 | 14.7394 | 5.2483 | 80.0000 |
| 16.5326 | 8.9198 | 80.0000 | 14.9517 | 4.9579 | 80.0000 |
| 16.7655 | 8.5691 | 80.0000 | 15.1613 | 4.6647 | 80.0000 |
| 16.9957 | 8.2156 | 80.0000 | 15.3695 | 4.3715 | 80.0000 |
| 17.2204 | 7.8594 | 80.0000 | 15.5764 | 4.0784 | 80.0000 |
| 17.4437 | 7.5005 | 80.0000 | 15.7819 | 3.7825 | 80.0000 |
| 17.6629 | 7.1402 | 80.0000 | 15.9860 | 3.4865 | 80.0000 |
| 17.8793 | 6.7785 | 80.0000 | 16.1902 | 3.1893 | 80.0000 |
| 18.0944 | 6.4155 | 80.0000 | 16.3915 | 2.8920 | 80.0000 |
| 18.3054 | 6.0511 | 80.0000 | 16.5929 | 2.5947 | 80.0000 |
| 18.5150 | 5.6853 | 80.0000 | 16.7943 | 2.2960 | 80.0000 |
| 18.7232 | 5.3182 | 80.0000 | 16.9929 | 1.9960 | 80.0000 |
| 18.9287 | 4.9510 | 80.0000 | 17.1930 | 1.6974 | 80.0000 |
| 19.1328 | 4.5811 | 80.0000 | 17.3916 | 1.3974 | 80.0000 |
| 19.3356 | 4.2112 | 80.0000 | 17.5889 | 1.0960 | 80.0000 |
| 19.5356 | 3.8400 | 80.0000 | 17.7861 | 0.7946 | 80.0000 |
| 19.7342 | 3.4687 | 80.0000 | 17.9821 | 0.4932 | 80.0000 |
| 19.9301 | 3.0961 | 80.0000 | 18.1780 | 0.1918 | 80.0000 |
| 20.1260 | 2.7221 | 80.0000 | 18.3725 | −0.1110 | 80.0000 |
| 20.3206 | 2.3481 | 80.0000 | 18.5670 | −0.4151 | 80.0000 |
| 20.5124 | 1.9727 | 80.0000 | 18.7602 | −0.7179 | 80.0000 |
| 20.7042 | 1.5974 | 80.0000 | 18.9534 | −1.0220 | 80.0000 |
| 20.8932 | 1.2206 | 80.0000 | 19.1451 | −1.3261 | 80.0000 |
| 21.0823 | 0.8425 | 80.0000 | 19.3356 | −1.6316 | 80.0000 |
| 21.2686 | 0.4658 | 80.0000 | 19.5260 | −1.9371 | 80.0000 |
| 21.4549 | 0.0863 | 80.0000 | 19.7164 | −2.2426 | 80.0000 |
| 21.6398 | −0.2918 | 80.0000 | 19.9055 | −2.5481 | 80.0000 |
| 21.8220 | −0.6726 | 80.0000 | 20.0945 | −2.8550 | 80.0000 |
| 22.0042 | −1.0521 | 80.0000 | 20.2836 | −3.1619 | 80.0000 |
| 22.1837 | −1.4343 | 80.0000 | 20.4726 | −3.4687 | 80.0000 |
| 22.3632 | −1.8152 | 80.0000 | 20.6603 | −3.7756 | 80.0000 |
| 22.5413 | −2.1974 | 80.0000 | 20.8480 | −4.0825 | 80.0000 |
| 22.7180 | −2.5810 | 80.0000 | 21.0343 | −4.3907 | 80.0000 |
| 22.8947 | −2.9632 | 80.0000 | 21.2220 | −4.6976 | 80.0000 |
| 23.0687 | −3.3468 | 80.0000 | 21.4083 | −5.0058 | 80.0000 |
| 23.2427 | −3.7318 | 80.0000 | 21.5933 | −5.3141 | 80.0000 |
| 23.4167 | −4.1154 | 80.0000 | 21.7796 | −5.6237 | 80.0000 |
| 23.5879 | −4.5003 | 80.0000 | 21.9645 | −5.9319 | 80.0000 |
| 23.7578 | −4.8866 | 80.0000 | 22.1481 | −6.2415 | 80.0000 |
| 23.9277 | −5.2730 | 80.0000 | 22.3317 | −6.5511 | 80.0000 |
| 24.0948 | −5.6593 | 80.0000 | 22.5139 | −6.8607 | 80.0000 |
| 24.2619 | −6.0470 | 80.0000 | 22.6961 | −7.1717 | 80.0000 |
| 24.4291 | −6.4347 | 80.0000 | 22.8769 | −7.4827 | 80.0000 |
| 24.5948 | −6.8224 | 80.0000 | 23.0564 | −7.7951 | 80.0000 |
| 24.7606 | −7.2101 | 80.0000 | 23.2358 | −8.1060 | 80.0000 |
| 24.9250 | −7.5978 | 80.0000 | 23.4139 | −8.4198 | 80.0000 |
| 25.0894 | −7.9855 | 80.0000 | 23.5907 | −8.7335 | 80.0000 |
| 25.2524 | −8.3745 | 80.0000 | 23.7674 | −9.0472 | 80.0000 |
| 25.4154 | −8.7636 | 80.0000 | 23.9414 | −9.3623 | 80.0000 |
| 25.5771 | −9.1527 | 80.0000 | 24.1154 | −9.6774 | 80.0000 |
| 25.7360 | −9.5431 | 80.0000 | 24.2893 | −9.9925 | 80.0000 |
| 25.8949 | −9.9336 | 80.0000 | 24.4606 | −10.3103 | 80.0000 |
| 26.0525 | −10.3254 | 80.0000 | 24.6318 | −10.6268 | 80.0000 |
| 26.2114 | −10.7158 | 80.0000 | 24.8003 | −10.9446 | 80.0000 |
| 26.3703 | −11.1062 | 80.0000 | 24.9675 | −11.2638 | 80.0000 |
| 26.5306 | −11.4967 | 80.0000 | 25.1319 | −11.5830 | 80.0000 |
| 26.6840 | −11.8899 | 80.0000 | 25.2963 | −11.9022 | 80.0000 |
| 26.7477 | −12.0919 | 80.0000 | 25.4579 | −12.2241 | 80.0000 |
| 26.8114 | −12.2940 | 80.0000 | 25.6223 | −12.5474 | 80.0000 |
| 26.8142 | −12.5611 | 80.0000 | 25.8141 | −12.8475 | 80.0000 |
| 26.6936 | −12.8036 | 80.0000 | 26.1306 | −13.0091 | 80.0000 |
| 26.4785 | −12.9666 | 80.0000 | 26.4785 | −12.9666 | 80.0000 |
| 4.6661 | 12.9735 | 90.0007 | 4.6661 | 12.9735 | 90.0007 |
| 4.6277 | 13.2434 | 90.0007 | 4.7592 | 12.7611 | 90.0007 |
| 4.6674 | 13.5146 | 90.0007 | 4.9003 | 12.5762 | 90.0007 |
| 4.7168 | 13.6420 | 90.0007 | 4.9873 | 12.4988 | 90.0007 |
| 4.7661 | 13.7694 | 90.0007 | 5.0743 | 12.4214 | 90.0007 |
| 4.9921 | 14.1256 | 90.0007 | 5.3880 | 12.2433 | 90.0007 |
| 5.2730 | 14.4435 | 90.0007 | 5.7278 | 12.1323 | 90.0007 |
| 5.5935 | 14.7161 | 90.0007 | 6.0799 | 12.0693 | 90.0007 |
| 5.9401 | 14.9503 | 90.0007 | 6.4361 | 12.0364 | 90.0007 |

TABLE I-continued

| SUCTION SIDE | | | PRESSURE SIDE | | |
|---|---|---|---|---|---|
| X (%) | Y (%) | Z (%) | X (%) | Y (%) | Z (%) |
| 6.3018 | 15.1599 | 90.0007 | 6.7936 | 12.0186 | 90.0007 |
| 6.6785 | 15.3463 | 90.0007 | 7.1512 | 12.0036 | 90.0007 |
| 7.0717 | 15.4997 | 90.0007 | 7.5101 | 11.9816 | 90.0007 |
| 7.4745 | 15.6107 | 90.0007 | 7.8663 | 11.9474 | 90.0007 |
| 7.8841 | 15.6805 | 90.0007 | 8.2170 | 11.8953 | 90.0007 |
| 8.2978 | 15.7093 | 90.0007 | 8.5636 | 11.8227 | 90.0007 |
| 8.7157 | 15.7024 | 90.0007 | 8.9075 | 11.7282 | 90.0007 |
| 9.1308 | 15.6572 | 90.0007 | 9.2472 | 11.6104 | 90.0007 |
| 9.5390 | 15.5778 | 90.0007 | 9.5828 | 11.4679 | 90.0007 |
| 9.9404 | 15.4654 | 90.0007 | 9.9075 | 11.3049 | 90.0007 |
| 10.3336 | 15.3230 | 90.0007 | 10.2199 | 11.1213 | 90.0007 |
| 10.7144 | 15.1545 | 90.0007 | 10.5213 | 10.9213 | 90.0007 |
| 11.0816 | 14.9640 | 90.0007 | 10.8117 | 10.7062 | 90.0007 |
| 11.4364 | 14.7558 | 90.0007 | 11.0912 | 10.4774 | 90.0007 |
| 11.7789 | 14.5325 | 90.0007 | 11.3624 | 10.2391 | 90.0007 |
| 12.1118 | 14.2928 | 90.0007 | 11.6255 | 9.9897 | 90.0007 |
| 12.4351 | 14.0393 | 90.0007 | 11.8803 | 9.7322 | 90.0007 |
| 12.7502 | 13.7722 | 90.0007 | 12.1269 | 9.4678 | 90.0007 |
| 13.0557 | 13.4927 | 90.0007 | 12.3680 | 9.1965 | 90.0007 |
| 13.3516 | 13.2023 | 90.0007 | 12.6022 | 8.9212 | 90.0007 |
| 13.6393 | 12.9050 | 90.0007 | 12.8324 | 8.6417 | 90.0007 |
| 13.9160 | 12.5995 | 90.0007 | 13.0557 | 8.3595 | 90.0007 |
| 14.1845 | 12.2871 | 90.0007 | 13.2749 | 8.0732 | 90.0007 |
| 14.4448 | 11.9707 | 90.0007 | 13.4900 | 7.7855 | 90.0007 |
| 14.6983 | 11.6474 | 90.0007 | 13.7009 | 7.4950 | 90.0007 |
| 14.9449 | 11.3213 | 90.0007 | 13.9078 | 7.2019 | 90.0007 |
| 15.1860 | 10.9898 | 90.0007 | 14.1119 | 6.9060 | 90.0007 |
| 15.4216 | 10.6542 | 90.0007 | 14.3133 | 6.6087 | 90.0007 |
| 15.6518 | 10.3158 | 90.0007 | 14.5120 | 6.3087 | 90.0007 |
| 15.8764 | 9.9733 | 90.0007 | 14.7079 | 6.0086 | 90.0007 |
| 16.0970 | 9.6281 | 90.0007 | 14.9024 | 5.7059 | 90.0007 |
| 16.3134 | 9.2787 | 90.0007 | 15.0956 | 5.4017 | 90.0007 |
| 16.5272 | 8.9266 | 90.0007 | 15.2860 | 5.0976 | 90.0007 |
| 16.7368 | 8.5732 | 90.0007 | 15.4750 | 4.7907 | 90.0007 |
| 16.9436 | 8.2170 | 90.0007 | 15.6641 | 4.4839 | 90.0007 |
| 17.1477 | 7.8594 | 90.0007 | 15.8504 | 4.1770 | 90.0007 |
| 17.3491 | 7.5005 | 90.0007 | 16.0367 | 3.8688 | 90.0007 |
| 17.5478 | 7.1402 | 90.0007 | 16.2217 | 3.5591 | 90.0007 |
| 17.7451 | 6.7799 | 90.0007 | 16.4066 | 3.2495 | 90.0007 |
| 17.9410 | 6.4169 | 90.0007 | 16.5888 | 2.9399 | 90.0007 |
| 18.1355 | 6.0538 | 90.0007 | 16.7724 | 2.6289 | 90.0007 |
| 18.3273 | 5.6894 | 90.0007 | 16.9532 | 2.3180 | 90.0007 |
| 18.5177 | 5.3250 | 90.0007 | 17.1341 | 2.0070 | 90.0007 |
| 18.7068 | 4.9592 | 90.0007 | 17.3149 | 1.6946 | 90.0007 |
| 18.8944 | 4.5935 | 90.0007 | 17.4943 | 1.3823 | 90.0007 |
| 19.0808 | 4.2263 | 90.0007 | 17.6724 | 1.0699 | 90.0007 |
| 19.2643 | 3.8592 | 90.0007 | 17.8505 | 0.7562 | 90.0007 |
| 19.4479 | 3.4907 | 90.0007 | 18.0286 | 0.4425 | 90.0007 |
| 19.6301 | 3.1221 | 90.0007 | 18.2054 | 0.1288 | 90.0007 |
| 19.8096 | 2.7536 | 90.0007 | 18.3821 | −0.1849 | 90.0007 |
| 19.9890 | 2.3837 | 90.0007 | 18.5588 | −0.4987 | 90.0007 |
| 20.1658 | 2.0125 | 90.0007 | 18.7342 | −0.8138 | 90.0007 |
| 20.3425 | 1.6412 | 90.0007 | 18.9095 | −1.1275 | 90.0007 |
| 20.5178 | 1.2699 | 90.0007 | 19.0849 | −1.4426 | 90.0007 |
| 20.6918 | 0.8973 | 90.0007 | 19.2602 | −1.7577 | 90.0007 |
| 20.8658 | 0.5247 | 90.0007 | 19.4356 | −2.0727 | 90.0007 |
| 21.0384 | 0.1507 | 90.0007 | 19.6096 | −2.3878 | 90.0007 |
| 21.2097 | −0.2233 | 90.0007 | 19.7849 | −2.7029 | 90.0007 |
| 21.3795 | −0.5973 | 90.0007 | 19.9589 | −3.0180 | 90.0007 |
| 21.5494 | −0.9727 | 90.0007 | 20.1329 | −3.3331 | 90.0007 |
| 21.7179 | −1.3480 | 90.0007 | 20.3082 | −3.6482 | 90.0007 |
| 21.8851 | −1.7234 | 90.0007 | 20.4822 | −3.9647 | 90.0007 |
| 22.0508 | −2.1001 | 90.0007 | 20.6562 | −4.2797 | 90.0007 |
| 22.2152 | −2.4769 | 90.0007 | 20.8288 | −4.5962 | 90.0007 |
| 22.3796 | −2.8550 | 90.0007 | 21.0028 | −4.9113 | 90.0007 |
| 22.5426 | −3.2331 | 90.0007 | 21.1768 | −5.2278 | 90.0007 |
| 22.7043 | −3.6112 | 90.0007 | 21.3494 | −5.5428 | 90.0007 |
| 22.8646 | −3.9893 | 90.0007 | 21.5220 | −5.8593 | 90.0007 |
| 23.0235 | −4.3688 | 90.0007 | 21.6946 | −6.1758 | 90.0007 |
| 23.1824 | −4.7483 | 90.0007 | 21.8659 | −6.4922 | 90.0007 |
| 23.3400 | −5.1277 | 90.0007 | 22.0371 | −6.8087 | 90.0007 |
| 23.4975 | −5.5086 | 90.0007 | 22.2084 | −7.1251 | 90.0007 |
| 23.6537 | −5.8881 | 90.0007 | 22.3796 | −7.4430 | 90.0007 |
| 23.8098 | −6.2703 | 90.0007 | 22.5495 | −7.7608 | 90.0007 |
| 23.9660 | −6.6511 | 90.0007 | 22.7194 | −8.0773 | 90.0007 |
| 24.1208 | −7.0334 | 90.0007 | 22.8892 | −8.3965 | 90.0007 |

TABLE I-continued

| SUCTION SIDE | | | PRESSURE SIDE | | |
|---|---|---|---|---|---|
| X (%) | Y (%) | Z (%) | X (%) | Y (%) | Z (%) |
| 24.2756 | −7.4156 | 90.0007 | 23.0577 | −8.7143 | 90.0007 |
| 24.4304 | −7.7978 | 90.0007 | 23.2262 | −9.0335 | 90.0007 |
| 24.5839 | −8.1800 | 90.0007 | 23.3934 | −9.3527 | 90.0007 |
| 24.7359 | −8.5622 | 90.0007 | 23.5605 | −9.6719 | 90.0007 |
| 24.8866 | −8.9444 | 90.0007 | 23.7263 | −9.9925 | 90.0007 |
| 25.0360 | −9.3267 | 90.0007 | 23.8907 | −10.3130 | 90.0007 |
| 25.1853 | −9.7103 | 90.0007 | 24.0537 | −10.6336 | 90.0007 |
| 25.3319 | −10.0925 | 90.0007 | 24.2154 | −10.9555 | 90.0007 |
| 25.4798 | −10.4761 | 90.0007 | 24.3743 | −11.2789 | 90.0007 |
| 25.6278 | −10.8596 | 90.0007 | 24.5318 | −11.6022 | 90.0007 |
| 25.7785 | −11.2460 | 90.0007 | 24.6880 | −11.9255 | 90.0007 |
| 25.9292 | −11.6337 | 90.0007 | 24.8496 | −12.2502 | 90.0007 |
| 26.0415 | −12.0269 | 90.0007 | 25.0346 | −12.5584 | 90.0007 |
| 26.0032 | −12.4255 | 90.0007 | 25.3483 | −12.7365 | 90.0007 |
| 25.7059 | −12.7036 | 90.0007 | 25.7059 | −12.7036 | 90.0007 |
| 5.1469 | 14.5558 | 100.0000 | 5.1469 | 14.5558 | 100.0000 |
| 5.1469 | 14.8202 | 100.0000 | 5.2127 | 14.3352 | 100.0000 |
| 5.2168 | 15.0750 | 100.0000 | 5.3346 | 14.1380 | 100.0000 |
| 5.2784 | 15.1915 | 100.0000 | 5.4141 | 14.0544 | 100.0000 |
| 5.3401 | 15.3079 | 100.0000 | 5.4935 | 13.9708 | 100.0000 |
| 5.6018 | 15.6202 | 100.0000 | 5.7853 | 13.7653 | 100.0000 |
| 5.9141 | 15.8874 | 100.0000 | 6.1114 | 13.6256 | 100.0000 |
| 6.2443 | 16.1258 | 100.0000 | 6.4580 | 13.5461 | 100.0000 |
| 6.5936 | 16.3340 | 100.0000 | 6.8142 | 13.5105 | 100.0000 |
| 6.9662 | 16.5039 | 100.0000 | 7.1731 | 13.4996 | 100.0000 |
| 7.3512 | 16.6326 | 100.0000 | 7.5348 | 13.4968 | 100.0000 |
| 7.7471 | 16.7148 | 100.0000 | 7.8937 | 13.4886 | 100.0000 |
| 8.1512 | 16.7518 | 100.0000 | 8.2526 | 13.4626 | 100.0000 |
| 8.5581 | 16.7464 | 100.0000 | 8.6061 | 13.4132 | 100.0000 |
| 8.9623 | 16.7039 | 100.0000 | 8.9568 | 13.3324 | 100.0000 |
| 9.3609 | 16.6244 | 100.0000 | 9.3034 | 13.2187 | 100.0000 |
| 9.7514 | 16.5107 | 100.0000 | 9.6418 | 13.0735 | 100.0000 |
| 10.1322 | 16.3655 | 100.0000 | 9.9664 | 12.9023 | 100.0000 |
| 10.4993 | 16.1929 | 100.0000 | 10.2760 | 12.7091 | 100.0000 |
| 10.8528 | 15.9970 | 100.0000 | 10.5692 | 12.4954 | 100.0000 |
| 11.1939 | 15.7792 | 100.0000 | 10.8514 | 12.2625 | 100.0000 |
| 11.5254 | 15.5435 | 100.0000 | 11.1213 | 12.0159 | 100.0000 |
| 11.8446 | 15.2915 | 100.0000 | 11.3802 | 11.7556 | 100.0000 |
| 12.1543 | 15.0284 | 100.0000 | 11.6282 | 11.4843 | 100.0000 |
| 12.4529 | 14.7517 | 100.0000 | 11.8652 | 11.2062 | 100.0000 |
| 12.7406 | 14.4654 | 100.0000 | 12.0926 | 10.9227 | 100.0000 |
| 13.0201 | 14.1695 | 100.0000 | 12.3132 | 10.6350 | 100.0000 |
| 13.2900 | 13.8653 | 100.0000 | 12.5269 | 10.3432 | 100.0000 |
| 13.5502 | 13.5544 | 100.0000 | 12.7365 | 10.0473 | 100.0000 |
| 13.8023 | 13.2365 | 100.0000 | 12.9406 | 9.7486 | 100.0000 |
| 14.0475 | 12.9146 | 100.0000 | 13.1406 | 9.4472 | 100.0000 |
| 14.2845 | 12.5885 | 100.0000 | 13.3365 | 9.1431 | 100.0000 |
| 14.5147 | 12.2584 | 100.0000 | 13.5283 | 8.8376 | 100.0000 |
| 14.7407 | 11.9241 | 100.0000 | 13.7174 | 8.5280 | 100.0000 |
| 14.9613 | 11.5857 | 100.0000 | 13.9037 | 8.2184 | 100.0000 |
| 15.1764 | 11.2446 | 100.0000 | 14.0873 | 7.9060 | 100.0000 |
| 15.3874 | 10.9007 | 100.0000 | 14.2681 | 7.5923 | 100.0000 |
| 15.5956 | 10.5541 | 100.0000 | 14.4462 | 7.2758 | 100.0000 |
| 15.7983 | 10.2062 | 100.0000 | 14.6229 | 6.9594 | 100.0000 |
| 15.9984 | 9.8541 | 100.0000 | 14.7983 | 6.6416 | 100.0000 |
| 16.1956 | 9.5020 | 100.0000 | 14.9723 | 6.3237 | 100.0000 |
| 16.3902 | 9.1472 | 100.0000 | 15.1449 | 6.0045 | 100.0000 |
| 16.5820 | 8.7910 | 100.0000 | 15.3161 | 5.6840 | 100.0000 |
| 16.7724 | 8.4335 | 100.0000 | 15.4860 | 5.3634 | 100.0000 |
| 16.9601 | 8.0745 | 100.0000 | 15.6545 | 5.0414 | 100.0000 |
| 17.1450 | 7.7156 | 100.0000 | 15.8230 | 4.7209 | 100.0000 |
| 17.3286 | 7.3553 | 100.0000 | 15.9901 | 4.3976 | 100.0000 |
| 17.5108 | 6.9936 | 100.0000 | 16.1573 | 4.0756 | 100.0000 |
| 17.6916 | 6.6320 | 100.0000 | 16.3230 | 3.7523 | 100.0000 |
| 17.8725 | 6.2703 | 100.0000 | 16.4888 | 3.4290 | 100.0000 |
| 18.0506 | 5.9073 | 100.0000 | 16.6546 | 3.1057 | 100.0000 |
| 18.2273 | 5.5428 | 100.0000 | 16.8190 | 2.7824 | 100.0000 |
| 18.4026 | 5.1784 | 100.0000 | 16.9834 | 2.4591 | 100.0000 |
| 18.5766 | 4.8140 | 100.0000 | 17.1477 | 2.1344 | 100.0000 |
| 18.7492 | 4.4496 | 100.0000 | 17.3108 | 1.8097 | 100.0000 |
| 18.9218 | 4.0838 | 100.0000 | 17.4752 | 1.4864 | 100.0000 |
| 19.0917 | 3.7181 | 100.0000 | 17.6382 | 1.1617 | 100.0000 |
| 19.2602 | 3.3509 | 100.0000 | 17.8012 | 0.8370 | 100.0000 |
| 19.4287 | 2.9838 | 100.0000 | 17.9642 | 0.5124 | 100.0000 |
| 19.5959 | 2.6152 | 100.0000 | 18.1273 | 0.1877 | 100.0000 |
| 19.7616 | 2.2481 | 100.0000 | 18.2903 | −0.1370 | 100.0000 |

TABLE I-continued

| SUCTION SIDE | | | PRESSURE SIDE | | |
|---|---|---|---|---|---|
| X (%) | Y (%) | Z (%) | X (%) | Y (%) | Z (%) |
| 19.9260 | 1.8782 | 100.0000 | 18.4519 | −0.4617 | 100.0000 |
| 20.0890 | 1.5097 | 100.0000 | 18.6150 | −0.7864 | 100.0000 |
| 20.2521 | 1.1398 | 100.0000 | 18.7780 | −1.1110 | 100.0000 |
| 20.4137 | 0.7699 | 100.0000 | 18.9410 | −1.4357 | 100.0000 |
| 20.5754 | 0.3987 | 100.0000 | 19.1027 | −1.7604 | 100.0000 |
| 20.7357 | 0.0274 | 100.0000 | 19.2657 | −2.0851 | 100.0000 |
| 20.8946 | −0.3439 | 100.0000 | 19.4287 | −2.4098 | 100.0000 |
| 21.0535 | −0.7165 | 100.0000 | 19.5918 | −2.7344 | 100.0000 |
| 21.2110 | −1.0891 | 100.0000 | 19.7548 | −3.0591 | 100.0000 |
| 21.3672 | −1.4617 | 100.0000 | 19.9178 | −3.3838 | 100.0000 |
| 21.5234 | −1.8344 | 100.0000 | 20.0808 | −3.7071 | 100.0000 |
| 21.6782 | −2.2070 | 100.0000 | 20.2439 | −4.0318 | 100.0000 |
| 21.8316 | −2.5810 | 100.0000 | 20.4069 | −4.3565 | 100.0000 |
| 21.9851 | −2.9550 | 100.0000 | 20.5713 | −4.6798 | 100.0000 |
| 22.1371 | −3.3290 | 100.0000 | 20.7343 | −5.0045 | 100.0000 |
| 22.2878 | −3.7044 | 100.0000 | 20.8973 | −5.3291 | 100.0000 |
| 22.4385 | −4.0784 | 100.0000 | 21.0603 | −5.6538 | 100.0000 |
| 22.5892 | −4.4537 | 100.0000 | 21.2247 | −5.9771 | 100.0000 |
| 22.7385 | −4.8291 | 100.0000 | 21.3878 | −6.3018 | 100.0000 |
| 22.8879 | −5.2058 | 100.0000 | 21.5508 | −6.6265 | 100.0000 |
| 23.0358 | −5.5812 | 100.0000 | 21.7138 | −6.9512 | 100.0000 |
| 23.1838 | −5.9579 | 100.0000 | 21.8782 | −7.2758 | 100.0000 |
| 23.3317 | −6.3361 | 100.0000 | 22.0399 | −7.6005 | 100.0000 |
| 23.4783 | −6.7128 | 100.0000 | 22.2029 | −7.9252 | 100.0000 |
| 23.6249 | −7.0909 | 100.0000 | 22.3645 | −8.2499 | 100.0000 |
| 23.7715 | −7.4690 | 100.0000 | 22.5276 | −8.5759 | 100.0000 |
| 23.9153 | −7.8471 | 100.0000 | 22.6879 | −8.9006 | 100.0000 |
| 24.0592 | −8.2252 | 100.0000 | 22.8495 | −9.2267 | 100.0000 |
| 24.2017 | −8.6033 | 100.0000 | 23.0084 | −9.5527 | 100.0000 |
| 24.3428 | −8.9814 | 100.0000 | 23.1673 | −9.8788 | 100.0000 |
| 24.4811 | −9.3595 | 100.0000 | 23.3263 | −10.2062 | 100.0000 |
| 24.6209 | −9.7377 | 100.0000 | 23.4824 | −10.5322 | 100.0000 |
| 24.7592 | −10.1158 | 100.0000 | 23.6386 | −10.8596 | 100.0000 |
| 24.9003 | −10.4952 | 100.0000 | 23.7948 | −11.1884 | 100.0000 |
| 25.0456 | −10.8761 | 100.0000 | 23.9496 | −11.5172 | 100.0000 |
| 25.1894 | −11.2583 | 100.0000 | 24.1058 | −11.8474 | 100.0000 |
| 25.2935 | −11.6460 | 100.0000 | 24.2866 | −12.1570 | 100.0000 |
| 25.2469 | −12.0364 | 100.0000 | 24.5976 | −12.3337 | 100.0000 |
| 24.9497 | −12.3050 | 100.0000 | 24.9497 | −12.3050 | 100.0000 |

It will also be appreciated that the airfoil 52 disclosed in the above Table I may be scaled up or down geometrically for use in other similar turbine designs. Consequently, the coordinate values set forth in Table I may be scaled upwardly or downwardly such that the airfoil profile shape remains unchanged. A scaled version of the coordinates in Table I would be represented by X, Y, and Z coordinate values of Table I, with the X, Y, and Z non-dimensional coordinate values converted to inches, multiplied or divided by a constant number.

An important term in this disclosure is "profile". The profile is the range of the variation between measured points on an airfoil surface and the ideal position listed in Table I. The actual profile on a manufactured turbine rotor blade will be different than those in Table I and the design is robust to this variation meaning that mechanical and aerodynamic function are not impaired. As noted above, a +or −5% profile tolerance is used herein. The X, Y, and Z values are all non-dimensionalized relative to the airfoil height.

The disclosed airfoil shape optimizes and is specific to machine conditions and specifications. It provides a unique profile to achieve: 1) interaction between other stages in the turbine 10; 2) aerodynamic efficiency; and 3) normalized aerodynamic and mechanical rotor blade or airfoil loadings. The disclosed locus of points defined in Table I allows the gas turbine 12 or any other suitable turbine to run in an efficient, safe and smooth manner. As also noted, any scale of the disclosed airfoil 52 may be adopted as long as 1) interaction between other stages in the pressure turbine 10; 2) aerodynamic efficiency; and 3) normalized aerodynamic and mechanical blade loadings are maintained in the scaled turbine. The airfoil 52 described herein thus improves overall gas turbine 12 efficiency. Specifically, the airfoil 52 provides a desired turbine efficiency lapse rate (ISO, hot, cold, part load, etc.). The airfoil 52 also meets all aeromechanics and stress requirements. The turbine rotor blade 50 described herein has very specific aerodynamic design requirements. Significant cross-functional design effort was required to meet these design goals. The airfoil 52 of the rotor blade 50, thus, is of a specific shape to meet aerodynamic, mechanical, and heat transfer requirements in an efficient and cost-effective manner.

Further, it should be understood that exemplary embodiments of the present disclosure may include the entirety of the nominal airfoil profile set forth in Table I or portions thereof. Such portions may include a portion of the pressure side (or "pressure side portion"), a portion of the suction side (or "suction side portion"), and portions of both the pressure side and suction side.

Thus, exemplary embodiments of the present disclosure include a turbine rotor blade having an airfoil that includes a pressure side portion of a nominal airfoil profile substantially in accordance with Cartesian coordinate values of X, Y, and Z of a pressure side as set forth in Table I. The Cartesian coordinate values of X, Y, and Z are non-dimensional values from 0% to 100% convertible to dimensional distances by multiplying the Cartesian coordinate values of X, Y, and Z by a height of the airfoil defined along the Z axis. The X and Y values of the pressure side are coordinate values that, when connected by smooth continuing arcs, define pressure side sections of the pressure side portion of the nominal airfoil profile at each Z coordinate value. The pressure side sections may be joined smoothly with one another to form the pressure side portion.

Exemplary embodiments of the present disclosure also include a turbine rotor blade having an airfoil that includes a suction side portion of a nominal airfoil profile substantially in accordance with Cartesian coordinate values of X, Y, and Z of a suction side as set forth in Table I. The Cartesian coordinate values of X, Y, and Z are non-dimensional values from 0% to 100% convertible to dimensional distances by multiplying the Cartesian coordinate values of X, Y, and Z by a height of the airfoil defined along the Z axis. The X and Y values of the suction side are coordinate values that, when connected by smooth continuing arcs, define suction side sections of the suction side portion of the nominal airfoil profile at each Z coordinate value. The suction side sections may be joined smoothly with one another to form the suction side portion.

Exemplary embodiment of the present disclosure also include a turbine engine that has an airfoil, wherein the airfoil includes: a pressure side portion of a nominal airfoil profile substantially in accordance with Cartesian coordinate values of X, Y, and Z of a pressure side as set forth in Table I; and a suction side portion of the nominal airfoil profile substantially in accordance with Cartesian coordinate values of X, Y, and Z of the suction side as set forth in Table I. The Cartesian coordinate values of X, Y, and Z are non-dimensional values from 0% to 100% convertible to dimensional distances by multiplying the Cartesian coordinate values of X, Y, and Z by a height of the airfoil defined along the Z axis. The X and Y values of the pressure side are coordinate values that, when connected by smooth continuing arcs, define pressure side sections of the pressure side portion of the nominal airfoil profile at each Z coordinate value. The pressure side sections may be joined smoothly with one another to form the pressure side portion. The X and Y values of the suction side are coordinate values that, when connected by smooth continuing arcs, define suction side sections of the suction side portion of the nominal airfoil profile at each Z coordinate value. The suction side sections may be joined smoothly with one another to form the suction side portion.

A height of each of the suction side portion and pressure side portion may be defined along the Z axis. The height of each of the suction side portion and pressure side portion may be less than or equal to the height of the airfoil. According to exemplary embodiments, the height of the suction side portion and the height of the pressure side portion may be substantially the same. According to exemplary embodiments, the suction side portion and the pressure side portion may each start at a common distance relative to a base of the airfoil and extend toward a tip of the airfoil. According to exemplary embodiments, the height of the suction side portion and/or the height of the pressure side portion may each be equal to or greater than 50% of the height of the airfoil. According to other embodiments, the height of the suction side portion and/or the height of the pressure side portion may each be equal to or greater than 75% of the height of the airfoil. According to other embodiments, the height of the suction side portion and the height of the pressure side portion may each be equal to 100% of the height of the airfoil.

As already described, the turbine engine may include a combustion or gas turbine that has a compressor, combustor, and turbine. The airfoil of the present disclosure may be configured as the airfoil of a turbine rotor blade, i.e., a rotor blade within the turbine of the gas turbine. More specifically, the airfoil of the present disclosure may be the airfoil of a turbine rotor blade that is configured to function as a second stage rotor blade in the turbine. In such cases, the turbine includes a second stage that has a row of circumferentially spaced nozzles and a row of circumferentially spaced rotor blades, with the airfoil of the present disclosure being configured as the airfoil of each of the rotor blades within the second stage row of rotor blades.

Along with the airfoil, the shape or contour of the platform impacts aerodynamic characteristics and losses of the rotor blade and must satisfy system requirements of aerodynamic and mechanical blade loading and efficiency. The aerodynamic characteristics and losses associated with the platform, separately, as well as the manner in which the platform functions in tandem with the airfoil and/or fillets, may significantly affect performance, thrust, efficiency, and power. Embodiments of the present disclosure include one or more platform contours, which may be coupled with the airfoil shape disclosed above or used separately. As provided below, to define the contour of the platform there is a unique set or locus of points in space that meets the stage requirements and that can be manufactured. This unique locus of points satisfies the requirements for stage efficiency and, as will be appreciated, are arrived at by iteration between aerodynamic and mechanical loadings and enable the turbine to run in an efficient, safe and smooth manner. These points are unique and specific to the system.

Figure 3:
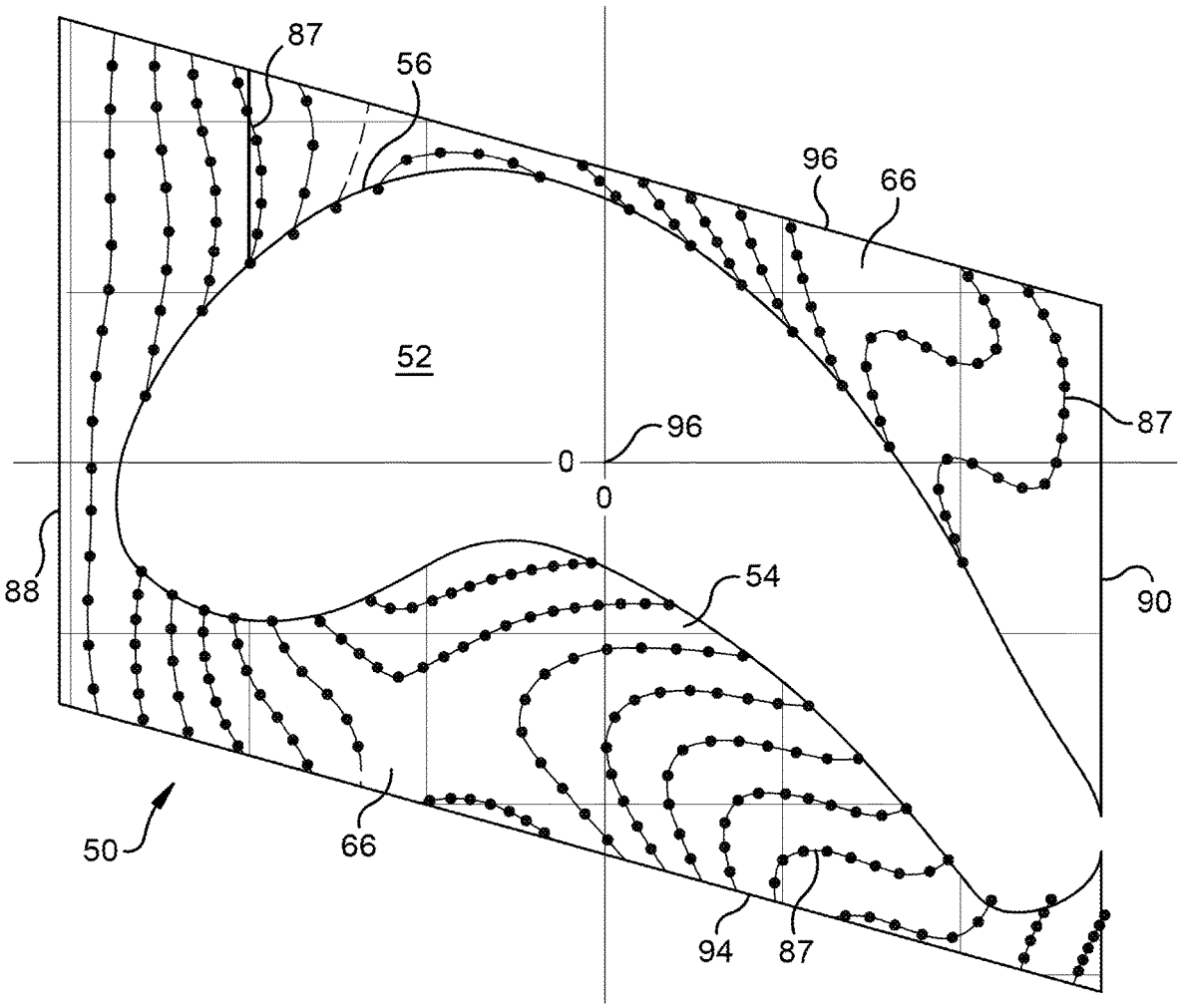
FIG. 3 is a top view showing surface contour of a platform at the base of a turbine rotor blade according to at least one embodiment of the present disclosure.

Turning now to FIG. 3, a top view is provided of an endwall or platform 66, which is the surface from which the airfoil 52 of the rotor blade 50 extends. In accordance with an alternative embodiment of the present disclosure, a locus of points—each of which are represented as points on the illustrated contour lines of FIG. 3—defines a specific contour of a platform of a turbine rotor blade. These points are set forth in a set of points with X', Y', and Z' dimensions relative to a reference origin coordinate system, as provided in Table II and shown in FIG. 3, respectively. Embodiments of the present disclosure, thus, include a rotor blade having a non-axisymmetric platform contour that enhances performance, efficiency and/or durability of the rotor blade when compared with conventional designs.

More specifically, the Cartesian coordinate system of X', Y', and Z' values given in Table II below defines a surface shape or contour of the platform 66 of the turbine rotor blade 50 at various locations or points defined along contour lines 87. The contour lines 87 extend along the surface or surface area (also "total surface area") of the platform 66, which is defined between an outer periphery or edges of the platform 66—which, as indicated, may be referred to as a leading edge 88, trailing edge 90, pressure edge 94, and suction edge 96—and a base of the airfoil 52 (i.e., the location at which the platform 66 terminates into the airfoil 52 and/or the fillet 72 of airfoil 52). As shown in FIG. 3, the point data origin 96 is defined at a position within the footprint of the airfoil 52, for example, a point near a central portion of the footprint of the airfoil 52. The point data origin 96 corresponds to the non-dimensional Z' value of Table II (presented below) at Z' equals 0.

The coordinate values for the X', Y', and Z' coordinates are set forth in non-dimensionalized units in Table II, although units of dimensions may be used when the values are appropriately converted. That is, the X', Y', and Z' values set forth in Table II are expressed in non-dimensional form (X', Y', and Z') from 0% to 100%, which may be converted by multiplying each by the radial span 70 (as shown in FIG. 2) or height of the airfoil. As one example, the Cartesian coordinate values of X', Y', and Z' may be convertible to dimensional distances by multiplying the X', Y', and Z' values by a height of the airfoil at the leading edge 58 and/or multiplying by a constant number. As another example, the Cartesian coordinate values of X', Y', and Z' may be convertible to dimensional distances by multiplying the X', Y', and Z' values by a height of the airfoil at the trailing edge 60 and/or multiplying by a constant number. Thus, to convert the Z' value to a Z' coordinate value of the platform contour, for example, in inches, the non-dimensional Z' value given in Table II is multiplied by the height of the airfoil in inches.

As described above, the Cartesian coordinate system has orthogonally-related X', Y', and Z' axes, where the X' axis lies generally parallel to a centerline of the rotor shaft 14, i.e., the rotary axis and a positive X' coordinate value is axial toward an aft, i.e., exhaust end, of the turbine 10. The positive Y' coordinate value extends tangentially in the direction of rotation of the rotor, and the positive Z' coordinate value extends radially outwardly toward the radial tip 68 of the airfoil 52. All the values in Table II are given at room temperature.

By defining X' and Y' coordinate values at selected locations in a Z' direction normal to the X', Y' plane, the contour of the platform is shown via several contour lines, each of which having multiple points spaced at regular intervals. By connecting the X' and Y' values of each of the contour lines with smooth continuing arcs, each contour line at each distance Z' can be determined. The overall contour of the platform of the various surface locations can then be determined by smoothly connecting the adjacent contour lines to one another to form the platform.

The Table II values are generated and shown to four decimal places for determining the contour of the platform. As the turbine rotor blade heats up during operation of the gas turbine, mechanical stresses and elevated temperatures will cause a change in the X', Y', and Z' values. Accordingly, it should be understood that the values for the nominal platform contour given in Table II represent ambient, non-operating or non-hot conditions (e.g., room temperature) and are for an uncoated platform. Further, there are typical manufacturing tolerances as well as coatings which may be accounted for in the actual shape or contour of the platform 66. It will therefore be appreciated that +/− typical manufacturing tolerances, i.e., +/−values, including any coating thicknesses, may be additive to the X', Y' and/or Z' values given in Table II below. Accordingly, a distance of +/−5% in a direction normal to any platform surface location or about +/−5% of the length of the chord 62 in a direction nominal to any platform surface location may define a platform contour envelope for this particular platform design, i.e., a range of variation between measured points on the actual platform surface at nominal cold or room temperature and the ideal position of those points as given in Table II below at the same temperature. According to another example, a tolerance of about 10-20% of a thickness of the airfoil's trailing edge 60 in a direction normal to any platform surface location may define a range of variation between measured points on an actual platform surface and ideal positions as embodied by the invention in Table II. As should further be understood, the data provided in Table II is scalable and the geometry pertains to all aerodynamic scales and/or RPM ranges. The design of the platform 66 for the turbine rotor blade 50 is robust to this range of variation without impairment of mechanical and aerodynamic functions.

TABLE II

| X' (%) | Y' (%) | Z' (%) |
|---|---|---|
| 7.10323 | −4.29481 | −3.30160 |
| 7.90465 | −4.22084 | −3.30160 |
| 6.39633 | −3.90438 | −3.30160 |
| 8.65676 | −3.90301 | −3.30160 |
| 9.41434 | −3.60299 | −3.30160 |
| 10.18289 | −3.33037 | −3.30160 |
| 10.96239 | −3.08788 | −3.30160 |
| 11.75149 | −2.88376 | −3.30160 |
| 12.55017 | −2.71799 | −3.30160 |
| 13.35708 | −2.59470 | −3.30160 |
| 14.16809 | −2.50976 | −3.30160 |
| 14.98185 | −2.46044 | −3.30160 |
| 13.17077 | −12.99815 | −3.93178 |
| 12.48853 | −12.57209 | −3.93178 |
| 11.77067 | −12.20906 | −3.93178 |
| 11.01582 | −11.92958 | −3.93178 |
| 8.63210 | −11.81314 | −3.93178 |
| 10.23084 | −11.75560 | −3.93178 |
| 9.42941 | −11.71039 | −3.93178 |
| 7.53887 | −6.85663 | −3.93178 |
| 6.70457 | −6.57168 | −3.93178 |
| 8.35811 | −6.48538 | −3.93178 |
| 9.14446 | −6.03329 | −3.93178 |
| 5.99630 | −6.00452 | −3.93178 |
| 9.94452 | −5.60312 | −3.93178 |
| 5.27707 | −5.45243 | −3.93178 |
| 10.76238 | −5.20995 | −3.93178 |
| 11.60079 | −4.86335 | −3.93178 |
| 4.61264 | −4.83595 | −3.93178 |
| 12.45976 | −4.57292 | −3.93178 |
| 13.33790 | −4.34413 | −3.93178 |
| 14.23111 | −4.18385 | −3.93178 |
| 17.85328 | −4.13179 | −3.93178 |
| 15.13391 | −4.08932 | −3.93178 |
| 16.94774 | −4.07562 | −3.93178 |
| 16.04082 | −4.05781 | −3.93178 |
| 6.88266 | 12.43236 | −3.93178 |
| 12.96527 | 12.62552 | −3.93178 |
| 11.75286 | 13.18446 | −3.93178 |
| 7.82245 | 13.35708 | −3.93178 |
| 10.46373 | 13.52832 | −3.93178 |
| 9.13076 | 13.60093 | −3.93178 |

TABLE II-continued

| X' (%) | Y' (%) | Z' (%) |
|---|---|---|
| 15.64765 | −13.37078 | −4.56196 |
| 14.78046 | −12.35427 | −4.56196 |
| 13.89410 | −11.35420 | −4.56196 |
| 6.00589 | −11.00760 | −4.56196 |
| 13.02281 | −10.34043 | −4.56196 |
| 5.95246 | −9.78834 | −4.56196 |
| 12.30221 | −9.22118 | −4.56196 |
| 5.51682 | −8.64991 | −4.56196 |
| 12.24604 | −7.91972 | −4.56196 |
| 4.75786 | −7.69094 | −4.56196 |
| 13.05432 | −6.87581 | −4.56196 |
| 3.88657 | −6.82923 | −4.56196 |
| 14.20645 | −6.20864 | −4.56196 |
| 20.80142 | −6.06480 | −4.56196 |
| 3.09473 | −5.89629 | −4.56196 |
| 19.47668 | −5.88670 | −4.56196 |
| 15.48736 | −5.83465 | −4.56196 |
| 18.14919 | −5.74012 | −4.56196 |
| 16.81485 | −5.69902 | −4.56196 |
| 2.55360 | −4.80307 | −4.56196 |
| 16.38057 | 11.37886 | −4.56196 |
| 5.13734 | 11.63230 | −4.56196 |
| 15.76409 | 12.04329 | −4.56196 |
| 15.12843 | 12.68991 | −4.56196 |
| 5.60038 | 12.83924 | −4.56196 |
| 14.47222 | 13.31598 | −4.56196 |
| 6.00452 | 14.06809 | −4.56196 |
| 6.25522 | 15.33393 | −4.56196 |
| 17.41900 | −13.82971 | −5.19214 |
| 16.83129 | −12.85978 | −5.19214 |
| 16.27372 | −11.87479 | −5.19214 |
| 15.79012 | −10.85006 | −5.19214 |
| 3.99479 | −10.52264 | −5.19214 |
| 15.50106 | −9.75820 | −5.19214 |
| 3.49476 | −9.52531 | −5.19214 |
| 15.69012 | −8.65813 | −5.19214 |
| 2.82211 | −8.63210 | −5.19214 |
| 23.17556 | −8.08686 | −5.19214 |
| 22.05494 | −7.92383 | −5.19214 |
| 16.49291 | −7.87999 | −5.19214 |
| 2.13850 | −7.74711 | −5.19214 |
| 20.94116 | −7.71423 | −5.19214 |
| 19.82191 | −7.53750 | −5.19214 |
| 17.56285 | −7.52654 | −5.19214 |
| 18.69306 | −7.44983 | −5.19214 |
| 1.58915 | −6.77307 | −5.19214 |
| 1.23981 | −5.71272 | −5.19214 |
| 1.09323 | −4.60442 | −5.19214 |
| 18.62319 | 10.09932 | −5.19214 |
| 3.47284 | 10.68840 | −5.19214 |
| 18.03000 | 10.94596 | −5.19214 |
| 17.43270 | 11.78848 | −5.19214 |
| 3.93452 | 12.42962 | −5.19214 |
| 16.83540 | 12.62963 | −5.19214 |
| 4.12905 | 14.21741 | −5.19214 |
| 3.75916 | 15.96959 | −5.19214 |
| 18.93280 | −14.25303 | −5.82232 |
| 18.46565 | −13.19679 | −5.82232 |
| 18.09713 | −12.10220 | −5.82232 |
| 17.96150 | −10.95965 | −5.82232 |
| 25.10994 | −10.14179 | −5.82232 |
| 23.96329 | −10.01849 | −5.82232 |
| 18.39441 | −9.91712 | −5.82232 |
| 1.29872 | −9.83218 | −5.82232 |
| 22.83581 | −9.76505 | −5.82232 |
| 21.70834 | −9.51435 | −5.82232 |
| 19.41503 | −9.41297 | −5.82232 |
| 20.56579 | −9.35818 | −5.82232 |
| 0.83019 | −8.97733 | −5.82232 |
| 0.43017 | −8.08960 | −5.82232 |
| 0.12193 | −7.16487 | −5.82232 |
| −0.08220 | −6.21275 | −5.82232 |
| −0.17398 | −5.24282 | −5.82232 |
| −0.14659 | −4.27016 | −5.82232 |
| 20.64251 | 8.60607 | −5.82232 |
| 1.77957 | 9.45544 | −5.82232 |
| 20.14522 | 9.45681 | −5.82232 |
| 19.65340 | 10.31030 | −5.82232 |

TABLE II-continued

| X' (%) | Y' (%) | Z' (%) |
|---|---|---|
| 2.02480 | 10.66100 | −5.82232 |
| 19.17392 | 11.17200 | −5.82232 |
| 2.16727 | 11.88301 | −5.82232 |
| 18.71772 | 12.04466 | −5.82232 |
| 2.13302 | 13.11186 | −5.82232 |
| 1.87958 | 14.31468 | −5.82232 |
| 1.47544 | 15.47640 | −5.82232 |
| 1.07131 | 16.63950 | −5.82232 |
| 20.41921 | −14.68868 | −6.45250 |
| 20.17672 | −13.74889 | −6.45250 |
| 20.10960 | −12.78444 | −6.45250 |
| 26.04288 | −12.26522 | −6.45250 |
| 27.00322 | −12.17070 | −6.45250 |
| 25.08939 | −12.09672 | −6.45250 |
| 20.45483 | −11.89534 | −6.45250 |
| 24.15371 | −11.84054 | −6.45250 |
| 23.21529 | −11.59120 | −6.45250 |
| 21.29461 | −11.44736 | −6.45250 |
| 22.26043 | −11.42270 | −6.45250 |
| −0.73978 | −9.21433 | −6.45250 |
| −1.13158 | −7.87999 | −6.45250 |
| −1.39188 | −6.51277 | −6.45250 |
| −1.48503 | −5.12501 | −6.45250 |
| −1.37544 | −3.73861 | −6.45250 |
| 22.60977 | 6.78540 | −6.45250 |
| −0.10001 | 7.66354 | −6.45250 |
| 22.06179 | 7.91013 | −6.45250 |
| 0.13015 | 8.82800 | −6.45250 |
| 21.53709 | 9.04583 | −6.45250 |
| 0.28358 | 10.00479 | −6.45250 |
| 21.05350 | 10.20070 | −6.45250 |
| 0.32057 | 11.18981 | −6.45250 |
| 20.67813 | 11.39256 | −6.45250 |
| 0.23015 | 12.37345 | −6.45250 |
| 0.03699 | 13.54339 | −6.45250 |
| −0.20823 | 14.70512 | −6.45250 |
| −0.44798 | 15.86684 | −6.45250 |
| −0.62881 | 17.03952 | −6.45250 |
| 22.07685 | −15.20515 | −7.08268 |
| 27.82245 | −14.52154 | −7.08268 |
| 26.84567 | −14.48455 | −7.08268 |
| 22.25906 | −14.24892 | −7.08268 |
| 25.89903 | −14.22015 | −7.08268 |
| 28.69101 | −14.08453 | −7.08268 |
| 24.96061 | −13.92013 | −7.08268 |
| 24.00575 | −13.68724 | −7.08268 |
| 23.02760 | −13.68450 | −7.08268 |
| −2.46866 | −8.68827 | −7.08268 |
| −2.66320 | −7.70601 | −7.08268 |
| −2.79745 | −6.71416 | −7.08268 |
| −2.86595 | −5.71546 | −7.08268 |
| −2.86458 | −4.71539 | −7.08268 |
| −2.78101 | −3.71806 | −7.08268 |
| −2.62484 | −2.72895 | −7.08268 |
| −2.33304 | 4.36057 | −7.08268 |
| 24.53045 | 4.70580 | −7.08268 |
| 24.12083 | 5.70313 | −7.08268 |
| −2.07137 | 5.97438 | −7.08268 |
| 23.73587 | 6.71142 | −7.08268 |
| −1.78779 | 7.58408 | −7.08268 |
| 23.39475 | 7.73478 | −7.08268 |
| 23.15775 | 8.78690 | −7.08268 |
| −1.58641 | 9.20611 | −7.08268 |
| 22.89883 | 9.83218 | −7.08268 |
| −1.53161 | 10.83910 | −7.08268 |
| 22.62210 | 10.87472 | −7.08268 |
| −1.62888 | 12.47072 | −7.08268 |
| −1.82204 | 14.09412 | −7.08268 |
| −2.01932 | 15.71614 | −7.08268 |
| −2.12480 | 17.34776 | −7.08268 |
| 28.73484 | −17.00801 | −7.71286 |
| 27.69779 | −16.84362 | −7.71286 |
| 29.68833 | −16.60525 | −7.71286 |
| 26.70320 | −16.49154 | −7.71286 |
| 25.69628 | −16.17782 | −7.71286 |
| 24.65374 | −16.15727 | −7.71286 |
| 30.33221 | −15.77368 | −7.71286 |
| −4.44688 | −7.55942 | −7.71286 |

TABLE II-continued

| X' (%) | Y' (%) | Z' (%) |
|---|---|---|
| −4.59758 | −5.77848 | −7.71286 |
| −4.63319 | −3.99068 | −7.71286 |
| −4.57292 | −2.20426 | −7.71286 |
| −4.55237 | −0.41784 | −7.71286 |
| −4.56470 | 1.36996 | −7.71286 |
| 26.54154 | 2.17138 | −7.71286 |
| −4.53730 | 3.15775 | −7.71286 |
| 26.18947 | 3.20570 | −7.71286 |
| 25.88396 | 4.25372 | −7.71286 |
| −4.36879 | 4.93595 | −7.71286 |
| 25.68121 | 5.32502 | −7.71286 |
| 29.89246 | 5.37434 | −7.71286 |
| 28.83622 | 5.60723 | −7.71286 |
| 30.68292 | 6.01822 | −7.71286 |
| 27.85670 | 6.08946 | −7.71286 |
| 25.84972 | 6.37989 | −7.71286 |
| 26.85937 | 6.53058 | −7.71286 |
| −4.12083 | 6.70731 | −7.71286 |
| 30.57333 | 7.08953 | −7.71286 |
| 30.07877 | 8.06083 | −7.71286 |
| −3.88931 | 8.47866 | −7.71286 |
| 29.43215 | 8.94034 | −7.71286 |
| −3.76327 | 10.26235 | −7.71286 |
| −3.73724 | 12.04877 | −7.71286 |
| −3.76190 | 13.83656 | −7.71286 |
| −3.77423 | 15.62436 | −7.71286 |
| −3.71258 | 17.41078 | −7.71286 |
| 31.60627 | −18.15467 | −8.34304 |
| 31.86520 | −17.54778 | −8.34304 |
| 32.11864 | −16.93952 | −8.34304 |
| 32.39948 | −16.34359 | −8.34304 |
| 32.70224 | −15.75724 | −8.34304 |
| 29.34174 | −2.46592 | −8.34304 |
| 29.01158 | −1.48366 | −8.34304 |
| 28.72526 | −0.48770 | −8.34304 |
| 28.52387 | 0.52743 | −8.34304 |
| 32.46935 | 0.60963 | −8.34304 |
| 31.46380 | 0.61237 | −8.34304 |
| 30.52538 | 1.04802 | −8.34304 |
| 33.02418 | 1.45763 | −8.34304 |
| 29.60477 | 1.52476 | −8.34304 |
| 28.64306 | 1.53435 | −8.34304 |
| 33.21734 | 2.47414 | −8.34304 |
| 33.29954 | 3.50709 | −8.34304 |
| 33.33516 | 4.54278 | −8.34304 |
| 33.25570 | 5.57298 | −8.34304 |
| 32.92280 | 6.55250 | −8.34304 |
| 32.42962 | 7.46352 | −8.34304 |
| 31.84328 | 8.31838 | −8.34304 |
| 33.69546 | −18.73005 | −8.97322 |
| 33.81601 | −18.25467 | −8.97322 |
| 33.96397 | −17.78615 | −8.97322 |
| 34.18042 | −17.34502 | −8.97322 |
| 34.45167 | −16.93678 | −8.97322 |

It will also be appreciated that the platform contour disclosed in the above Table II may be scaled up or down geometrically for use in other similar turbine designs. Consequently, the coordinate values set forth in Table II may be scaled upwardly or downwardly such that the relative surface shape of the platform remains unchanged. A scaled version of the coordinates in Table II would be represented by X', Y', and Z' coordinate values of Table II, with the X', Y', and Z' non-dimensional coordinate values converted to inches, multiplied or divided by a constant number.

An important term in this disclosure is "profile". The profile is the range of the variation between measured points on an actual platform surface and the ideal position listed in Table II. The actual profile on a manufactured turbine rotor blade will be different than those in Table II and the design is robust to the variation or tolerances described above, meaning that mechanical and aerodynamic function are not impaired.

The disclosed platform contour optimizes and is specific to machine conditions and specifications. In use, it provides a unique surface contour that achieves: 1) aerodynamic efficiency; and 2) normalized aerodynamic and mechanical rotor blade or platform loading. The disclosed locus of points defined in Table II allows the gas turbine 12 or any other suitable turbine to run in an efficient, safe and smooth manner. As also noted, any scale of the disclosed platform contour may be adopted as long as 1) aerodynamic efficiency; and 2) normalized aerodynamic and mechanical rotor blade loadings are maintained in the scaled turbine. The platform 66 described herein thus improves overall gas turbine 12 efficiency. The disclosed platform 66 also meets all aeromechanics and stress requirements. The turbine rotor blade 50 described herein has very specific aerodynamic design requirements. Significant cross-functional design effort was required to meet these design goals. The platform 66 of the rotor blade 50, thus, is of a specific shape to meet aerodynamic, mechanical, and heat transfer requirements in an efficient and cost-effective manner, and, in accordance with alternative embodiments, may be use to advantage in conjunction with the airfoil disclosed above.

Further, it should be understood that exemplary embodiments of the present disclosure may include the entirety of the nominal surface shape or contour set forth in Table II or portions thereof. Such portions may include a portion of the platform 66 adjacent to or near the pressure edge 94, a portion of the platform 66 adjacent to or near the suction edge 96, a portion of the platform 66 adjacent to or near the leading edge 88, and/or a portion of the platform 66 adjacent or near the trailing edge 90. Such portions further may include a portion of the platform 66 defined between the pressure edge 94 and the airfoil 52, a portion of the platform 66 defined between the suction edge 96 and the airfoil.

Thus, embodiments of the present disclosure may include a turbine rotor blade including an airfoil that extends from a platform. The platform may include a first portion of a nominal platform contour substantially in accordance with Cartesian coordinate values of X', Y', and Z' as set forth in Table II. The Cartesian coordinate values of X', Y', and Z' are non-dimensional values from 0% to 100% convertible to dimensional distances by multiplying the Cartesian coordinate values of X', Y', and Z' by a height of the airfoil defined along a Z' axis. The X' and Y' values of the first portion are coordinate values that, when connected by smooth continuing arcs, define contour lines of the first portion of the nominal airfoil profile at each Z' coordinate value. The contour lines may be joined smoothly with one another to form the first portion. As defined above, a total surface area of the platform is defined between an outer periphery of the platform, which is defined by a leading edge, trailing edge, pressure edge, and suction edge of the platform, and a base of the airfoil. In accordance with exemplary embodiments, the surface area of the first portion may be equal to or greater than 50% of the total surface area of the platform. In accordance with other embodiments, the surface area of the first portion may be equal to or greater than 75% of the total surface area of the platform. In accordance with still other embodiments, the surface area of the first portion may be equal to 100% of the total surface area of the platform.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed:

1. A turbine rotor blade comprising:

a platform and an airfoil extending from the platform, wherein the platform comprises a nominal platform contour in accordance with Cartesian coordinate values of X', Y', and Z' as set forth in Table II, wherein:

the Cartesian coordinate values of X', Y', and Z' in Table II are non-dimensional values from 0% to 100% convertible to dimensional distances by multiplying the Cartesian coordinate values of X', Y', and Z' by a height of the airfoil defined along a Z' axis, the Z' axis being normal to an X', Y' plane and the height being expressed in units of distance;

the X' and Y' values of the nominal platform contour are coordinate values that, when connected by smooth continuing arcs, define contour lines of a portion of the nominal platform contour at each Z' coordinate value of a set of Cartesian coordinate values of X', Y', and Z' in Table II;

the platform has a height along the Z' axis; and the nominal platform contour lines lie in an envelope defined by distances within +/−5% of X' and Y' values of Table II, where the +/−5% value of X' and Y' values of Table II define a chord line for Z' at a defined constant Z' value and the +/−5% value of X' and Y' values of Table II define a platform contour envelope in a direction normal to any platform surface location.

2. The turbine rotor blade of claim 1, wherein a total surface area of the platform is defined between an outer periphery of the platform, which is defined by a leading edge, trailing edge, pressure edge, and suction edge of the platform, and a base of the airfoil.

3. The turbine rotor blade of claim 2, wherein a surface area of the first portion is equal to or greater than 50% of the total surface area of the platform; and wherein the height of the airfoil is between 3 and 10 inches.

4. The turbine rotor blade of claim 2, wherein a surface area of the first portion is equal to or greater than 75% of the total surface area of the platform; and wherein the turbine rotor blade is configured to function as a second stage turbine rotor blade in a turbine.

5. The turbine rotor blade of claim 2, wherein a surface area of the first portion is equal to 100% of the total surface area of the platform.

6. A turbine engine that includes a rotor blade having an airfoil, the airfoil comprising:

a nominal airfoil profile defined by a leading edge, a trailing edge, a pressure side extending between the leading edge and the trailing edge, and a suction side extending between the leading edge and the trailing edge opposite the pressure side;

a pressure side portion of the pressure side of the nominal airfoil profile being defined in accordance with a first set of Cartesian coordinate values of X, Y, and Z of the pressure side as set forth in Table I;

a suction side portion of the suction side of the nominal airfoil profile being defined in accordance with a second set of Cartesian coordinate values of X, Y, and Z of the suction side as set forth in Table I;

wherein, the Cartesian coordinate values of X, Y, and Z are non-dimensional values from 0% to 100% convertible to dimensional distances by multiplying the Cartesian coordinate values of X, Y, and Z by a height of the airfoil defined along a Z axis, the height expressed in units of distance;

the X and Y values of the pressure side are coordinate values that, when connected by smooth continuing arcs, define pressure side sections of the pressure side portion of the nominal airfoil profile at each Z coordinate value, the pressure side sections being joined smoothly with one another to form the pressure side portion extending from the leading edge to the trailing edge;

the X and Y values of the suction side are coordinate values that, when connected by smooth continuing arcs, define suction side sections of the suction side portion of the nominal airfoil profile at each Z coordinate value, the suction side sections being joined smoothly with one another to form the suction side portion extending from the leading edge to the trailing edge;

wherein the pressure side portion of the airfoil has a height along the Z axis, the first set of the X and Y values beginning at a first Z value relative to a base of the airfoil and extending toward a tip of the airfoil;

wherein the suction side portion of the airfoil having a height along the Z axis, the second set of the X and Y values beginning at the first Z value relative to the base of the airfoil and extending toward the tip of the airfoil; and wherein the nominal airfoil profile lies in an envelope +/−5% of any airfoil surface location defined by the Cartesian coordinate values X, Y, and Z of Table I in a direction normal to any of the suction side sections and the pressure side sections.

7. The turbine engine of claim 6, wherein the turbine engine comprises a gas turbine having a compressor, a combustor, and a turbine; and wherein the airfoil comprises a rotor blade in the turbine.

8. The turbine engine of claim 7, wherein the rotor blade is a second stage rotor blade in the turbine.

9. The turbine engine of claim 7, wherein the height of the suction side portion is less than the height of the airfoil; and wherein the height of the pressure side portion is less than the height of the airfoil.

10. The turbine engine of claim 9, wherein the height of the suction side portion and the height of the pressure side portion are the same; and wherein the height of the suction side portion and the height of the pressure side portion are each equal to or greater than 50% of the height of the airfoil.

11. The turbine engine of claim 10, wherein the height of the suction side portion and the height of the pressure side portion are each equal to or greater than 75% of the height of the airfoil.

12. The turbine engine of claim 10, wherein the turbine comprises a second stage that includes a row of second stage nozzles adjacent to a row of second stage rotor blades; and wherein a plurality of second stage rotor blades contained within the row of second stage rotor blades comprises the airfoil.

13. The turbine engine of claim 7, wherein the height of the suction side portion and the height of the pressure side portion are each equal to 100% of the height of the airfoil.

14. A turbine rotor blade comprising an airfoil that extends from a platform;

wherein the airfoil comprises: a) a pressure side of a nominal airfoil profile in accordance with Cartesian coordinate values of X, Y, and Z of a pressure side as set forth in Table I; and b) a suction side of the nominal airfoil profile in accordance with Cartesian coordinate values of X, Y, and Z of the suction side as set forth in Table I;

wherein:

the Cartesian coordinate values of X, Y, and Z of Table I are non-dimensional values from 0% to 100% convertible to dimensional distances by multiplying the Cartesian coordinate values of X, Y, and Z by a height of the airfoil defined along a Z axis;

the X and Y values of the pressure side are coordinate values that, when connected by smooth continuing arcs, define pressure side sections of the pressure side of the nominal airfoil profile at each Z coordinate value, the pressure side sections being joined smoothly with one another to form the pressure side;

the X and Y values of the suction side are coordinate values that, when connected by smooth continuing arcs, define suction side sections of the suction side of the nominal airfoil profile at each Z coordinate value, the suction side sections being joined smoothly with one another to form the suction side;

wherein the airfoil comprises at least one of:

a first set of the X and Y values of the pressure side defining a pressure side portion of the airfoil having a height along the Z axis, the first set of the X and Y values beginning at a first Z value relative to a base of the airfoil and extending toward a tip of the airfoil;

a second set of the X and Y values of the suction side defining a suction side portion of the airfoil having a height along the Z axis, the second set of the X and Y values beginning at the first Z value relative to the base of the airfoil and extending toward the tip of the airfoil; and wherein the platform comprises a nominal platform contour in accordance with Cartesian coordinate values of X', Y', and Z' as set forth in Table II;

wherein:

the Cartesian coordinate values of X', Y', and Z' of Table II are non-dimensional values from 0% to 100% convertible to dimensional distances by multiplying the Cartesian coordinate values of X', Y', and Z' by the height of the airfoil defined along a Z' axis; the Z' axis being normal to an X', Y' plane and the height being expressed in units of distance;

the X' and Y' values of the nominal platform contour are coordinate values that, when connected by smooth continuing arcs, define contour lines of a portion of the nominal platform contour at each Z' coordinate value of a set of Cartesian coordinate values of X', Y', and Z' in Table II;

the nominal platform contour lines lie in an envelope defined by distances within +/−5% of X' and Y' values of Table II, where the +/−5% value of X' and Y' values of Table II define a chord line for Z' at defined constant Z' values, and the +/−5% value of X' and Y' values of Table II define a platform contour envelope in a direction normal to any platform surface location.

15. The turbine rotor blade of claim 14, wherein the turbine rotor blade is configured to function as a second stage turbine rotor blade in a turbine; and wherein the height of the airfoil is between 3 and 10 inches.

16. The turbine rotor blade of claim 14, wherein the airfoil comprises both of the pressure side portion and the suction side portion of the nominal airfoil profile;

wherein the height of the suction side portion is less than or equal to the height of the airfoil;

wherein the height of the pressure side portion is less than or equal to the height of the airfoil; and wherein a total surface area of the platform is defined between an outer periphery of the platform, which is defined by a leading edge, trailing edge, pressure edge, and suction edge of the platform, and a base of the airfoil.

17. The turbine rotor blade of claim 16, wherein the height of the suction side portion and the height of the pressure side portion are each equal to or greater than 50% of the height of the airfoil; and wherein a surface area of the first portion is equal to or greater than 50% of the total surface area of the platform.

18. The turbine rotor blade of claim 16, wherein the height of the suction side portion and the height of the pressure side portion are each equal to or greater than 75% of the height of the airfoil; and wherein a surface area of the first portion is equal to or greater than 75% of the total surface area of the platform.

19. The turbine rotor blade of claim 16, wherein the height of the suction side portion and the height of the pressure side portion are each equal to 100% of the height of the airfoil; and wherein a surface area of the first portion is equal to 100% of the total surface area of the platform.

* * * * *